US010082375B2

(12) United States Patent
McCloy

(10) Patent No.: US 10,082,375 B2
(45) Date of Patent: Sep. 25, 2018

(54) MALFUNCTION TRAINING DEVICE FOR FIREARMS

(71) Applicant: Stephen A. McCloy, Boise, ID (US)

(72) Inventor: Stephen A. McCloy, Boise, ID (US)

( * ) Notice: Subject to any disclaimer, the term of this patent is extended or adjusted under 35 U.S.C. 154(b) by 0 days.

(21) Appl. No.: 15/622,948

(22) Filed: Jun. 14, 2017

(65) Prior Publication Data

US 2017/0363398 A1 Dec. 21, 2017

Related U.S. Application Data

(60) Provisional application No. 62/351,273, filed on Jun. 16, 2016, provisional application No. 62/452,728, filed on Jan. 31, 2017.

(51) Int. Cl.

| | |
|---|---|
| ***F42B 8/00*** | (2006.01) |
| ***F42B 8/08*** | (2006.01) |
| *F41A 33/00* | (2006.01) |

(52) U.S. Cl.

CPC ..... *F42B 8/08* (2013.01); *F41A 33/00* (2013.01)

(58) Field of Classification Search

CPC ..... F41A 33/00; F42B 8/08
USPC ..... 102/444, 529
See application file for complete search history.

(56) References Cited

U.S. PATENT DOCUMENTS

| | | | | |
|---|---|---|---|---|
| 119,357 A | | 9/1871 | Hobbs | |
| 225,464 A | * | 3/1880 | Coloney | F42B 7/10 102/439 |
| 1,585,075 A | * | 5/1926 | Boyce | F42B 6/00 102/444 |
| 2,882,821 A | * | 4/1959 | Benson | F42B 8/08 102/444 |
| 6,189,454 B1 | | 2/2001 | Hunt | |
| 6,305,290 B1 | * | 10/2001 | Stimmell | F42B 8/08 102/439 |
| 8,979,537 B2 | | 3/2015 | Stone | |
| 2014/0096427 A1 | | 4/2014 | Bonner | |

(Continued)

OTHER PUBLICATIONS

Sealed Mindset™ Concealed Carry Masters Course DVD Cover and Screenshots, including hard malfunction device, at least as early as Dec. 31, 2014.

(Continued)

*Primary Examiner* — Samir Abdosh
(74) *Attorney, Agent, or Firm* — Pedersen and Company, PLLC; Ken J. Pedersen; Barbara S. Pedersen

(57) ABSTRACT

A firearm malfunction training device and method include a blank malfunction round that simulates a T3 malfunction and allows a realistic clearing protocol during the training. The malfunction round size and shape generally mimic the corresponding live round, so that malfunction round moves like the live round through the magazine. However, the malfunction round has a front end/portion that is oversized in diameter and does not fit properly or fully through the firearm breech, to jam the firearm loading mechanism at the breech. Preferably, the malfunction round also has a conical rear region radially-undersized relative to the live round casing, whereby the malfunction round leaves the magazine when the magazine is stripped from the firearm to start the clearing protocol. The enlarged front end and undersized rear region effectively simulate, and provide a realistic protocol for identifying, clearing and, correcting, a T3 malfunction.

21 Claims, 45 Drawing Sheets

(56) References Cited

U.S. PATENT DOCUMENTS

2015/0219413 A1 8/2015 Karimullah et al.
2017/0363398 A1* 12/2017 McCloy ..... F42B 8/08

OTHER PUBLICATIONS

Internet images for various live rounds and .38 AMU live round, at least as early as Jun. 8, 2016.

* cited by examiner

MALFUNCTION TRAINING DEVICE FOR FIREARMS

This application claims benefit of Provisional Application 62/351,273, filed Jun. 16, 2016, and Provisional Application Ser. No. 62/452,728, filed Jan. 31, 2017, both of which are incorporated herein by this reference.

BACKGROUND OF THE INVENTION

Field of the Invention

The invention relates generally to firearms, and more specifically to a blank "dummy" or "malfunction" ammunition round that is provided to intentionally create a malfunction in the operational sequence of a firearm. The created malfunction from the malfunction round is used with otherwise live ammunition as a "live-fire" training event for shooters to practice recognizing and correcting the malfunction.

Related Art

U.S. Published Patent Application US2015/0219413 Karimullah et al discloses two types of malfunctions for semi-automatic, or self-loading, firearms in paragraphs # [0004] and #[0005]. The first malfunction is caused by the chambered round of ammunition misfiring, or not firing, leaving a not-completely-discharged round in the chamber that must be cleared out before the weapon can be fired again properly. This first type of malfunction is referred to, for example, as a "T-1 (Type 1) malfunction", "live trigger stoppage", or "phase-one stoppage".

Another type of malfunction identified in this '413 Karimullah et al reference is a "T3 (Type 3) malfunction", "dead trigger stoppage", or "double-feed stoppage", which typically occurs when a round fails to eject from the chamber due, for example, to faulty ammunition or a damaged spent round extractor. In this case, a second round tries to automatically feed into the chamber, but is blocked by the un-ejected round. The spring pressure on the firearm's self-loading mechanism, to push the second round forward into firing position, pushes the front of the second round against the back of the un-ejected first round, and jams and disables the firearm. In order to clear the jammed firearm, the shooter must forcibly remove the magazine, manually remove both the un-ejected and blocked rounds, and ensure that both the chamber and magazine well are clear. Then, the shooter may insert a loaded magazine, and cycle the loading mechanism to result in a live round in the chamber, ready to fire. This disclosed technology is directed at a "dummy" ammunition round for shooter training to identify and resolve this "double-feed stoppage" or "T3 malfunction".

U.S. Published Patent Application US2014/0096427 Bonner also discloses these failure-to-fire and double-feed firearm malfunctions in paragraphs #[0012] and #[0013], as well as other firearm malfunctions in paragraphs #[0014]-#[0019].

However, both the '413 Karimullah et al and the '427 Bonner references discussed above disclose devices related to these firearm malfunctions that are not structurally similar to Applicant's herein disclosed technology.

SUMMARY

A firearm malfunction training device and methods are disclosed. The training device is provided in the form of a blank, malfunction ammunition round. The malfunction round is generally similarly sized and shaped as a corresponding live round of the same caliber for the same make and model of firearm being used in training, so that the malfunction round operates well in the magazine. However, the malfunction round has an oversized-diameter front end or front end portion(s) in the region where the projectile is located in the corresponding live round. This way, the malfunction round does not fit properly or fully through the breech (breech-face opening) at the back/proximal end of the chamber, and, upon loading, the malfunction round jams the firearm at this location. Therefore, the simulated T3 malfunction is accomplished not with any round, live or dummy, in the chamber, but, instead, with any previous spent round ejected from the firearm, and the malfunction round abutting into/against the breech and not capable of being loaded properly in the chamber. Upon jamming, the malfunction round simulates a "T3 malfunction" or "double-feed stoppage", and the firearm is immediately in a state where the shooter can practice the protocol to identify, understand, clear and correct this type of jam.

Preferred embodiments comprise a special modification in the casing and/or base/primer region of the malfunction round, to adapt the malfunction round for separation from the magazine at the desired time for realistic clear and correction training. The special modification may be an axially-elongated, undersized-diameter region, preferably a conical region, just distal of the base/primer region. This axially-elongated, undersized-diameter region allows the malfunction round to separate from the magazine, upon stripping of the magazine in an early step in the clearing/correcting of the malfunction; this way, the realism of the training protocol is enhanced because there is no need to add the step of removing the malfunction round from the magazine before reinserting the magazine into the firearm.

DETAILED DESCRIPTION OF CERTAIN EMBODIMENTS

Referring to the Figures, there are shown an exemplary conventional semi-automatic pistol and an exemplary conventional AR-15 rifle, which are two but not the only firearms with which the disclosed malfunction rounds may be used. Also referring to the Figures, there are shown exemplary live ammunition rounds according to the prior art, and multiple, but not the only, embodiments of the malfunction round according to the invention. The malfunction round is also called herein a "dummy round" or "dummy cartridge" or "blank" in view of the malfunction round preferably comprising no powder or primer or any means of ignition or explosion associated with the malfunction round.

Certain embodiments of the malfunction round may be described as a dummy/blank round with an enlarged, simulated-projectile-portion, that is, an enlarged front end or front-end-portion. The enlarged front end or front-end-portion is configured, typically by being slightly oversized at one or more locations around the circumference of the front end, to prevent entry into the chamber at the back end of the barrel. The front end or front-end-portion is therefore prevented from fitting properly or fully through the opening into the chamber (the opening being called the "breech" or "breech-face opening"). Further, the malfunction round and its enlarged front end/portion are configured to not bind up in the magazine including not inside the magazine and not at the top opening of the magazine, to not interfere with the travel of live rounds in the magazine, and to not interfere with the internal moving parts of the firearm. This malfunction round is for the purpose of simulating the condition of the Type 3 Malfunction, which is considered by many to be the most serious malfunction of a firearm fight. The disclosed malfunction round allows the military, law enforcement and responsibly-armed people to practice experiencing and clearing this type of malfunction under live-fire training conditions, which is a vital handgun training/survival skill.

Figure 1:
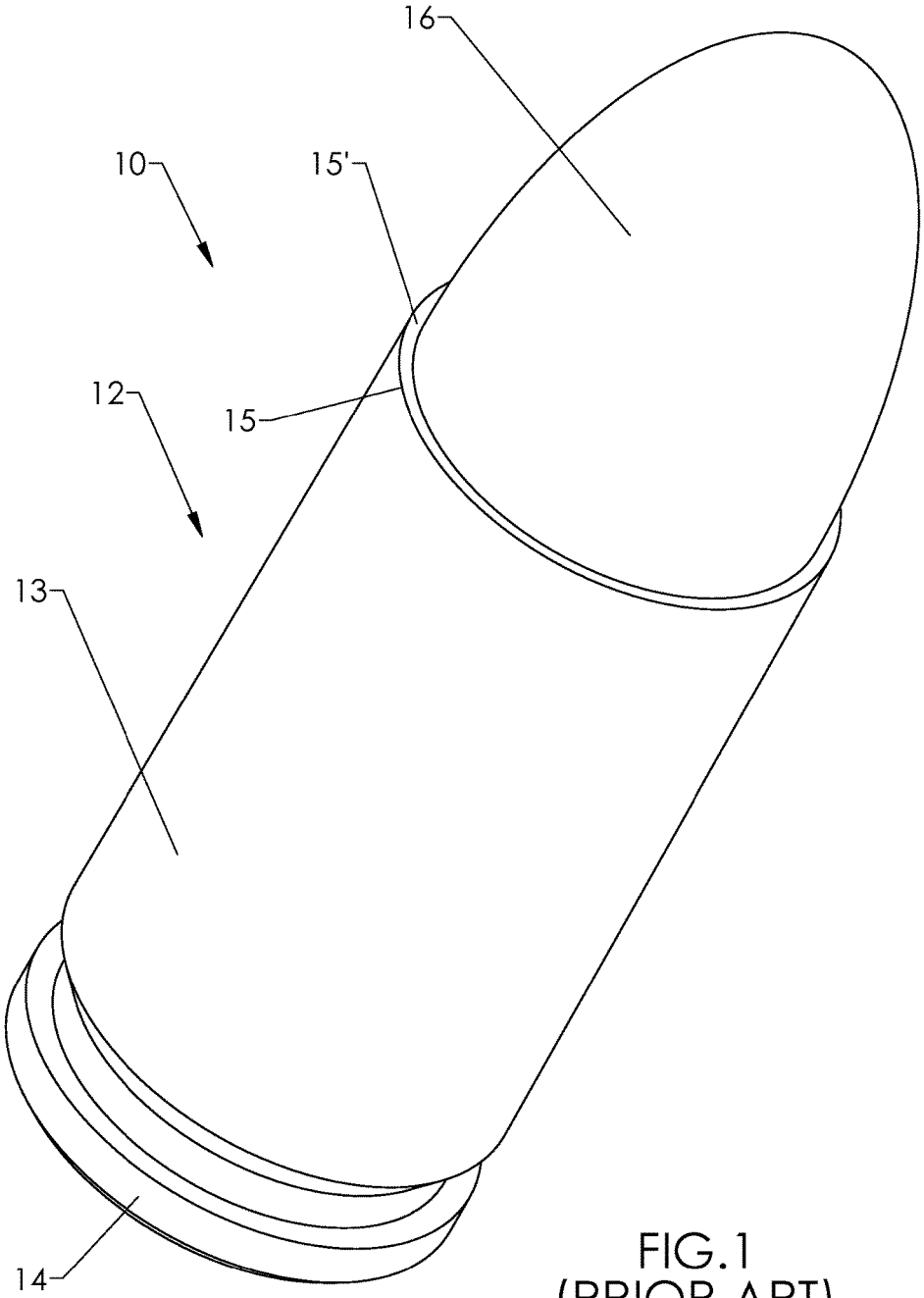
FIG.1 (PRIOR ART)
FIG. 1 is a front, side perspective view of an exemplary prior art live ammunition round according to the prior art.

FIG. 1 depicts one exemplary live ammunition round 10 according to the prior art. The term "live" is meant "ready to fire", wherein an assembled ammunition round 10 comprises a cartridge casing 12, filled with powder (not shown) and comprising main portion 13 and a base/primer 14 at the back end of the cartridge casing 12, and a projectile 16 in front of the casing 12. Distal edge 15 is larger in diameter than the maximum diameter of the projectile 16, and hence forms shoulder 15'. Projectile 16 is typically connected to casing 12 by its proximal end being received inside distal edge 15 of casing 12 in a tight friction fit that allows separation of the projectile from the casing upon firing.

Live ammunition rounds exist in many conventional sizes and shapes, commonly referred to as "make", "model" and "caliber". Typically, "make" means the name of the manufacturer of the firearm or the round. Typically, "model" means the name or number of the particular type of firearm in the line of firearms made by the manufacturer. Typically, "caliber" refers to the largest outer diameter of projectile 16, which is typically slightly smaller than the inner diameter of the corresponding firearm barrel. The term "caliber" is often used when identifying a firearm, as an indication of the largest projection outer diameter the firearm is configured to use. Within a certain make, model and caliber round may be different powder loadings, different base/primers 14 and different projectiles 16. Typical common calibers for pistols include 0.17, 0.22, 0.35, 0.38, 9 mm, 10 mm, 0.40, 0.44, 0.45 and 0.50, among others.

Figure 2A:
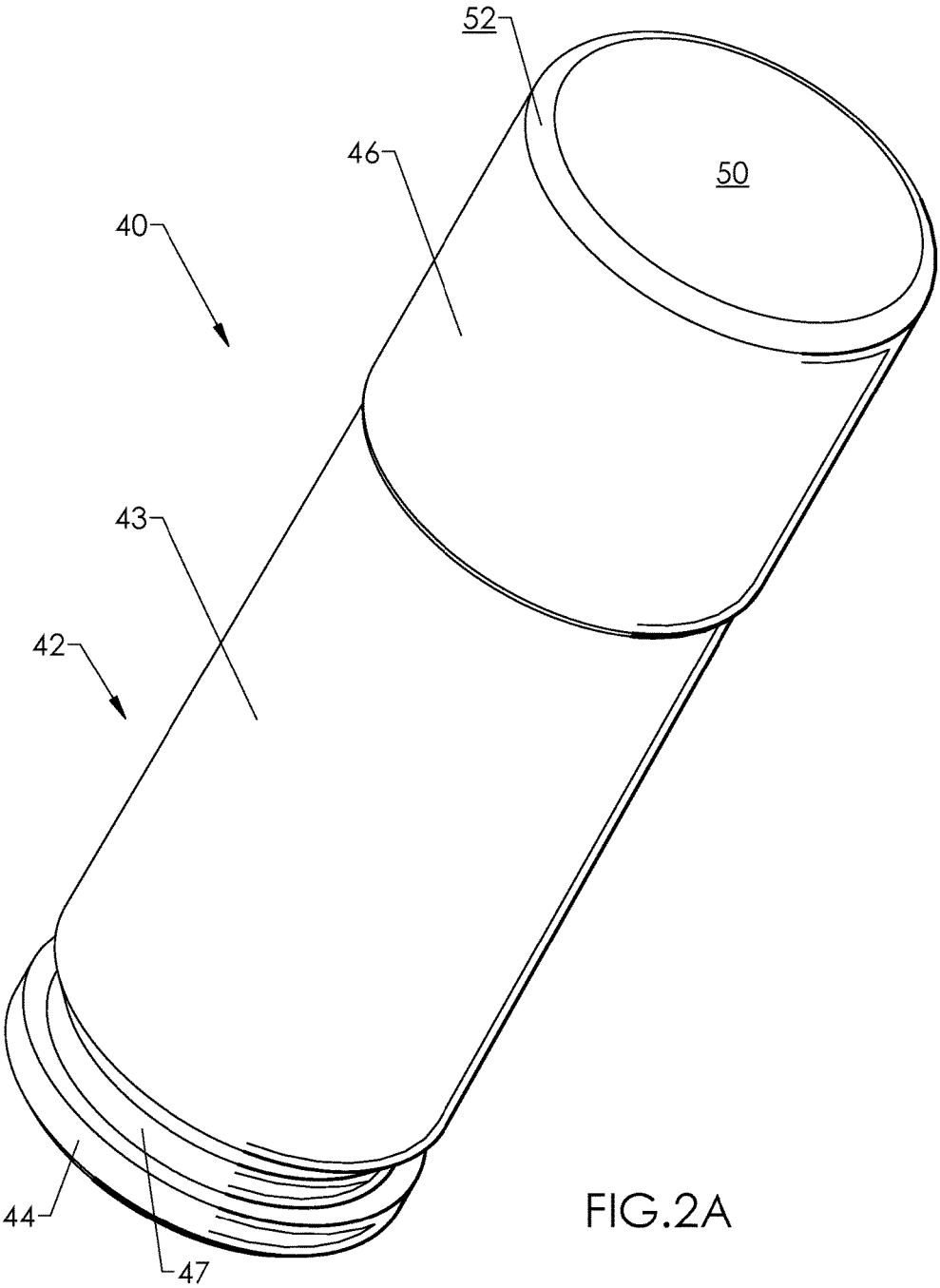
FIG. 2A is a front, side perspective view of one embodiment of a malfunction round according to the invention.
Figure 2B:
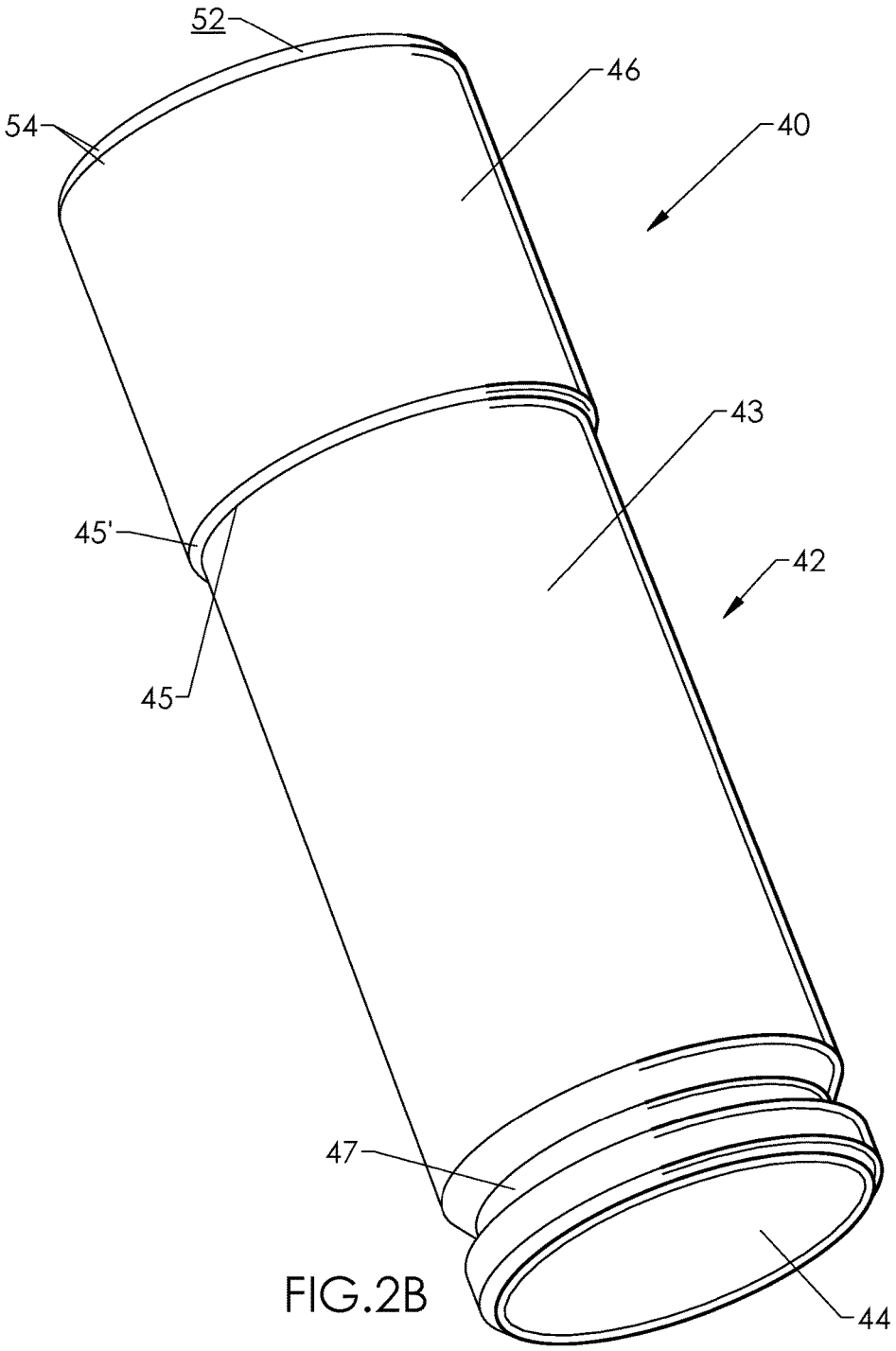
FIG. 2B is a rear, side perspective view of the malfunction round of FIG. 2A.
Figure 3:
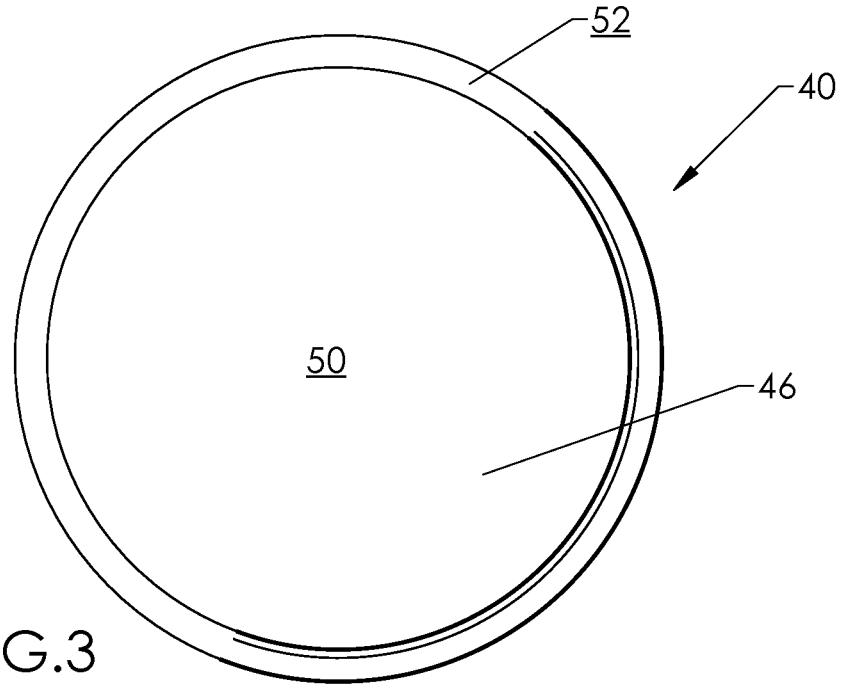
FIG. 3 is a front view (or "front end" view) of the malfunction round of FIGS. 2A and B.
Figure 4:
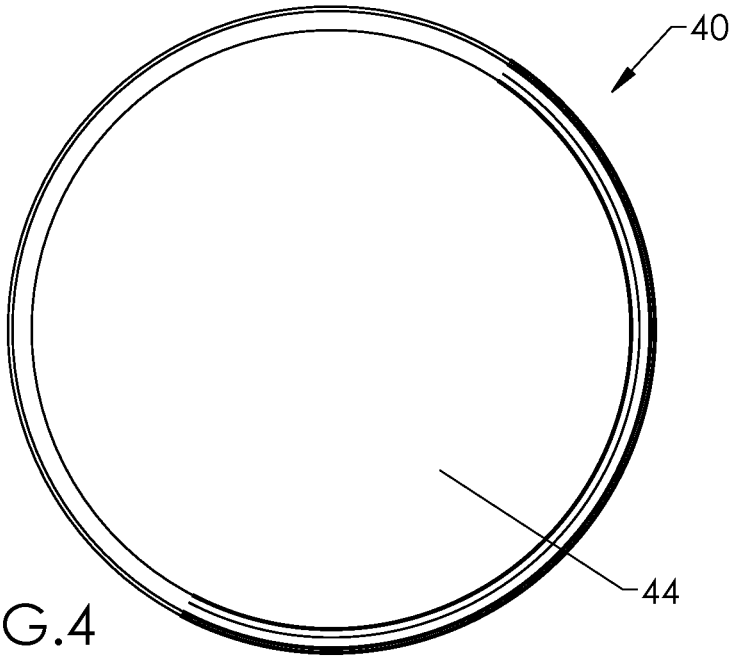
FIG. 4 is a rear view (or "rear end" view) of the malfunction round of FIGS. 2A and B.
Figure 5:
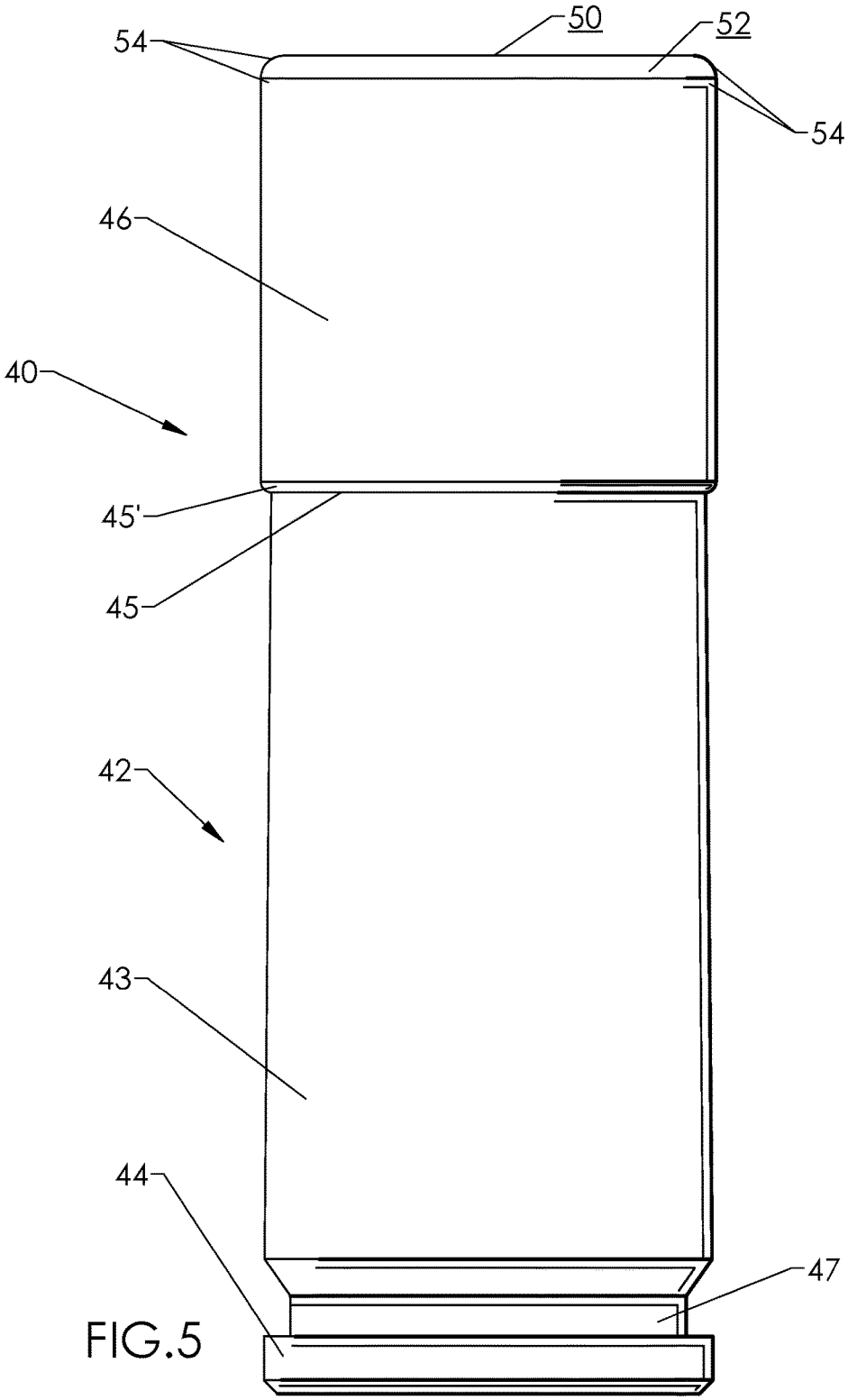
FIG. 5 is a right side view of the malfunction round of FIGS. 2A and B, wherein the top side, bottom side, and left side views will be the same as FIG. 5, due to the generally cylindrical shape, and symmetry around the longitudinal axis, of the malfunction round.

FIGS. 2A and B, and 3-5, depict one embodiment of blank, malfunction round 40 that may be used in combination with a live round such as that portrayed in FIG. 1, for example, for use in certain embodiments of conventional pistols, including but not necessarily limited to GLOCK™ pistols. Malfunction round 40 has an enlarged front end that extends along a substantial amount of the axial length of the round, and is cylindrical. Certain alternative malfunction rounds are also portrayed in the drawings, including malfunction rounds 231-239 in FIGS. 6A-I, malfunction round 240 in FIGS. 20A-25, malfunction round 240' in FIG. 25, malfunction round 340 in FIGS. 35-39, and malfunction round 440 in FIGS. 49-53. These alternative malfunction rounds comprise: 1) a radially-enlarged flared front end (round 231); 2) a radially-enlarged flared front end, with small flats/notches recessed relative to the flared portion(s) (round 232), and 3) radially-enlarged flared portions such as protrusions or fins, with surfaces separating the protrusions or fins that are recessed relative to the protrusions/fins. The surfaces that are relatively-recessed (simply "recessed surfaces") may include elliptical surfaces (round 233), conical/semi-conical/curved surfaces (round 234), or flat/planar surfaces (round 232, 235, 236, 237, 238, 239). Malfunction rounds 40, 240, 240', 340, and 440 are described in detail below, from which malfunction rounds 231-239 also will be well understood.

Preferably, the malfunction rounds correspond generally in dimensions with corresponding exemplary prior art rounds for the same make, model, and caliber of firearm. By "corresponding" is meant "compatible fit" in the sense that a malfunction round according to the herein invention fits in, and is operable within, the magazine for a conventional firearm of the same make, model and caliber. For example, if a shooter owns a GLOCK™ Model #19 in 9 mm caliber, and is interested in training to rectify T3 malfunctions for this firearm, the shooter needs to obtain and load in the GLOCK's™ #19 9 mm magazine at least one malfunction round made according to the present invention for that make, model, and caliber.

Therefore, referring again to FIGS. 2A-5, malfunction round 40 has central cylindrical or generally cylindrical section 42, also called "main body" 42, which comprises a central main portion 43 and base/back end 44. The generally cylindrical section 42 of malfunction round 40 corresponds generally to the casing 12 of live round 10, wherein base/back end 44 corresponds generally to live round base/primer 14 of live round 10. Main portion 43 may be slightly-tapered from a larger diameter at its back end to a smaller diameter at its distal end/edge (or "front edge"), as is conventional in the casings of many live rounds. The enlarged front end 46 of malfunction round 40 may be called a "front end cap" that is cylindrical and has a uniform diameter all along its axial length, and that takes the place of projectile 16 of live round 10. Enlarged front end 46 is radially-enlarged relative to all of: the projectile of the corresponding live round 10, the maximum diameter of the casing of the corresponding live round 10, the maximum diameter of main body 42 of malfunction round 40, and the diameter of the distal edge 45 of section 42 of the malfunction round 490 (thus, forming shoulder 45' between the main body 42 and the front end 46).

Figure 7A:
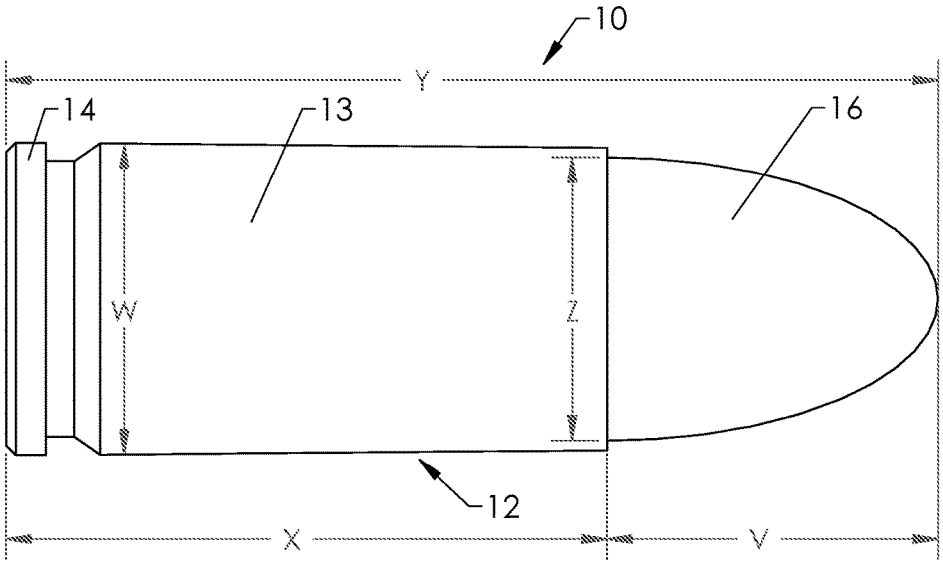
FIG.7A (PRIOR ART)
FIG. 7A is a side view of the exemplary prior art live ammunition round of FIG. 1, with dimension variables V, W, X, Y and Z indicated.

FIG. 7A depicts dimensions V, W, X, Y, and Z for exemplary prior art live round 10. Dimension V is the length of the projectile 16. W is the maximum outer diameter (O.D.) of casing 12 including main portion 13 and base/primer 14. Dimension X is the length of casing 12, including main portion 13 and base/primer 14. Dimension Y is the total length of the live round 10, including casing 12 and projectile 16. Dimension Z is the maximum O.D. of projectile 16.

Figure 7B:
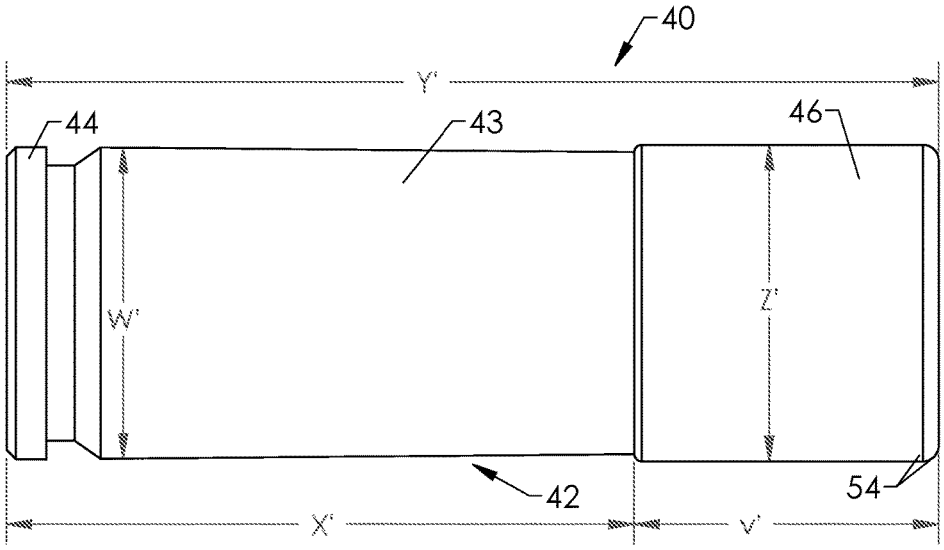
FIG. 7B is a side view of the malfunction round of FIGS. 2A-5, with dimension variables V', W', X', Y' and Z' indicated, for comparison to the live round of FIG. 7A.

FIG. 7B depicts dimensions V', W', X', Y' and Z' for malfunction round 40 according to certain embodiments of the invention. Dimension W' is the maximum O.D. of central generally cylindrical section 42 including main portion 43 and base/back end 44, which is typically on the main portion 43 just distal of the groove 47. Dimension X' is the length of said central generally cylindrical section 42. Dimension Y' is the total length of malfunction round 40. Dimension V' is the length of the front end 46, and dimension Z' is the maximum O.D. of the front end 46 of malfunction round 40.

Therefore, FIG. 7A and FIG. 7B are general representations of live round 10, and a corresponding malfunction round 40, respectively, wherein the dimensions of live round 10 and the dimensions of malfunction round 40 are not necessarily drawn to scale in the drawings for certain embodiments. Dimensions V, W, X, Y, and Z of live round 10 may be different for various calibers, brand names, and grains for the live rounds, and magazine types and breech diameters, for multiple corresponding hand guns. Dimensions V', W', X', Y', and Z' of malfunction round 40 may be adapted so that malfunction round 40 optimally cooperates with said multiple corresponding hand guns of various calibers, brand names, and magazine types and breech diameters. Exemplary adaptations are shown in Tables 1-4 and discussed in the Detailed Description of Provisional Application Ser. No. 62/452,728, filed Jan. 31, 2017, incorporated herein.

Dimension Z' of malfunction round 40, the largest diameter of the front end of round 40, is larger than each of: 1) the I.D. of the breech; 2) dimension W' of malfunction round 40; 3) dimension W of the live round casing, wherein W' is the same as W in many embodiments; 4) dimension Z of the live round; and 5) the caliber. Dimension Z' of malfunction round 40 may be from 0.000 (the same, for an exemplary GLOCK 43) up to approximately 0.004 inches larger than the breech I.D.; approximately 0.007-0.019 inches larger than dimension W' of round 40 and of dimension W; approximately 0.037-0.079 inches larger than dimension Z of the live round; and approximately 0.01-0.08 inches larger than the caliber number. For many handguns and corresponding magazines, dimension Z' of malfunction round 40 is the same or up to approximately 1.0 percent larger than the I.D. of the firearm breech; approximately 1.8-5.1 percent larger than dimension W' of malfunction round 40 and of dimension W; approximately 8.3-22 percent larger than dimension Z of the live round; and approximately 2-21 percent larger than the caliber number.

The inventor has determined that, to make malfunction rounds more universal and to account for manufacturing variances in both firearms and the malfunction rounds, dimension Z' of the preferred malfunction rounds will be in the range of 0.01 to 0.02 inches or in the range of about 0.01 to about 0.02 inches (0.005-0.025 inches), larger than the breech I.D. of the corresponding firearm as reported by in the SAAMI™ (Sporting Arms and Ammunition Manufacture' Institute, Inc.) specifications, which are well-known in the industry.

Figure 8:
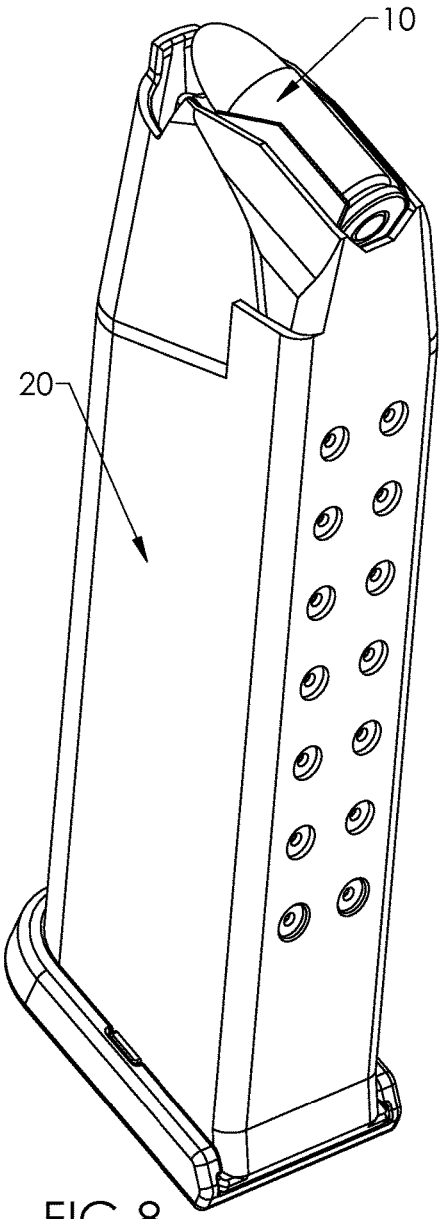
FIG.8 (PRIOR ART)
FIG. 8 is a rear perspective view of a magazine loaded so that an exemplary prior art live ammunition round, such as that shown in FIGS. 1 and 7A, is at the top of the magazine.
Figure 9:
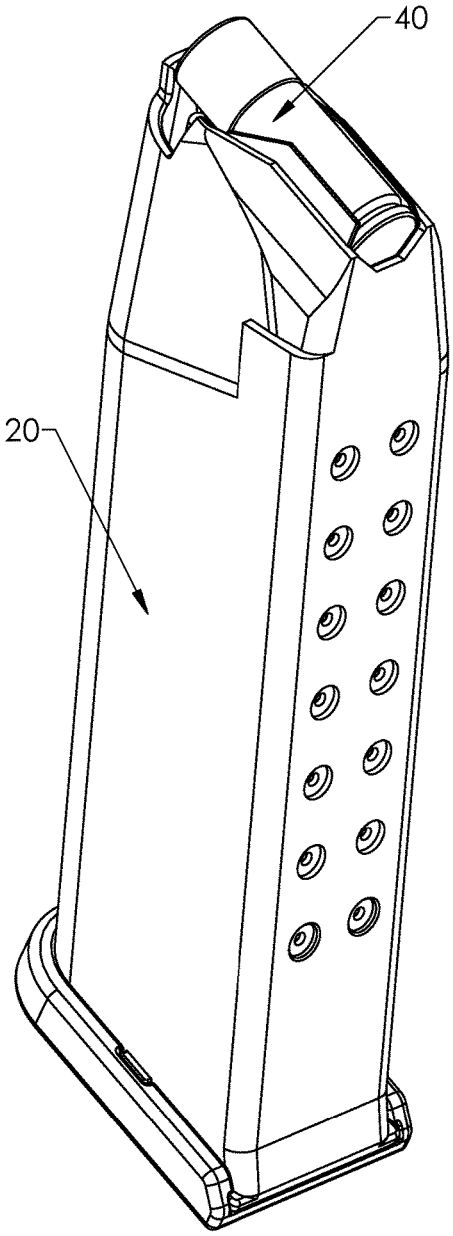
FIG. 9 is a rear perspective view of the magazine of FIG. 8 loaded so that the malfunction round of FIGS. 2A-5 is at the top of the magazine.

Referring again to the figures illustrating malfunction round 40, and a simulated malfunction for training purposes using malfunction round 40, FIG. 8 and FIG. 9 depict live round 10, and malfunction round 40, respectively, loaded in conventional magazines 20, wherein the two magazines are the same, including the same design, shape and size. Each live ammunition round 10 and each malfunction round 40 operates properly in the magazine 20. For example, each of round 10 and round 40 fits properly in, and moves smoothly along the length of, the magazine 20 to reach the top position in the magazine shown in FIGS. 8 and 9, without interfering with the higher-up or lower-down live round(s) 10 or malfunction round(s) 40 in the magazine. For training, one or more of the malfunction rounds 40 will be stacked with one or more corresponding live rounds 10 in a single magazine 20. The relative numbers of live and malfunction rounds and the order of stacking in the magazine will be determined by the trainer, but, typically, multiple live rounds 10 and a lesser number, or even only one, malfunction round 40 will be stacked in the magazine.

The malfunction round 40 is adapted/configured so that it does have a compatible fit with, and does operate properly in, the firearm's magazine. This compatible fit and proper operation in the magazine comprises two components/features, specifically: 1) that the malfunction round 40 fit and move properly inside the magazine and not interfere with movement of the surrounding live rounds 10 in the magazine; and 2) that the malfunction round 40 fit and move properly relative to the magazine top opening to approach but not fully or properly enter the breech. Malfunction round 40 comprises generally cylindrical section 42, comprising generally cylindrical main portion 43 and generally cylindrical base/back end 44, wherein section 42 has the same or very similar shape as the casing 12 of the corresponding live round 10. This sameness or similarity helps prevent improper positioning, wobbling, jamming, or interference with the other rounds 10, 40 in the magazine 20. To be compatible with the magazine 20 and the magazine top opening, the maximum diameter W' of the cylindrical section 42 must be less than the width of the magazine interior space, and typically maximum diameter W' is the same as, or very nearly the same as, the maximum diameter W of casing 12, to prevent the round 40 from becoming stuck in the magazine interior space.

Adaptations may be made in certain embodiments to further ensure that the malfunction round works smoothly in, and easily leaves the magazine top opening during the malfunction clearing/solving process, in multiple magazines and multiple firearms. Adaptations may be made to provide a single shape for the malfunction round that operates well in many different handguns and magazine, with only slight changes in the lengths and diameters, for example, slight changes in X', V', W', and/or Z'. For example, in certain embodiments, section 42, base/back end 44, and/or groove 47 may be of different shapes compared to the live round counterpart, for example, to allow proper fit and operation in a variety of magazines and handguns. Further, the lengths of the section 42 and front end 46, and the entire length of the malfunction round 40, may be different compared to the live round counterpart.

Figure 10:
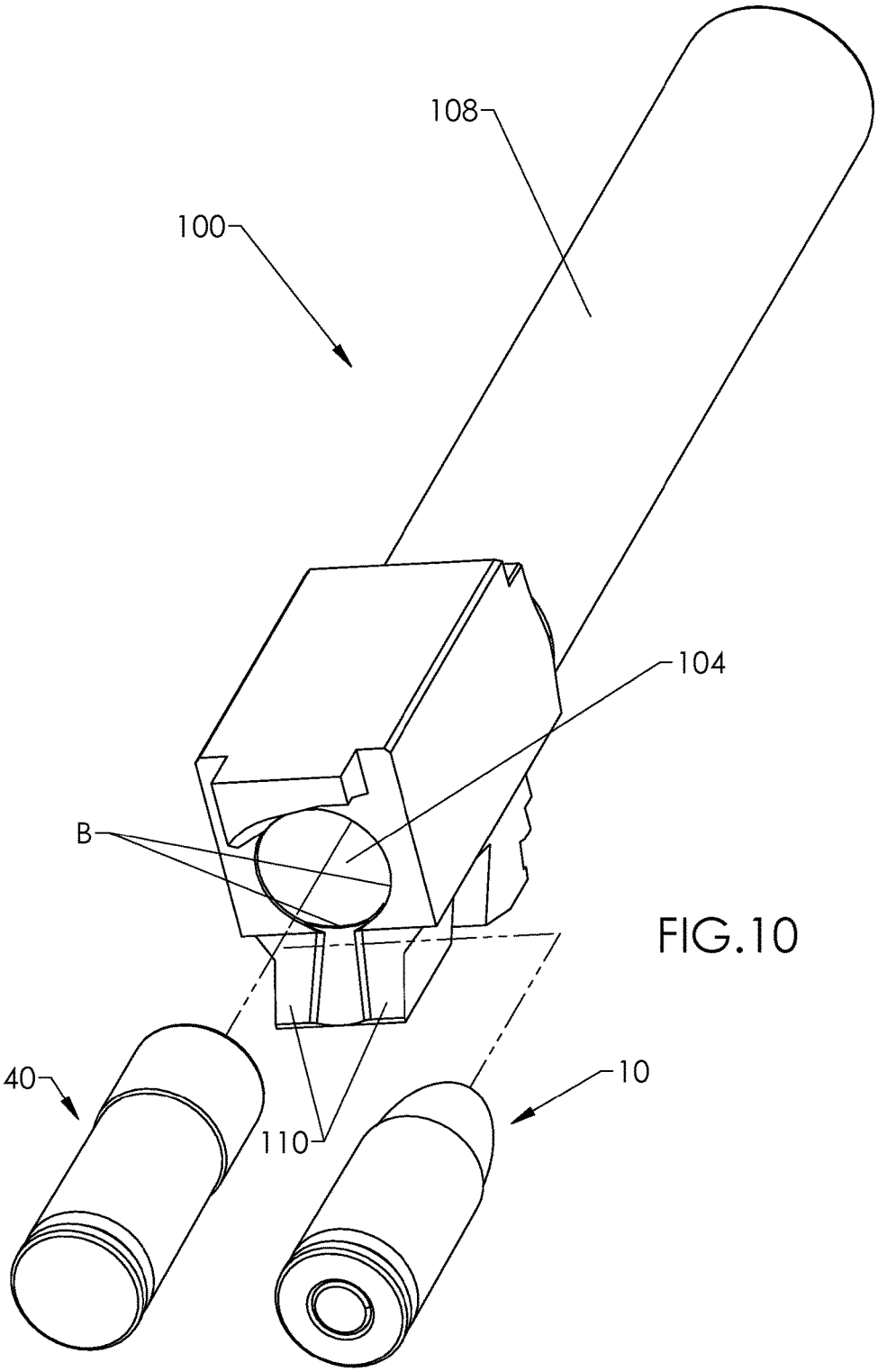
FIG. 10 is a schematic, rear perspective view of the exemplary prior art live ammunition round of FIGS. 1 and 7A on the lower right, and the malfunction round of FIG. 2A-5, on the lower left, and their general relationship to the breech and chamber, at the back end of the barrel part of a firearm.

In conventional operation of the firearm, live rounds are "fed" from the top of the magazine, through the breech, and into the chamber. FIG. 10 depicts a rear view of a chamber 104 at the back end of the barrel part 108 for a conventional exemplary firearm 100 (partially shown in FIG. 10). Those of skill in the art will know that a longitudinal bore (not entirely shown) extends through the entire barrel part from the chamber at the rear/proximal end of the barrel, to the projectile-exit opening at the distal end of the barrel.

In this Description, the term "chamber" is the preferred terminology for referring to the proximal end space of the barrel part 108 that is configured for receiving live rounds in the "ready-to-fire" position. A breech block surrounding and defining the chamber has a proximal "breech face" plane/surface, referenced as BF in FIGS. 15 and 17. The proximal opening into the chamber, which is an opening in the breech-face, is typically called the "breech", referenced as B in FIG. 10 by pointing to the proximal edge defining the breech. When properly loaded in the chamber, firing will send the projectile 16 through the barrel bore while retaining the casing 12 in the chamber by means of a "shelf" between the chamber and the barrel bore, for ejection prior to loading of the next round. Therefore, the term "breech diameter" is used for the inner diameter of the proximal opening into the chamber, "chamber inner diameter" is used for the chamber diameter generally midway between the breech and the barrel bore, and the "barrel bore inner diameter" is the inner diameter of the bore distal of the chamber. Notations on the SAAMI™ Appendix A of Provisional Application Ser. No. 62/452,728, filed Jan. 31, 2017, incorporated herein, illustrate the locations of these firearm structures. The chamber inner diameter typically is slightly larger than the inner diameter of the barrel bore, and slightly smaller than the breech diameter, as also may be seen on the SAAMI™ sheet of Appendix A of Provisional Application Ser. No. 62/452,728, incorporated herein.

FIG. 10 also depicts exemplary prior art round 10 and malfunction round 40. Each round, after reaching the top of the magazine (as in FIGS. 8 and 9) according to the order of stacking in the magazine, is then pushed separately to near the bottom of loading ramp 110 of chamber 104 by the force of the lift spring in the magazine (not shown in FIG. 10) of firearm 100. While rounds 10, 40 are orientated in this schematic drawing to be straight behind the chamber, with dashed lines from the round 10, 40 coaxial with the central axis of the chamber, it will be understood that, in normal operation, a round approaches the chamber, from the magazine, slightly below the chamber, to slide up and forward on the lower ramp 110 toward the chamber 104. When exemplary prior art round 10 reaches the top of the magazine, and when it is of the proper make, model and caliber for firearm 100, smooth, unobstructed passage of round 10 up loading ramp 110, through the breech, and into chamber 104 is obtained. This way, exemplary round 10 may be effectively fired in, and the remaining casing 12 then ejected from, chamber 104. Then, according to the loading mechanism of firearm 100, the next available live round 10 at the top of the magazine may be effectively lifted and smoothly pushed into chamber 104 for the next shot. This is repeated, for each live round 10, as the shooter continues to shoot, until all rounds 10 are spent or until a malfunction round 40 reaches the top of the magazine as discussed below.

When malfunction round 40 reaches the top of the magazine, however, the slightly-oversized nature of its front end 46 does not fit properly or entirely through the breech, and therefore, does not fit properly or entirely in the chamber 104 as would live round 10. This way, round 40 stops at or partially in the breech, typically partially on loading ramp 110, thereby jamming and disabling the firearm according to a simulated T3 malfunction. "Fit properly" and "not fit properly" will be understood by those of skill in the art; a proper fit in the chamber means in an orientation and position for effective firing of a live round, parallel to the longitudinal axis of the chamber and barrel, and typically with the base/back end 44 generally aligned/even with the breech forward of the ramps (see live round 10 in FIG. 13).

The effect of the dimensions of the malfunction round 40 vs the live round 10 is illustrated in FIGS. 11-19. Operation of a prior art, semi-automatic pistol using conventional live rounds is portrayed in FIGS. 11-15, and operation of the same pistol using a combination of live round and a malfunction round is portrayed in FIGS. 16-19.

Figure 11:
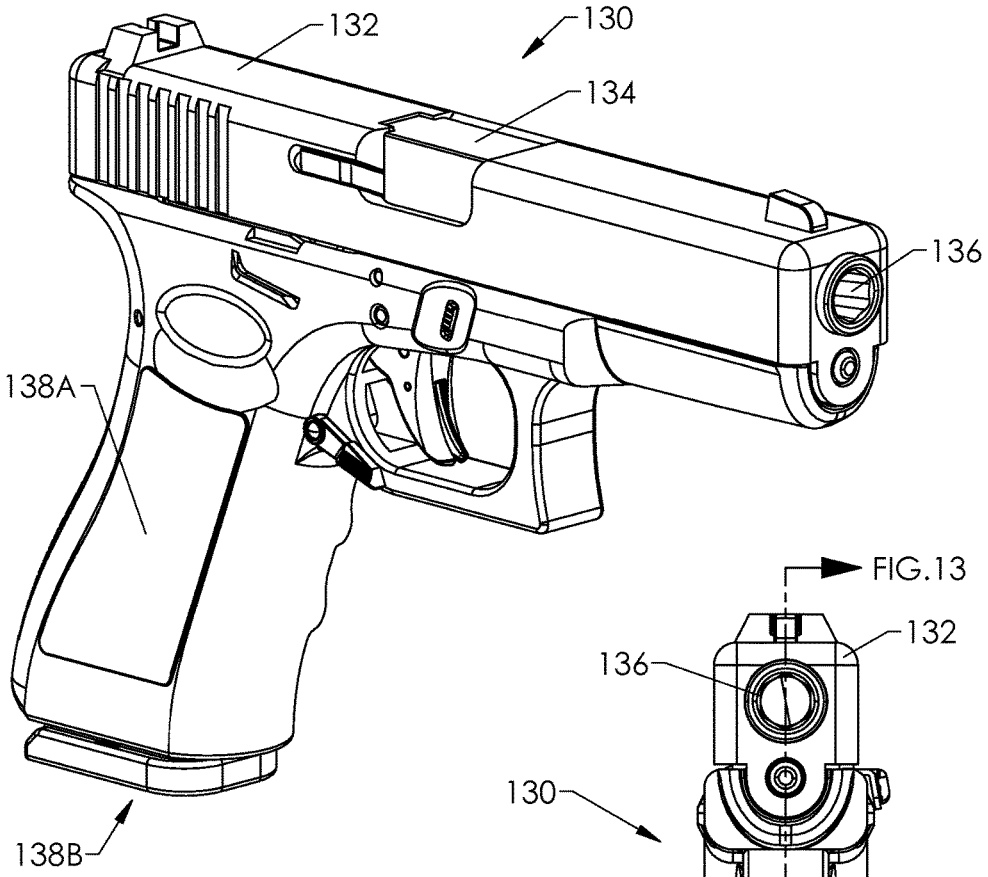
FIG.11 (PRIOR ART)
FIG. 11 is a front, right-side perspective view of an exemplary semi-automatic pistol according to the prior art.

FIG. 11 depicts a popular semi-automatic pistol 130 of the prior art, namely a GLOCK™ #19 9 mm caliber. The pistol 130 has action slide mechanism 132 with an ejection opening 134 and barrel 136 surrounded by the slide mechanism 132. Pistol 130 has handle, or grip, 138A, which has within it magazine 138B, the base of which magazine is visible in FIG. 11.

Figure 12:
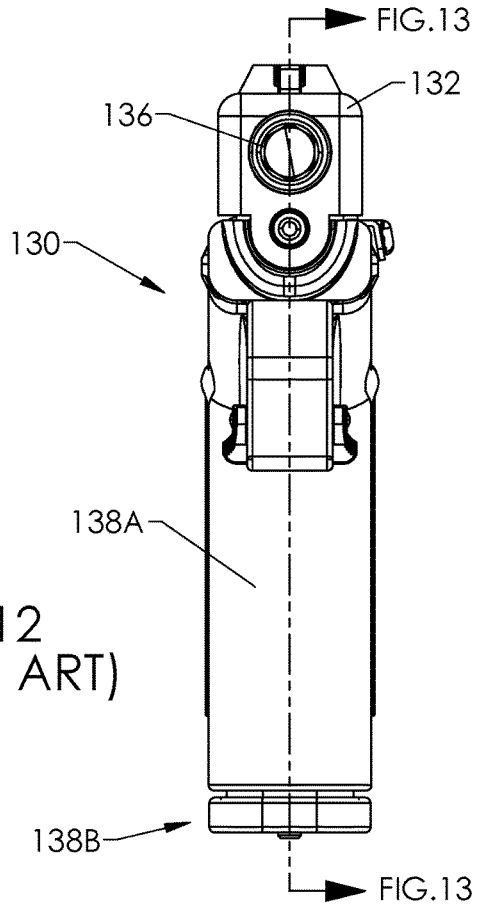
FIG.12 (PRIOR ART)
FIG. 12 is a front view of the pistol depicted in FIG. 11.

FIG. 12 is a front view of the pistol depicted in FIG. 11.

Figure 13:
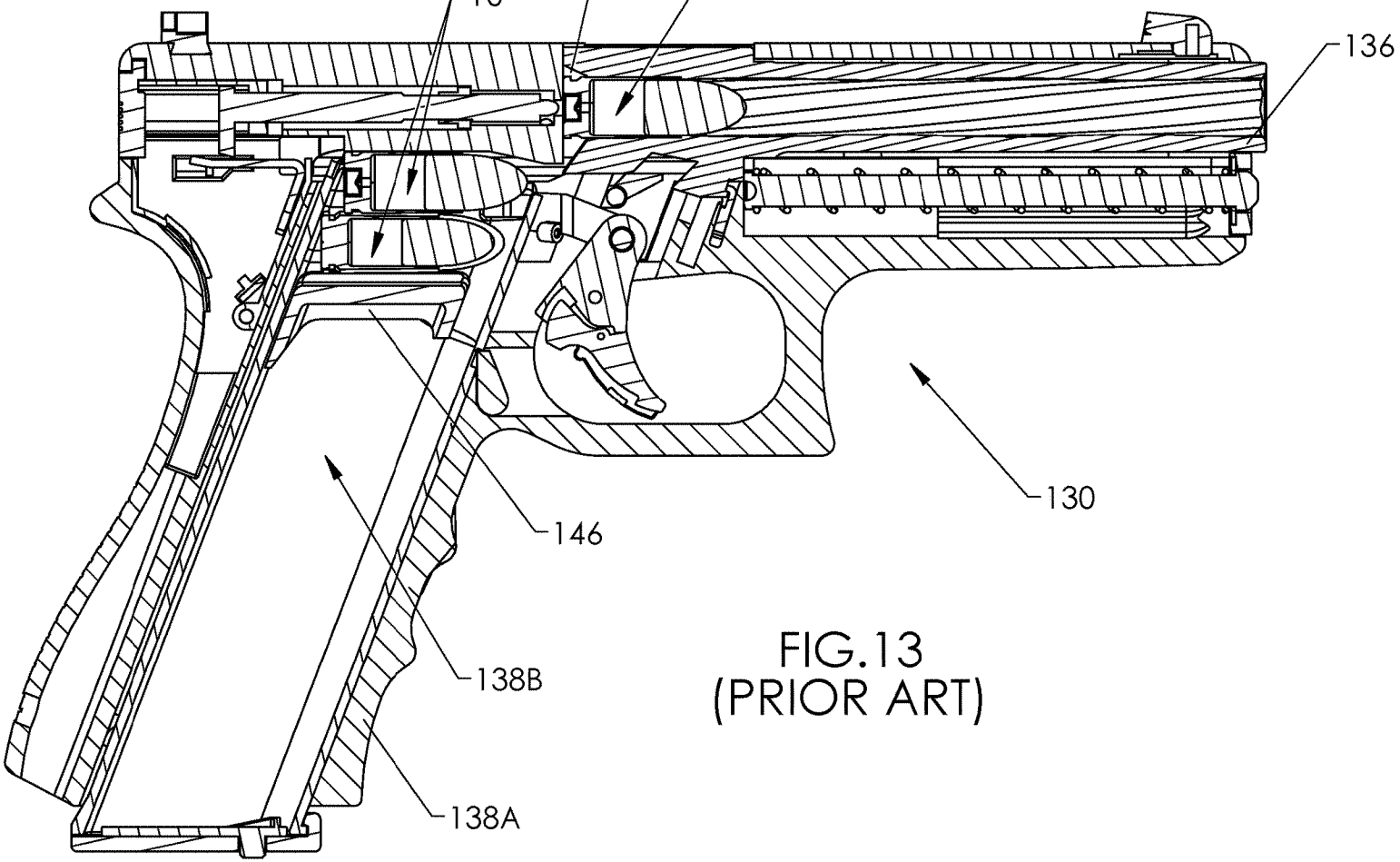
FIG. 13 (PRIOR ART)
FIG. 13 is a right side, cross-sectional view of the pistol depicted in FIGS. 11 and 12, along the FIG. 13-FIG. 13 line in FIG. 12, with the exemplary live ammunition round of FIGS. 1 and 7A in the chamber, and two exemplary live ammunition rounds of FIGS. 1 and 7A at the top of the magazine, with the loading mechanism in the "ready-to-fire" position. The lift spring in the magazine is not shown in this Figure.

FIG. 13 depicts a side, cross-sectional view of the pistol depicted in FIGS. 11 and 12, along the FIG. 13-FIG. 13 line of FIG. 12. The pistol has one exemplary live ammunition round 10 in the pistol chamber 142, and two exemplary live ammunition rounds 10' on round elevator 146 at the top of the magazine 138B, with the loading mechanism in the "ready-to-fire" position. The magazine 138B lift spring that pushes up on round elevator 146 to lift rounds 10 into chamber 142 is not shown in this Figure but will be understood to be present by those of skill in the art.

Figure 14:
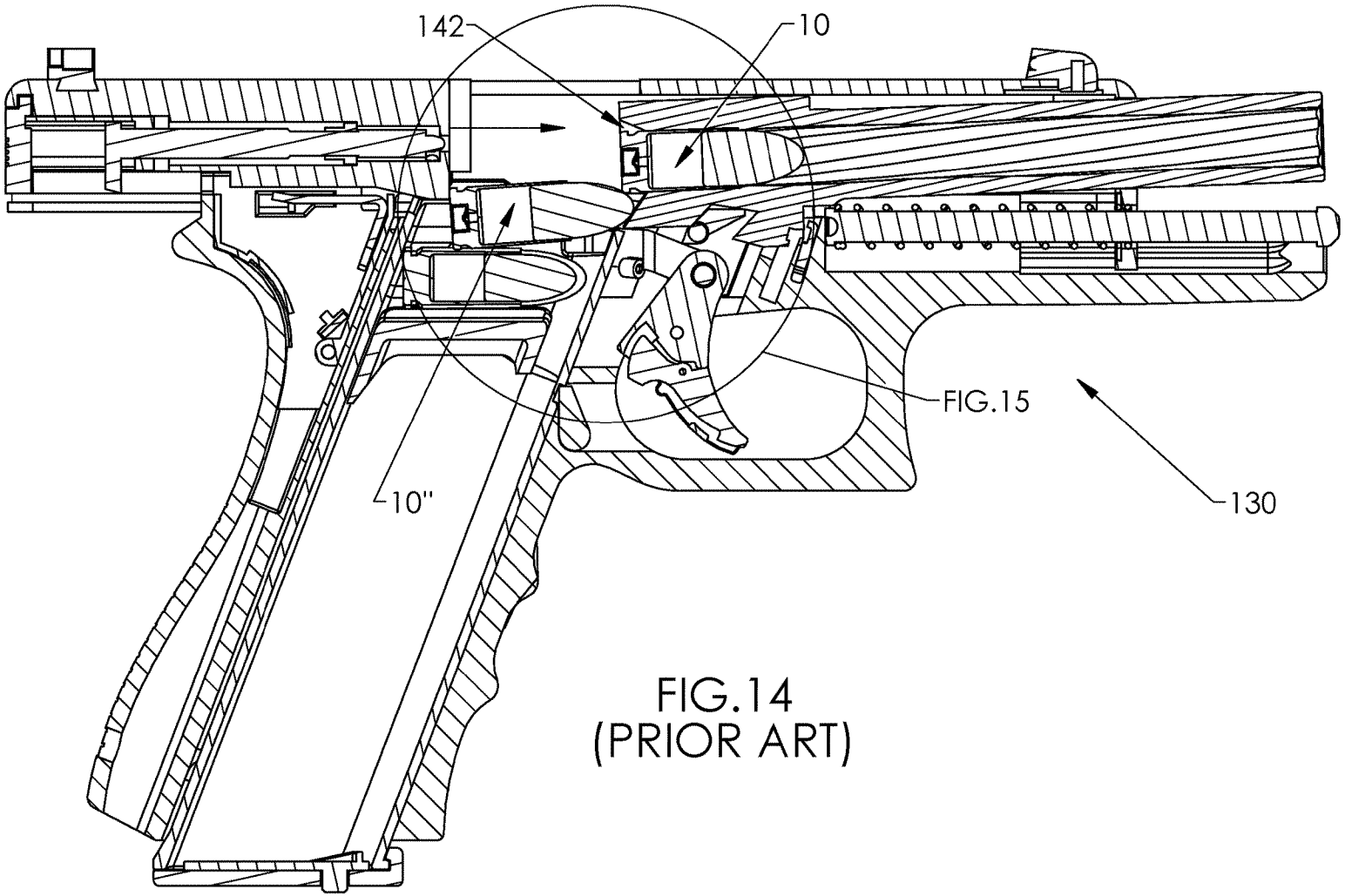
FIG.14 (PRIOR ART)
FIG. 14 is the same view as FIG. 13, except that the exemplary round in the chamber has failed to eject, the loading mechanism is in the "ready-to-load" position, and the top live round in the magazine is blocked by the un-ejected round, representing the beginning of a conventional "T3 malfunction" or "double-feed stoppage" of the firearm.

FIG. 14 depicts the same view as FIG. 13, except the exemplary round 10 in the chamber 142 has failed to eject, and the top live round 10" in the magazine 138B is blocked by the un-ejected round 10, representing a T3 malfunction of the firearm.

Figure 15:
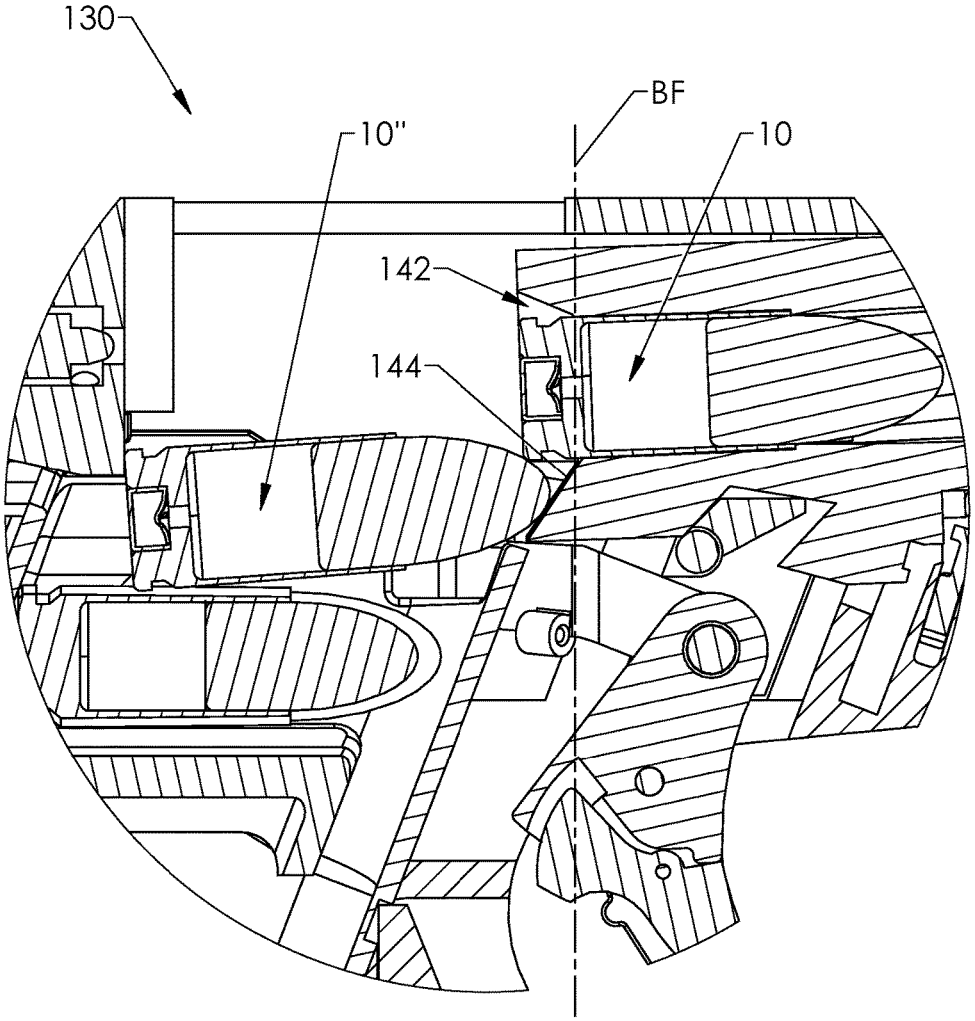
FIG.15 (PRIOR ART)
FIG. 15 is a magnified, detail view of the circled portion of FIG. 14.

FIG. 15 is a magnified, detail of the area circled in FIG. 14, which is the area of particular concern during the T3 malfunction of the firearm, as described above regarding FIG. 14. This magnified view shows to best advantage loading ramp 144 at the entrance to chamber 142, wherein the base 14 of un-ejected round 10 is blocking top live round 10" from sliding up the lower ramp 144, through the breech, and into the chamber 142.

Figure 16:
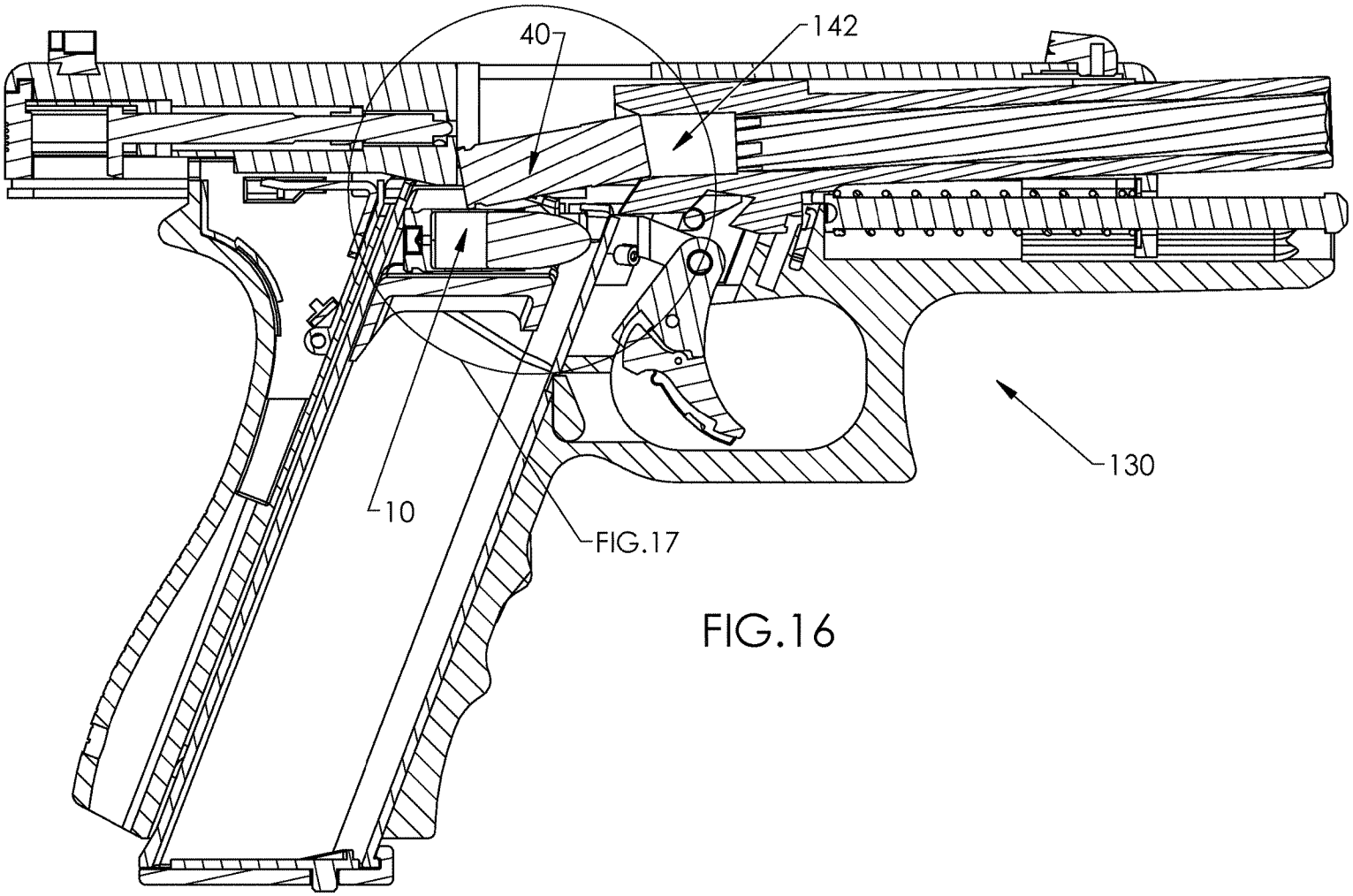
FIG. 16 is the same view as FIG. 14, except that the "T3 malfunction" has been simulated by the presence of the malfunction round of FIGS. 2A-5, at the top of the magazine, which has become jammed at the entrance to the chamber of the pistol, that is, at/near the breech.

FIG. 16 is the same view as FIG. 14, except the "T3 malfunction" has been simulated by the presence of an embodiment of the malfunction round. Malfunction round 40 is partially protruding from the magazine and jammed at the entrance to the chamber 142, specifically at/in the breech. In this situation, the prior, spent round has been properly ejected, and the malfunction round 40 is the first round at the top of the magazine. Therefore, unlike the "natural" T3 Malfunction illustrated in FIGS. 13 and 14, there is no round or any other object in conventional position in the breech/chamber blocking round 40 from entering the chamber 142. Instead, it is the enlargement of the front end 46 of the malfunction round 40 that prevents malfunction round 40 from properly/fully passing through the breech and entering the chamber 142.

Figure 17:
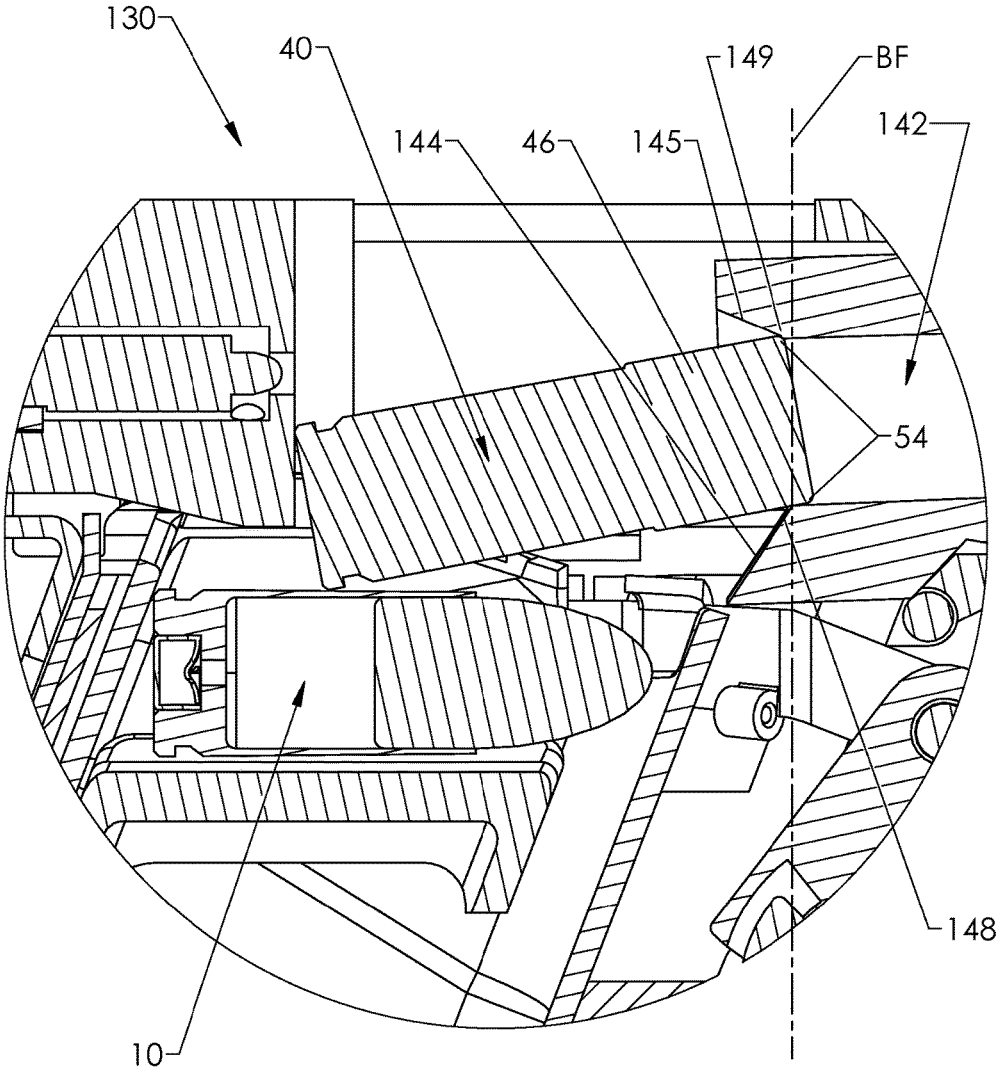
FIG. 17 is a magnified, detail view of the circled portion of FIG. 16.

FIG. 17 is a magnified, detail of the area circled in FIG. 16, which is the area of particular concern during this simulated T3 malfunction of the firearm that has been caused by use of the malfunction round 40. This magnified view shows to best advantage that no un-ejected round is in the chamber 142, so the chamber 142 is substantially empty, but that the malfunction round 40, with its enlarged front end 46 is jammed at/in the breech. This is due to the size and shape of the front end 46 not allowing the round 40 to slide on/past the ramps 144, 145, through the breech, and fully into the chamber 142. This view shows to best advantage how the "corners" 54 of round 40 abut against the ramps 144, 145 and/or the surface of the breech edge (or "corners" of the breech edge, in cross-sectional views) 148, 149 near the ramps 144, 145. As shown by FIGS. 16 and 17, jammed round 40 is slanted at an angle relative to, and therefore not parallel to, the longitudinal axis of the chamber and the barrel bore.

Once the jam is identified and understood by the shooter, the jam may be corrected by clearing round 40 out of its jammed position in FIGS. 16 and 17. The enlargement of front end 46 being at least at or near the front extremity of the round 40 is advantageous, so that round 40 jams at or very near the breech, for example at the breech edge 148, 149. This way, the round 40 does not go very far into the chamber, and does not become lodged inside the chamber and certainly not in the barrel bore, and the resulting jam closely simulates the jam shown in FIGS. 14 and 15. Therefore, it will be understood that having a pointed or otherwise small diameter front end 46 front extremity, with the front end enlargement farther back to the middle or rear of front end 46, may allow round 46 to go farther into the chamber, and may not be as good a simulation of the natural jam in FIGS. 14 and 15.

Figure 18:
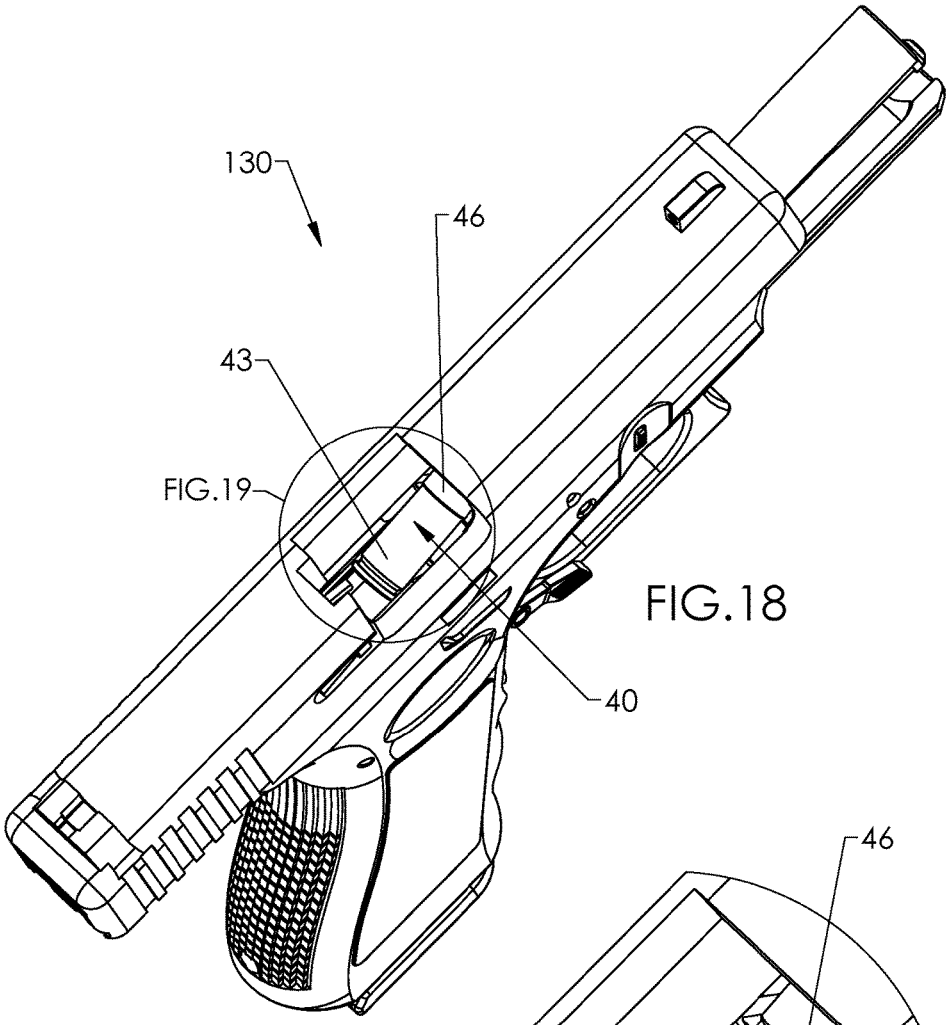
FIG. 18 is a top, perspective view of the pistol in the state depicted in FIG. 16.
Figure 19:
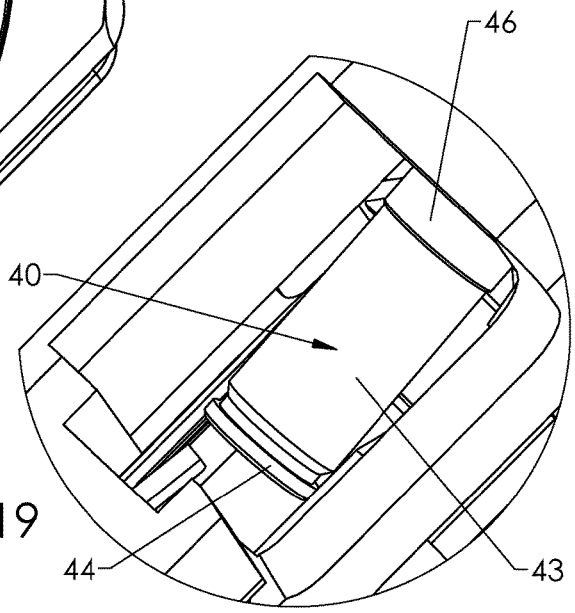
FIG. 19 is a magnified, detail view of the circled portion of FIG. 18.
Figure 20A:
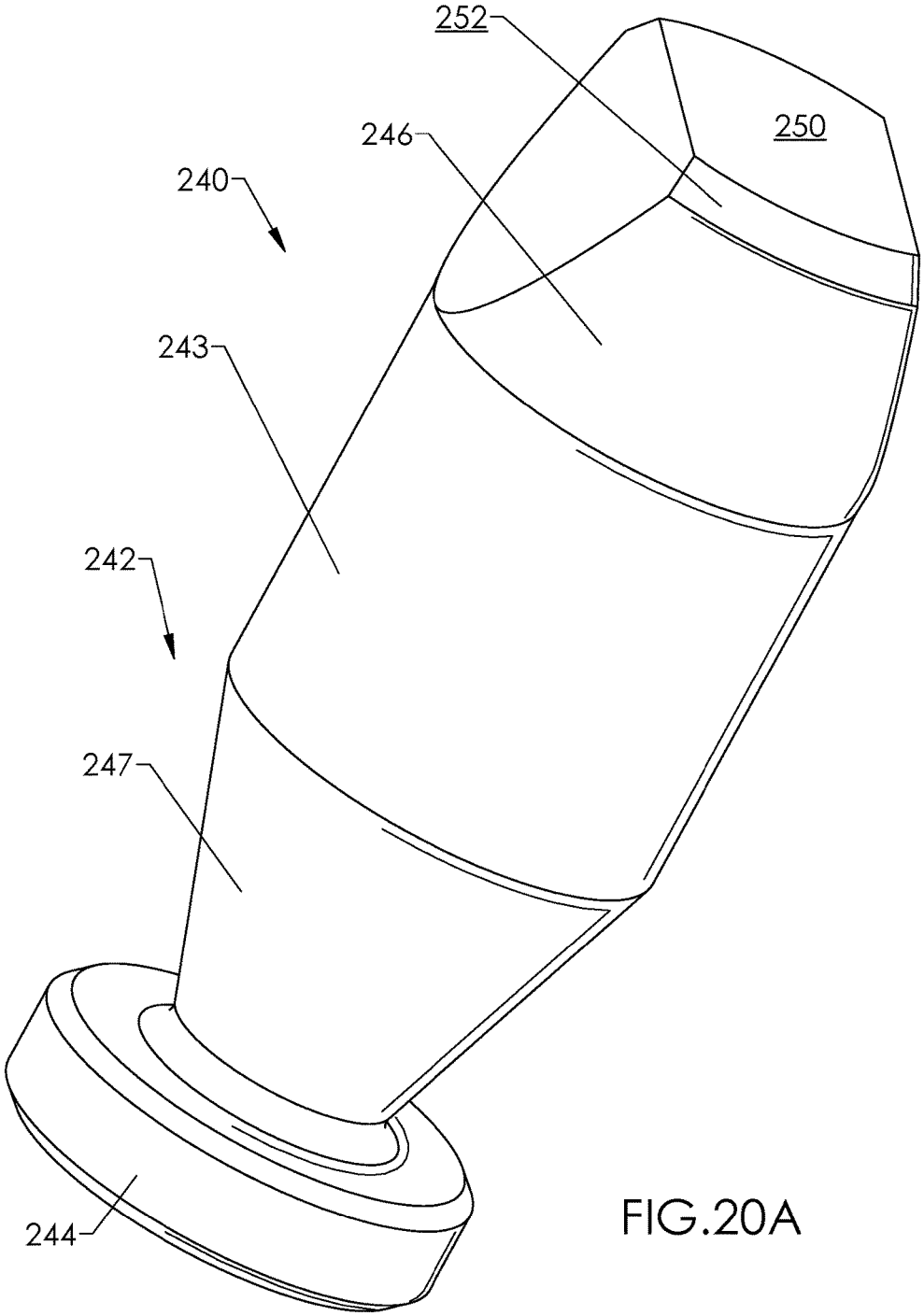
FIG. 20A is a front, side perspective view of a malfunction round according to an alternative embodiment of the invention, of the type of, and very similar to, the malfunction round of FIG. 6F.
Figure 20B:
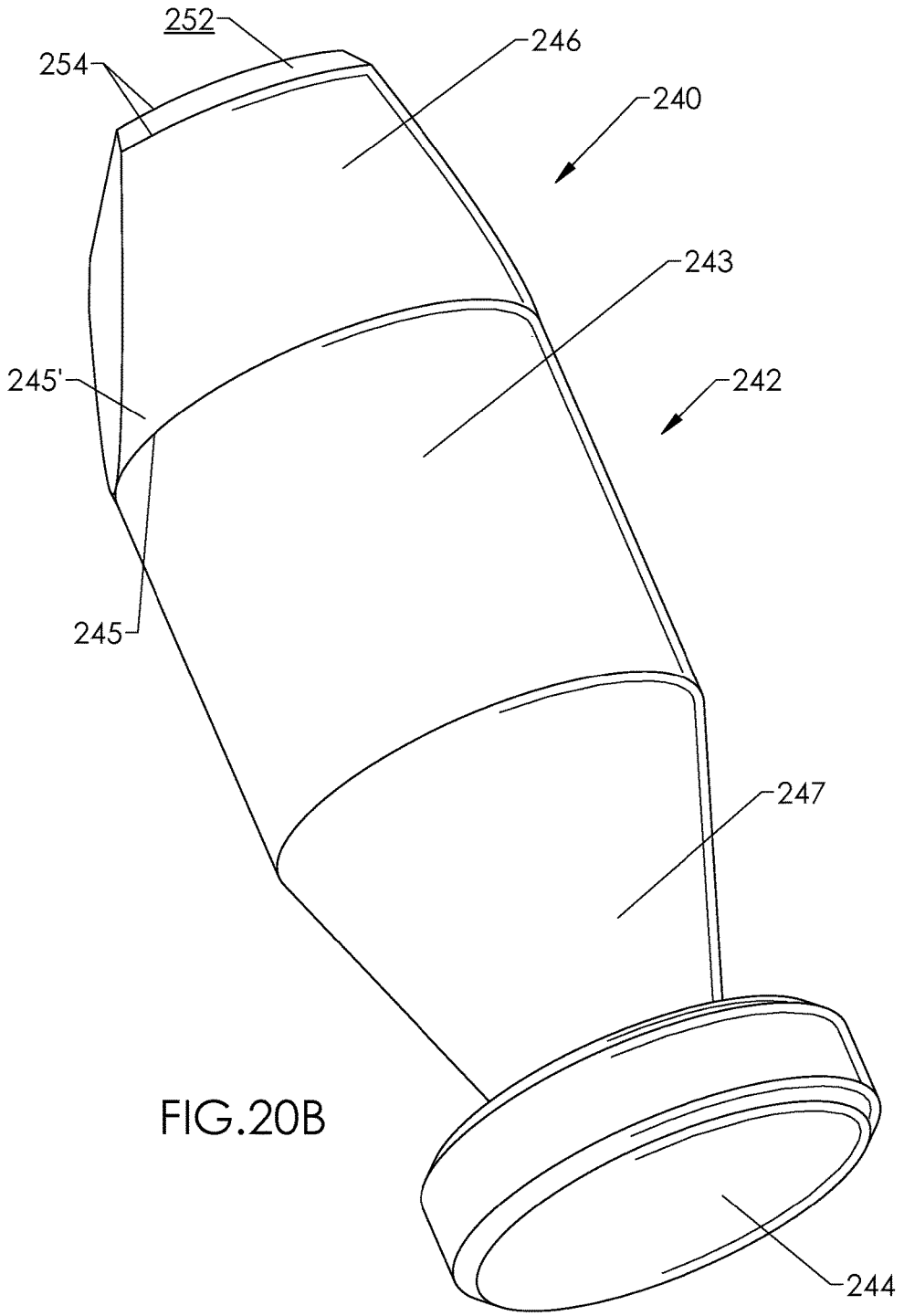
FIG. 20B is a rear, side perspective view of the malfunction round of FIG. 20A.

FIG. 18 is a top, perspective view of the pistol in the state depicted in FIG. 16, with the majority of round 40 outside of the chamber 142 and visible through the ejection opening 134, but the front end 46 jammed in the breech at or near the ramps 144, 145. FIG. 19 is a magnified, detail view of the circled portion of FIG. 18.

As understood from the above description and the drawings, malfunction round 40 is a single, generally cylindrical piece, having a front extremity, a rear extremity, a longitudinal axis between said front and rear extremities, and having no piece/part that protrudes radially from the longitudinal axis any distance greater than does the enlarged front end or front end portion from the longitudinal axis. The entire front end 46 of round 40 is a slightly-enlarged, cylindrical or generally cylindrical shape, and is symmetric or generally symmetric around the longitudinal axis of the round. The front extremity of front end 46 is front surface 50, which is transverse to the longitudinal axis of the round, generally flat, and only slightly-rounded, or chamfered at about 45 degrees, at its circular outer perimeter surface 52. Even in view of the chamfered perimeter surface 52, one may say that more than 90 percent, or more than 95 percent, of the length of front end 46 has an enlarged outer diameter that is the maximum diameter of the entire front end. Given that the front end 46 is the front 20-40 percent of the length of the round 40 in certain embodiments, one may say that the enlarged portion of round 40 extends along substantially the entire 20-40 percent of the length of the round.

The preferred malfunction rounds are "blanks", in that they do not include primer or powder and therefore are not operable for firing. Further, the front end of the preferred malfunction round, corresponding generally to the projectile of the live round, does not normally detach from or become separated from the section of the round that corresponds generally to the casing of the live round.

Attempted loading of malfunction round 40, as shown and described regarding FIGS. 16-19, results in the malfunction round 40 jammed in the breech, with only a small portion if any, extending into the chamber, and no portion reaching the barrel bore of barrel part 108. In the jammed position, corners 54 abut against one or more surfaces at or near the breech. Thus, in most embodiments, only 1-40 percent, more preferably 1-20 percent or 1-10, and most preferably 1-5 percent, of the length of the jammed malfunction round, is inside the chamber, that is, in a position that is distal of the breech (see breech edge 148, 149). Said portion of the malfunction round inside the chamber is typically a portion (see corner 54) of the malfunction round that extends into the chamber opening due to the slanted orientation of the jammed malfunction round 40 (see FIG. 17).

Alternative malfunction round front ends may be differently-shaped and still fall within the desired configuration/adaption of having at least a portion that is enlarged to an extent that it fits and operates in the magazine but does not fit entirely or properly through the breech, and does not fit entirely or properly into the chamber. Having the enlargement at or near the front extremity of the front end ensures that little of the malfunction round enters the chamber, making the jam, the position of the jammed malfunction round, and the ability of the shooter to clear the jam, a close simulation of a natural jam caused by an un-ejected round obstructing the chamber. Accounting for the front end being typically the front 20-40 percent of the length of the round, one may describe the enlargement in certain embodiments as being anywhere in the front 40 percent of the length of the round, more preferably at least in the front 20 percent, and most preferably at least in the front 10 percent of the length of the round. In certain embodiments, the enlargement may extend along only a portion of that front 20-40 percent of the malfunction round, for example, a ridge or ring that radially protrudes out past the outer surface of the malfunction round that lies in front of and behind said ridge or ring. The radial enlargement may extend all the way around (360 degrees) the front end portion, or, alternatively, may extend only partly around the front end portion, for example, by comprising protrusions that are opposing (180 degrees apart) or otherwise circumferentially spaced around the front end. The spaced-apart protrusions may be separated by "flats", "notches" or other recessed surfaces that are relatively-recessed compared to the protrusions in that they extend less distance(s) from the central longitudinal axis of the malfunction round than the radial enlargement, as will be discussed later in this document.

Figure 6A:
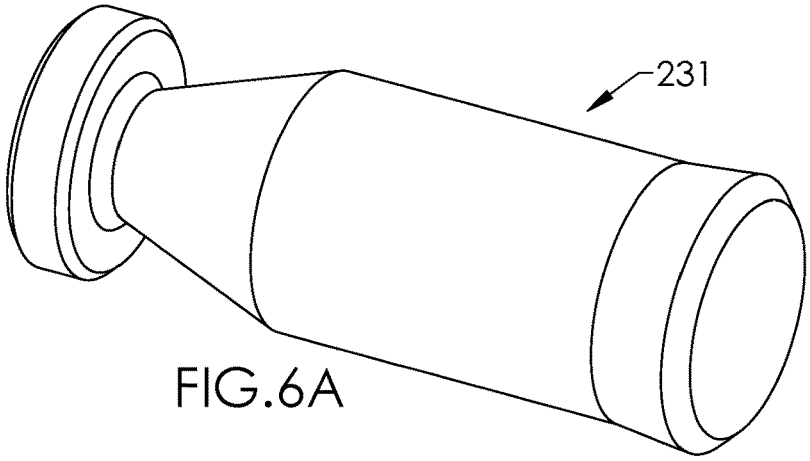
FIGS. 6A-I are front, side perspective views of malfunction rounds according to alternative embodiments of the invention, each of which has an alternative oversized-diameter front end or front end portions, rather than the cylindrical front end of the malfunction round of FIGS. 2A and 2B.
Figure 6B:
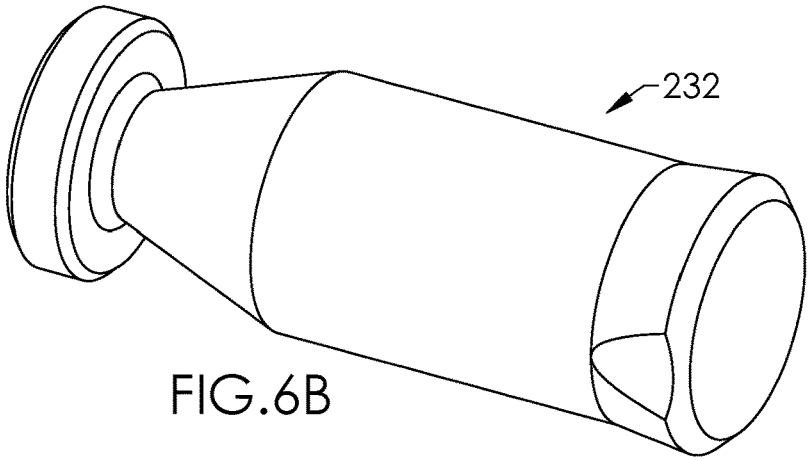
Figure 6C:
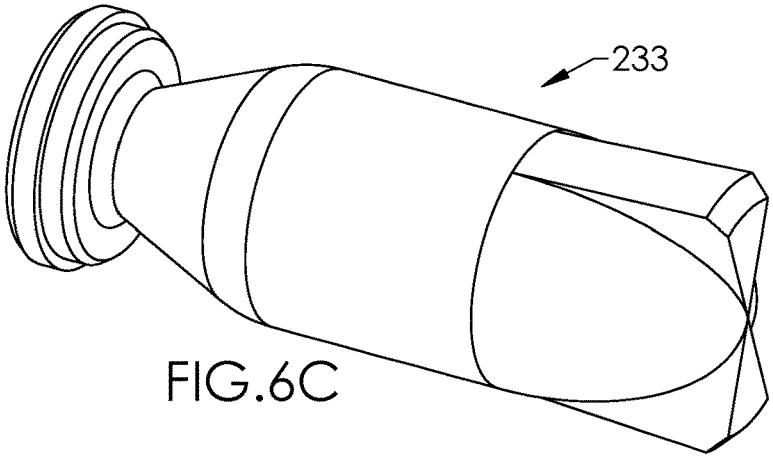
Figure 6D:
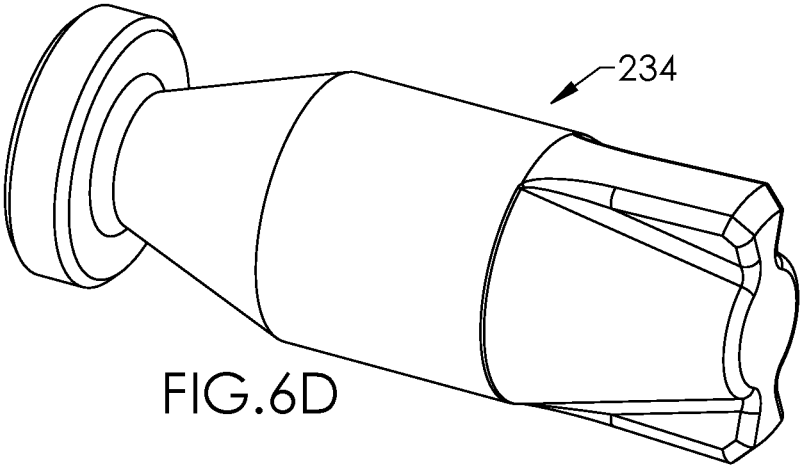
Figure 6E:
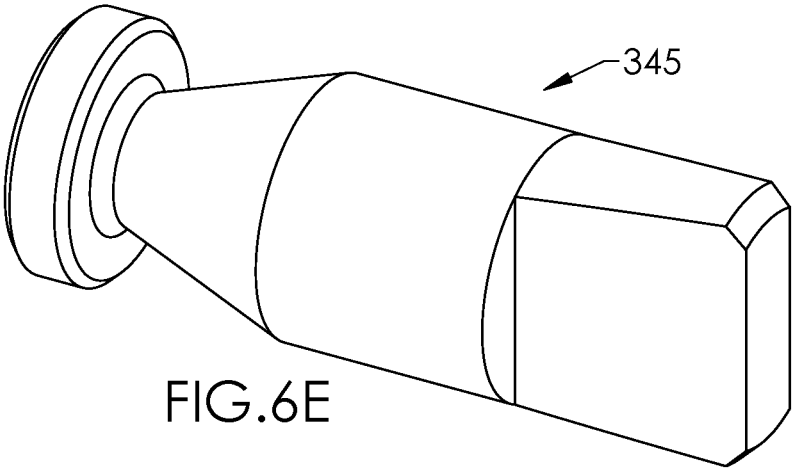
Figure 6F:
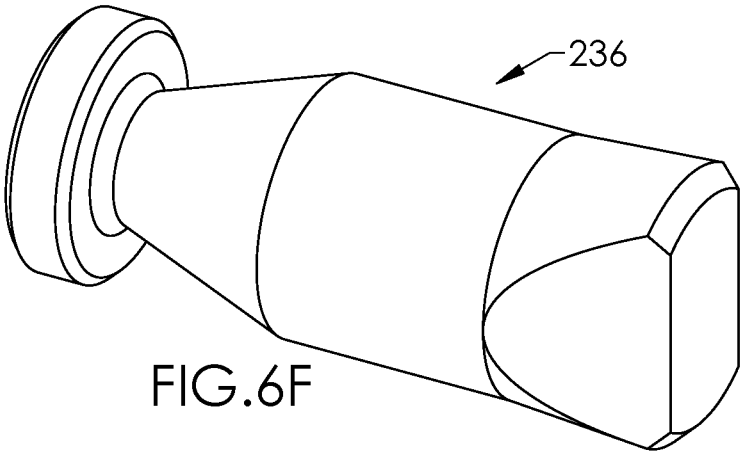
Figure 6G:
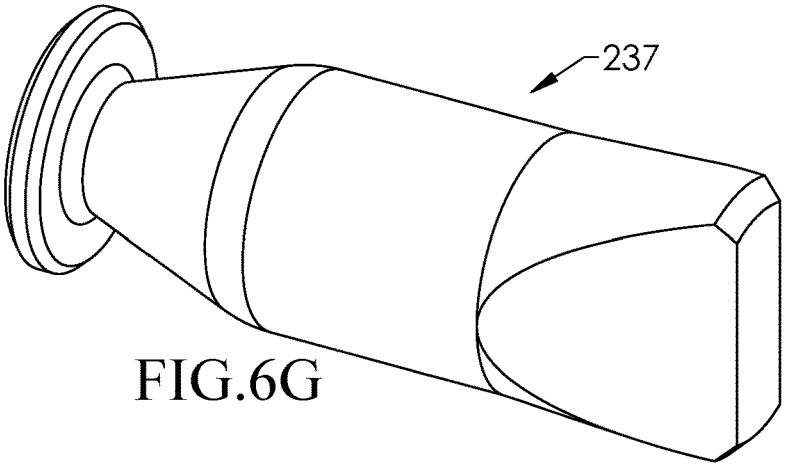

Malfunction Round 240 and FIGS. 20A-33:

Alternative malfunction round 240 is of the type portrayed in FIG. 6F, having radially-enlarged flared front end portions, or "protrusions", and flats/notches separating the flared protrusions or fins.

FIGS. 20A-33 depict blank, malfunction round 240, and modified malfunction round 240', and how malfunction round 240 compares to live round 10 and is used in an exemplary pistol 130. Alternative malfunction round 240 comprises many features that are similar to those of malfunction round 40, and operates in many ways that are similar to the operation of round 40, but malfunction round 240 is particularly-well adapted as to be a more universal malfunction round for many firearms and their magazines. Due to its specially-adapted main body 242 and front end 246, malfunction round 240 may be used in many firearms that receive live round 10, for example, with only slight modifications in its dimensions.

Malfunction round 240 has an oversized front end, by means of having two spaced-apart, radially-protruding, oversized front end portions, which flare outward from nearer the main portion 243 to their maximum dimension/diameter Z' near the front extremity of the malfunction round 240. The flared protrusions accomplish the desired jamming at the breech, as discussed in detail earlier in this document and illustrated in the drawings of the other malfunction rounds, the flared protrusions provides a "streamlined" shape that does not snag on the live rounds above and below the malfunction round 240 in the magazine, and can even serve as a ramp for smooth movement of the live round above malfunction round 240.

Malfunction round 240 is further-adapted for compatible fit and proper operation in the magazine, namely by comprising the flat recessed surfaces between said oversized front end protrusions, and an axially-elongated and radially-undersized, preferably conical, rear portion. These features specially-adapt the malfunction round 240 to: 1) fit and move properly inside the magazine and not interfere with movement of the surrounding live rounds 10 in the magazine; and 2) to fit and move properly through the magazine top opening, including that the malfunction round separates from the magazine when the magazine is stripped from the firearm in the first/early step in the malfunction clearing procedure, typically flying out of the magazine top opening and falling to the ground for the subsequent clearing steps of "racking" the slide mechanism. The inventor has found that the undersized, preferably conical, rear portion is particularly important for item no. 2 of this paragraph, as separating from the magazine upon stripping of the magazine is particularly important for creating a realistic training protocol and experience for the trainee. Said separating from the magazine typically takes the form of falling out of the magazine and onto the ground upon stripping the magazine. This separation prevents the malfunction round from continuing to reside in/on the magazine when the magazine is stripped, for example, partially protruding from the top of the magazine. This is important because, in a scenario where the malfunction round remains in/on the magazine, the trainee could not reinsert the magazine and continue to fire after clearing the malfunction. Instead, the trainee would have to manually remove the malfunction round from the magazine prior to reinserting the magazine into the firearm, which would be an abnormal/unrealistic step compared to clearing a T3 malfunction caused by an un-ejected round.

Figure 26A:
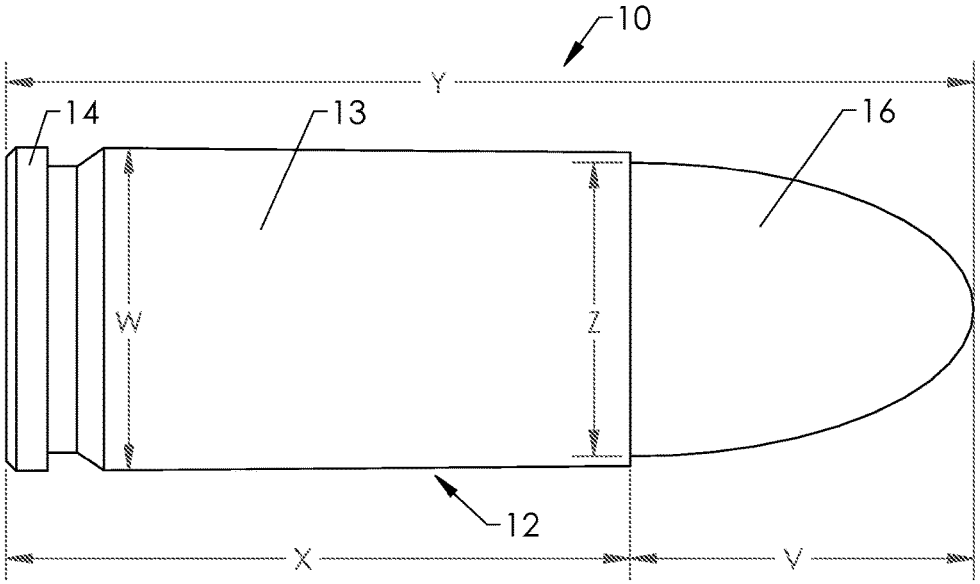
FIG.26A (PRIOR ART)
FIG. 26A is a side view of prior art live round 10 of FIGS. 1 and 7A, with dimension variables V, W, X, Y and Z indicated.

FIG. 26A depicts dimensions V, W, X, Y, and Z for an exemplary prior art live round 10, as discussed above. These dimensions, and dimensions for the associated breech, chamber and barrel bore, are provided in Appendix A of Provisional Application Ser. No. 62/452,728, incorporated herein, which provides the well-known-in-the art SAAMI™ (Sporting Arms and Ammunition Manufacture' Institute, Inc.) breech-face, chamber, and cartridge information, for a popular conventional 380 caliber automatic pistol firearm and its associated live round ammunition.

Figure 26B:
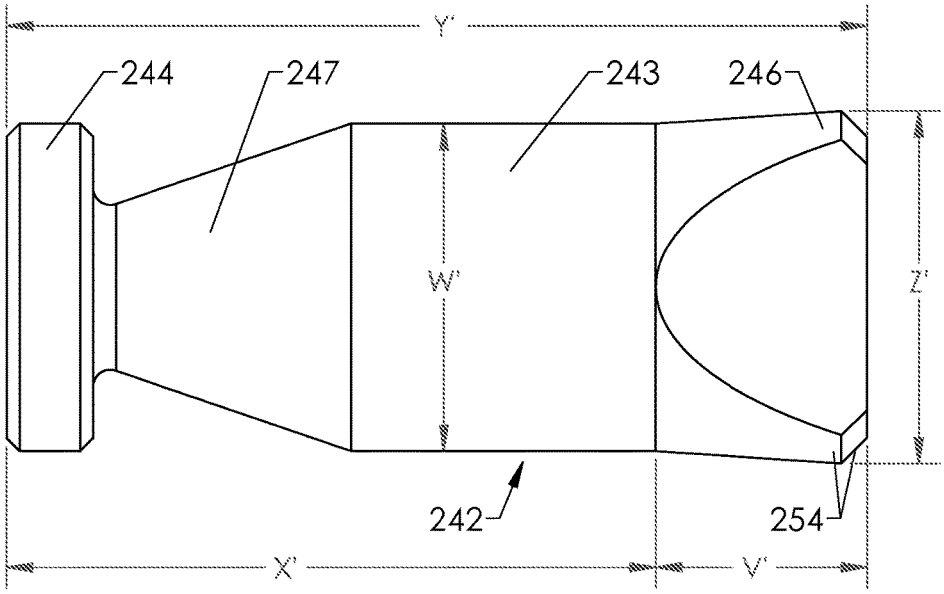
FIG. 26B is a side view of the malfunction round of FIGS. 20A-24, with dimension variables V', W', X', Y' and Z' indicated, for comparison to the live round of FIG. 26A.

FIG. 26B depicts dimensions V', W', X', Y' and Z' for the blank, malfunction round 240, which dimensions are provided for the 380 caliber pistol malfunction round 240 in Appendix B of Provisional Application Ser. No. 62/452,728, incorporated herein. Appendix A and B may assist the reader to cross-reference between the exemplary live round (for dimensions V, W, X, Y, and Z for breech, chamber, and barrel diameters), and the corresponding malfunction round 240 (for dimensions V', W', X', Y', and Z'). Dimension W' is the maximum O.D. of main portion 243, which is preferably the same as the maximum O.D. of base/back end 244. Dimension X' is the length of main body 242 including the base/back end 244, the groove portion 247, and main portion 243. Dimension Y' is the total length of malfunction round 240. Dimension V' is the length of the front end 246, and dimension Z' is the maximum O.D. of the front end 246 of malfunction round 240.

Malfunction round 240 comprises a cylindrical or generally cylindrical central main portion 243 and base/back end 244, and a conical groove portion 247 that serves as the transition between the main portion 243 and the base/back end 244. Forward of main portion 243 is front end 246. Portion 242 of malfunction round 240 corresponds generally to live round casing 12 except that the groove portion 247 is larger, specifically axially longer and more conical, than the groove 47 of the live round 10, resulting in an axially-elongated (compared to groove 47 and compared to the groove of the live round), undersized-diameter region at the rear of the main portion 243. This conical portion 247 preferably extends axially in a range of about 15-30 degrees, about 18-26 degrees, or about 20-24 degrees, to the longitudinal axis of the round 240. The undersized-diameter region extends from the main portion 243, toward the back/back end 244, decreasing to its smallest diameter at or near the base/back end 244, which is preferably about half of the diameter W' of the main portion and preferably about 40-48 percent of dimension Z'.

As explained above, this undersized-diameter, preferably conical, region 247 is instrumental in creating a realistic training experience, by allowing the round 240 to separate from and leave the magazine when the magazine is stripped from the firearm, to place the round 240 away from the magazine and away from the firearm for the rest of the clearing and correction protocol. Base/back end 244 corresponds generally to live round base/primer 14. Enlarged front end 246 comprises two opposing, enlarged sides/surfaces, specifically protrusions P1 and P2, that are flared radially outward away from the longitudinal axis of the round 240, in order to create the portions of the front end that are enlarged compared to the relevant breech I.D. Between the outwardly-flared protrusions P1 and P2 are opposing inwardly-slanted sides/surfaces, or flats/notches F1 and F2, that slope inward toward the central longitudinal axis of the round 240 and toward the distal end surface 250 of the round 240. Between each of the enlarged protrusions P1 and P2, and the distal end surface 250 is a beveled surface 252.

As discussed above for round 40, malfunction round 240 is adapted to have dimensions and a shape so that the round 240 can fit and work well inside a magazine in which a corresponding exemplary prior art round 10 is used. Further, round 240 is universally compatible with, and universally operates properly in, many firearm and magazines, with the help of special adaptations, and with only minor adjustments in dimensions W', X', Y', Z' and/or V'. Said special adaptations comprise the inwardly-slanted flats/notches F1 and F2 between the protrusions P1 and P2, and a large, long conical "waist" (groove 247), as discussed above.

Figure 23:
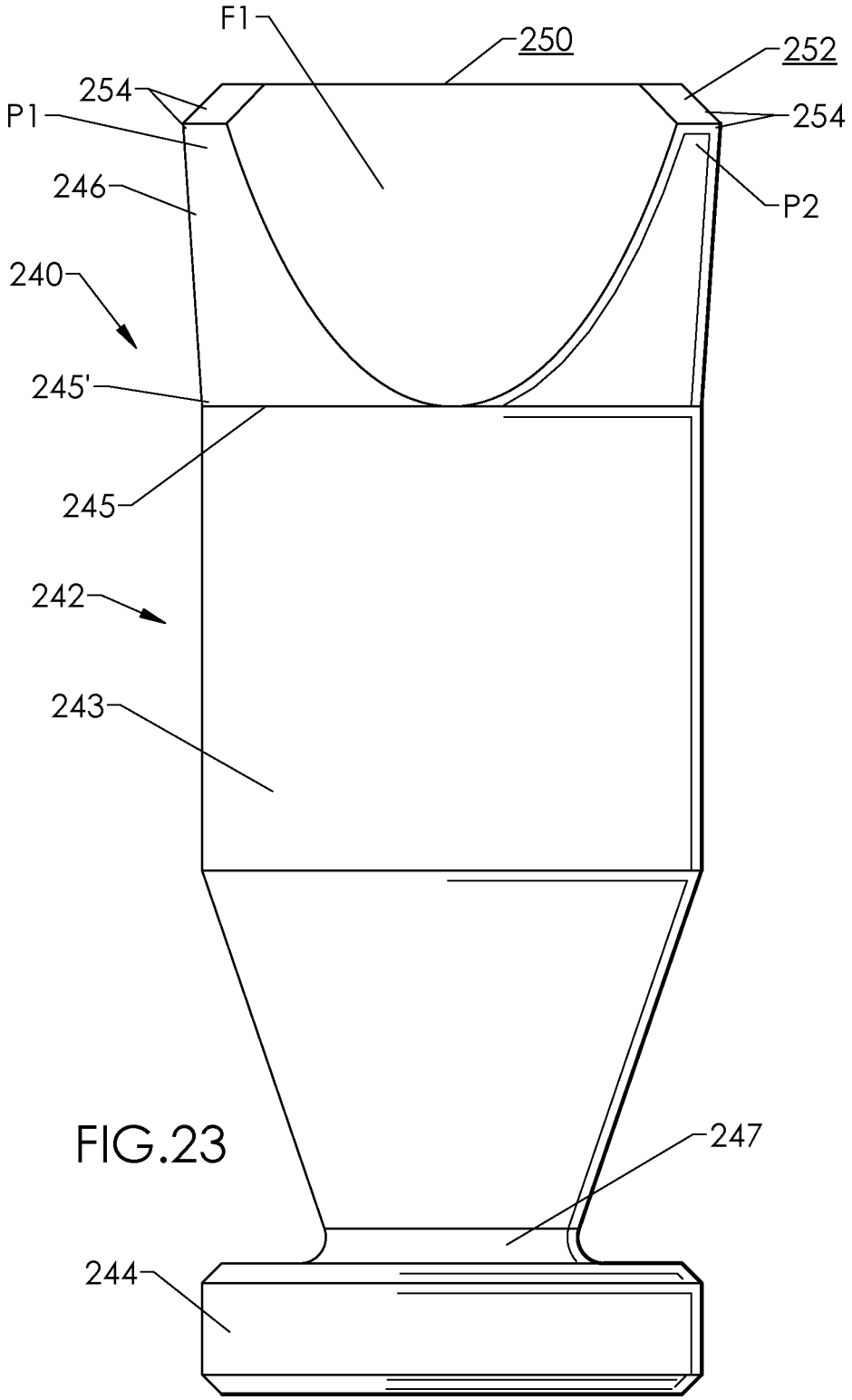
FIG. 23 is a side view of the malfunction round of FIGS. 20A and B.
Figure 24:
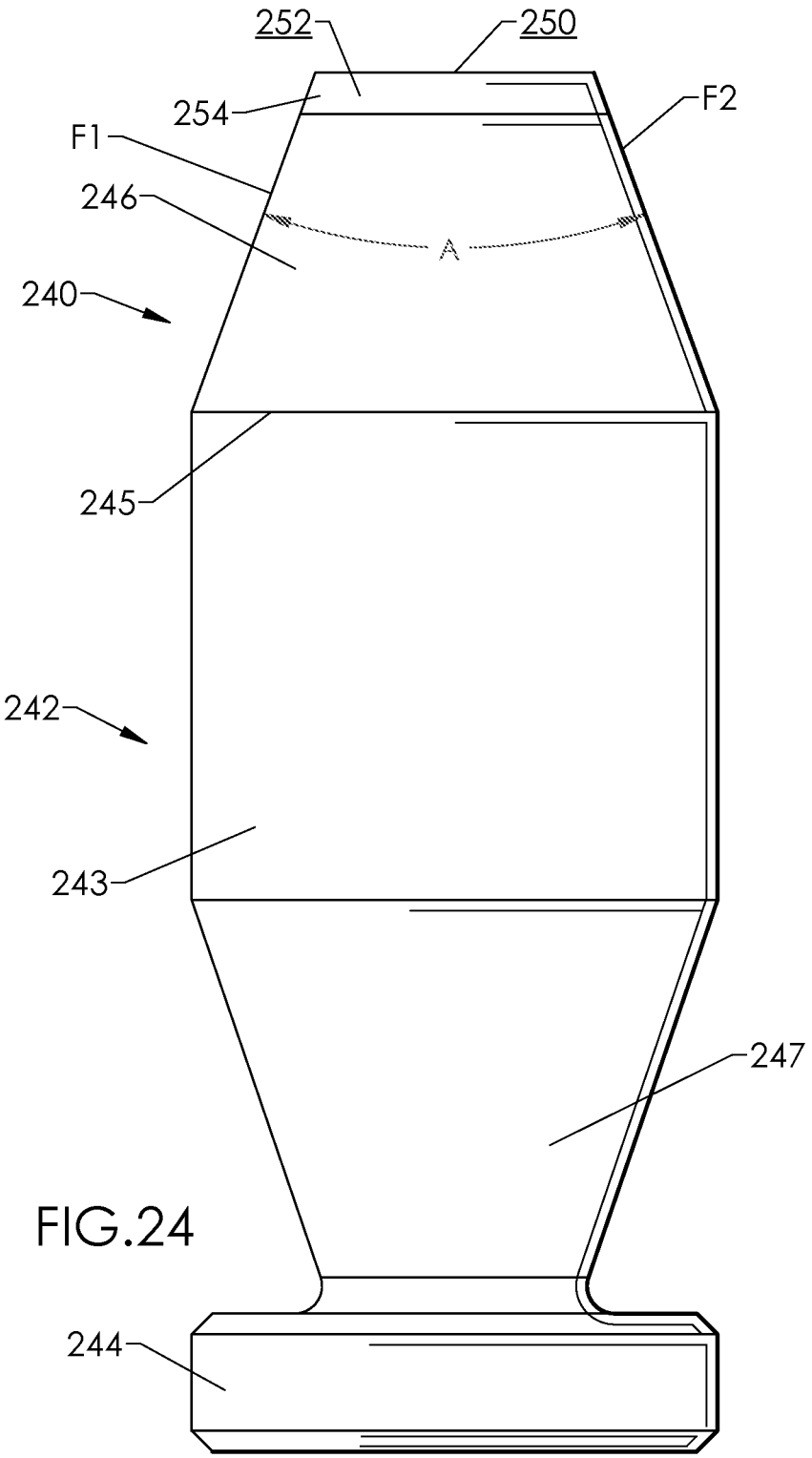
FIG. 24 is a side view of the malfunction round of FIGS. 20A and B, turned 90 degrees from FIG. 23 and showing angle A between the opposing flat recessed surfaces of the front end.
Figure 25:
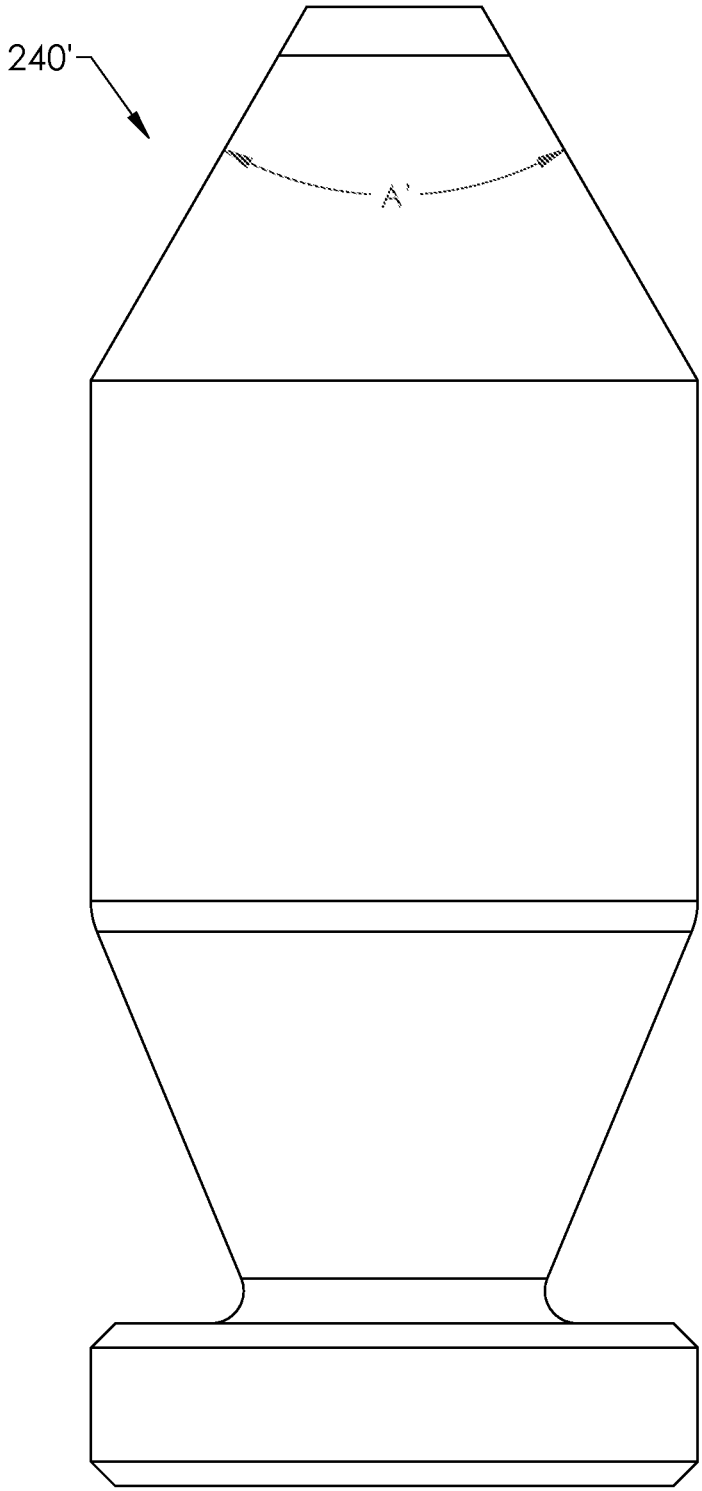
FIG. 25 is a side view of an alternative malfunction round having a larger angle A' between the opposing flat recessed surfaces of the front end.

Malfunctions rounds 240 all being the same general/overall shape of FIGS. 20A-24, but with slightly adapted dimensions V', W', X', Y' and/or Z', for other firearms, for example, for each of the 9 mm LUGER™/LUGER +P™, 357 SIG, 40 SMITH and WESSON™, 10 MM Automatic, 45 GLOCK™ Automatic Pistol, and 45 Automatic/Automatic +P. Further, the angle between the planes of the surfaces of the flats/notches provided in the front end, may be adapted for various firearms; for example, angle A between flats F1 and F2 in round 240 in FIG. 24 is about 45 degrees, while angle A' for round 240' in FIG. 25 has been adapted to be about 60 degrees.

For malfunction rounds 240 for multiple, and preferably all, the firearms listed above, dimension Z' will be equal to or greater than the breech diameter of the corresponding firearm, but preferably dimension Z' will be greater than the breech diameter by an amount in the range of about 0.01 to about 0.02 inches larger than the breech diameter, and most preferably about 0.02 inches (for example, 0.018 up to 0.022 inches) larger than the breech diameter, of the corresponding firearm. Further, it may be noted that dimension Z' is preferably the largest diameter of any portion of the malfunction round 240, which preferably has no piece/part that protrudes radially from the longitudinal axis of the round 240 a distance greater from the longitudinal axis than do the enlarged front end portions P1 and P2.

Figure 27:
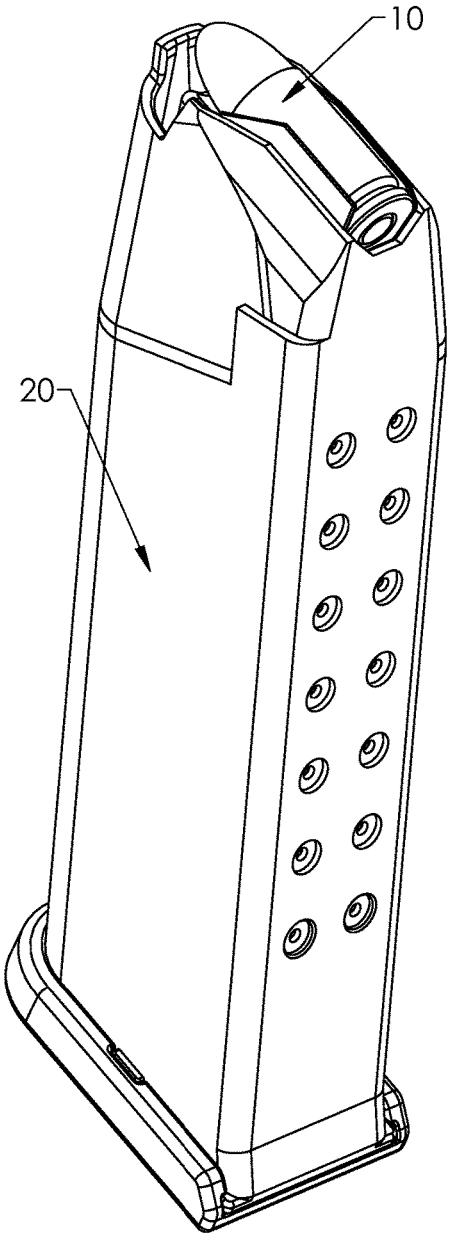
FIG.27 (PRIOR ART)
FIG. 27 is a rear perspective view of a conventional magazine holding the prior art live round of FIGS. 1, 7A and 26A, which is visible at the top of the magazine.
Figure 28:
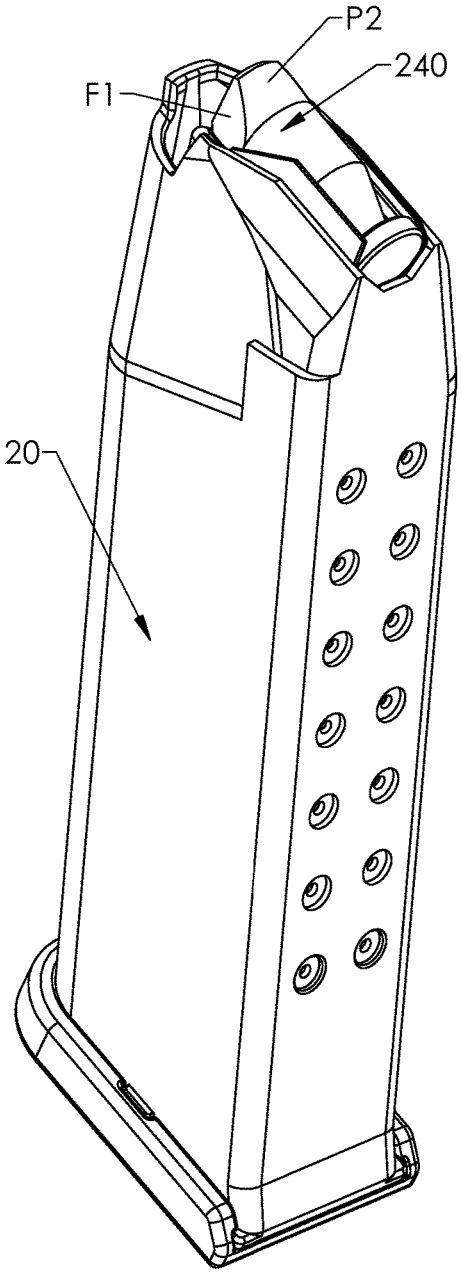
FIG. 28 is a rear perspective view of the magazine of FIG. 27 with a malfunction round of FIGS. 20A-24 at the top of the magazine.
Figure 29:
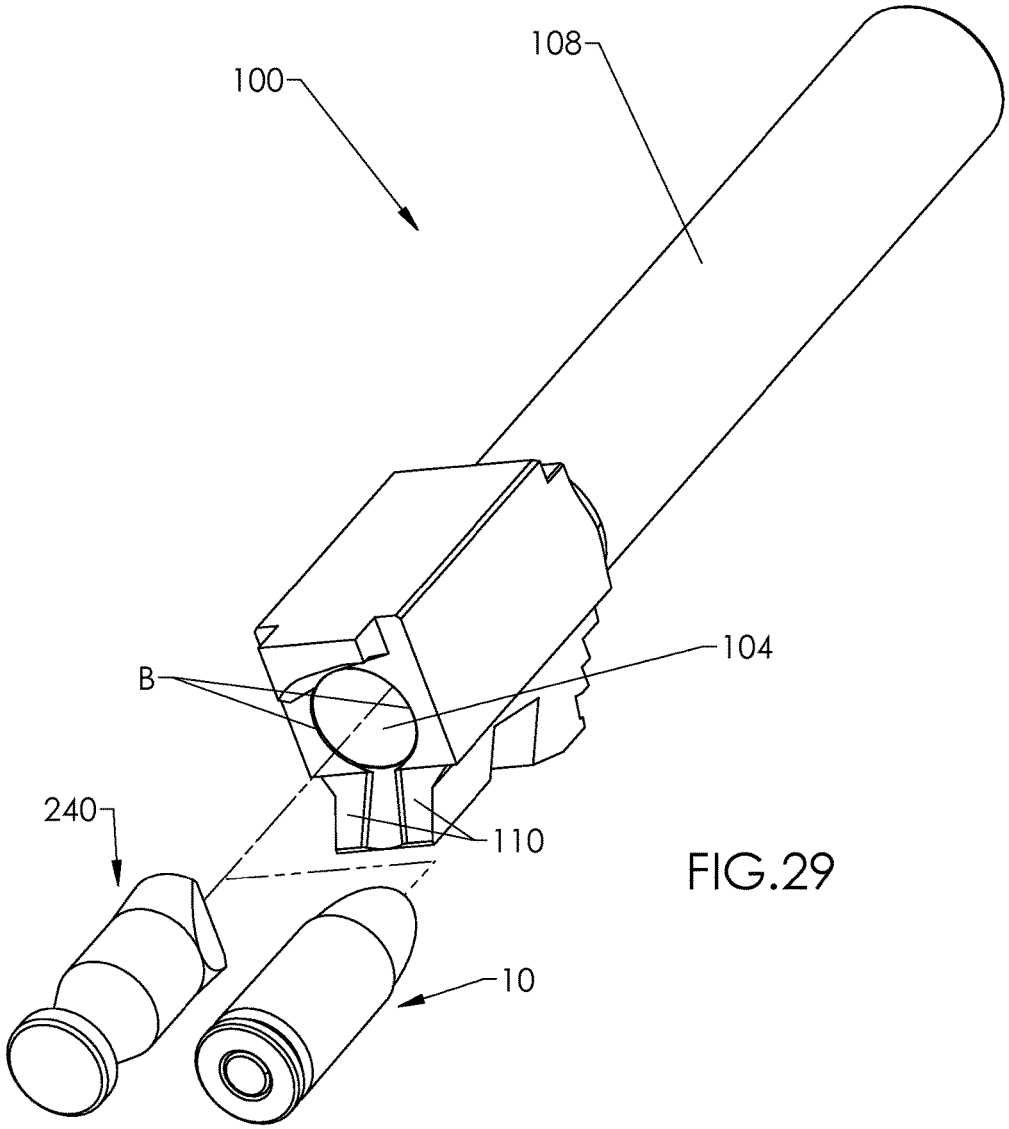
FIG. 29 is a schematic, rear perspective view of the exemplary live round of FIGS. 1, 7A and 26A on the lower right, and the malfunction round of FIGS. 20A-24 on the lower left, and their general relationship to the breech and chamber, at the back end of the barrel part of a firearm.

FIG. 27 and FIG. 28, depict, respectively, the same conventional magazine 20 loaded with an exemplary prior art round 10, and a malfunction round 240. Note that the malfunction round 240 visible in FIG. 28 (and all of the rounds 240 in the magazine) are loaded so that that the flats F1 and F2 are generally vertical, and facing the left and right sidewalls of the magazine. The inventor has found this to be especially important for the "universality" of the round's 240 fit and smooth operation in many magazines.

Each live ammunition round 10 and each malfunction round 240 operates properly in the magazine 20, fitting properly in, and moving smoothly along the length of, the magazine 20 to reach the top position in the magazine shown in FIGS. 27 and 28, without interfering with the higher-up or lower-down live round(s) 10 or malfunction round(s) 240 in the magazine. For training, one or more of the malfunction rounds 240 will be stacked with one or more corresponding live rounds 10 in a single magazine 20, with relative numbers of live and malfunction rounds and the order of stacking in the magazine being determined by the trainer, as discussed above. When malfunction round 240 reaches the top of the magazine inside the firearm, the oversized nature of the enlarged protrusions P1 and P2 causes front end 246 to not fit properly or entirely through the breech, and therefore, to not fit properly or entirely in the chamber 104 as would live round 10. This way, round 240 stops at or partly-extending into the breech, typically still partly on loading ramp 110, thereby jamming and disabling the firearm according to a "simulated" T3 malfunction. The effect of the dimensions of the malfunction round 240 vs the live round 10 is illustrated by comparing FIGS. 11-15 for a live round 10, to FIGS. 30-33 for the malfunction round 240. Operation of a prior art, semi-automatic pistol using live rounds 10 in FIGS. 11-15 is described above in this document, and operation of the same pistol using a combination of live round(s) and malfunction round 240 is portrayed in FIGS. 30-35 in a similar drawing sequence as in FIGS. 16-19.

Figure 30:
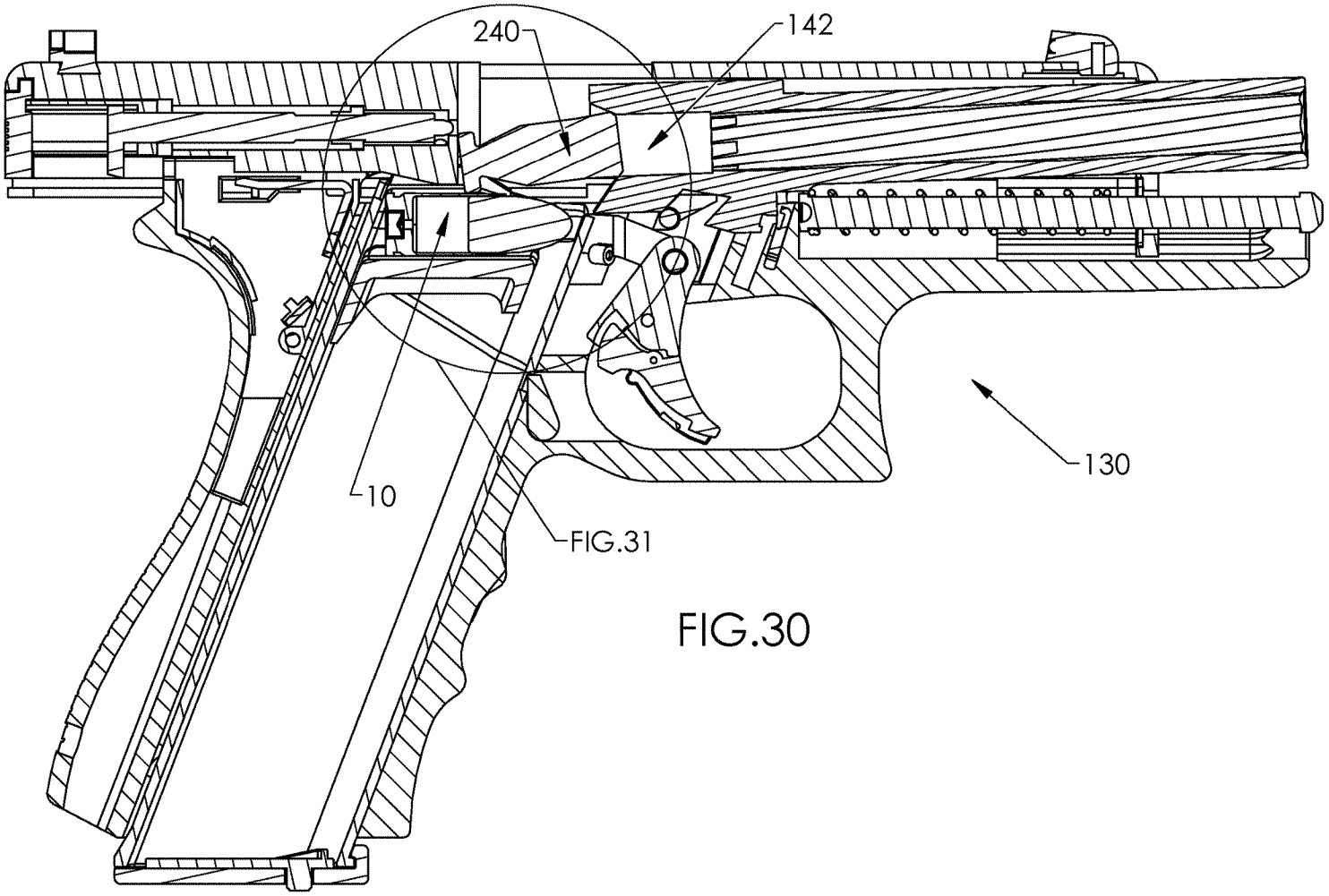
FIG. 30 is a right side, cross-sectional view of a "T3 malfunction" that has been simulated by the presence of the malfunction round of FIGS. 20A-24 at the top of the magazine, which has become jammed at the entrance to the chamber of the pistol, that is, at/near the breech.

In FIG. 30, a T3 malfunction has been simulated by the presence of malfunction round 240. Malfunction round 240 is partially protruding from the magazine and jammed at the entrance to chamber 142, particularly at/in the breech. In this situation, the prior, spent round has been properly ejected, and the malfunction round 240 is the first round at the top of the magazine. Therefore, unlike the natural T3 Malfunction illustrated in FIGS. 13 and 14, there is no round or any other object in conventional position in the breech/chamber blocking round 240 from entering the chamber 142. Instead, it is the enlargement of the front end 246 that prevents round 240 from properly/fully passing through the breech and entering the chamber 142.

Figure 31:
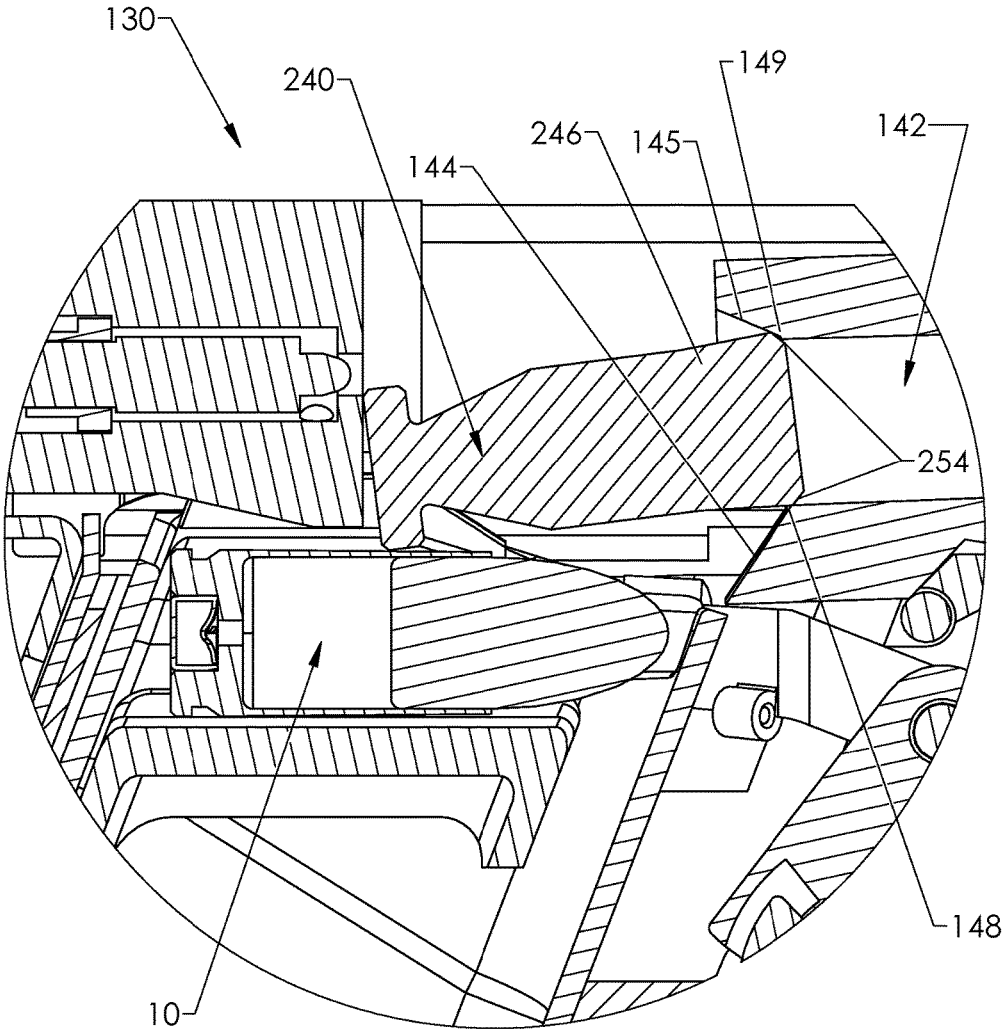
FIG. 31 is a magnified, detail view of the circled portion of FIG. 30.

FIG. 31 is a magnified, detail of the area circled in FIG. 30, which is the area of particular concern during this simulated T3 malfunction of the firearm that has been brought on by use of the malfunction round 240. This magnified view shows to best advantage that no un-ejected round is in the chamber 142, so the chamber 142 is substantially empty, but that the malfunction round 240, with its enlarged front end 246 is jammed at/in the breech. This is due to the size and shape of the front end 246, and particularly the enlarged/outwardly-flared sides/surfaces P1 and P2, not allowing the round 240 to slide on/past the ramps 144, 145, through the breech, and fully into the chamber 142. This view shows to best advantage how the "corners" 254 of round 240 abut against the ramps 144, 145 and/or the surface of the breech edge 148, 149 near the ramps 144, 145. As shown by FIGS. 30 and 31, jammed round 240 is slanted at an angle relative to, and therefore not parallel to, the longitudinal axis of the chamber and the barrel bore.

Once the jam is identified and understood by the shooter, the jam may be corrected by clearing round 240 out of its jammed position of FIGS. 30 and 31. The enlargement of portions of front end 246 being at least at or near the front extremity of the round 240 is advantageous, so that round 240 jams at or very near the ramps 144, 145 and/or breech edge 148, 149. This way, the round 240 does not go very far into the chamber, and does not become lodged inside the chamber and certainly not in the barrel bore, and the resulting jam closely simulates the jam shown in FIGS. 14 and 15 and, hence, a standard clearing technique for a T3 Malfunction may be taught to the shooter. Therefore, it will be understood that having a pointed or otherwise small diameter front end 246 front extremity, with the front end enlargement farther back to the middle or rear of front end 246, would allow round 246 to go farther into the chamber, and would not be as good a simulation of the natural jam in FIGS. 14 and 15.

Figures 32, 33:
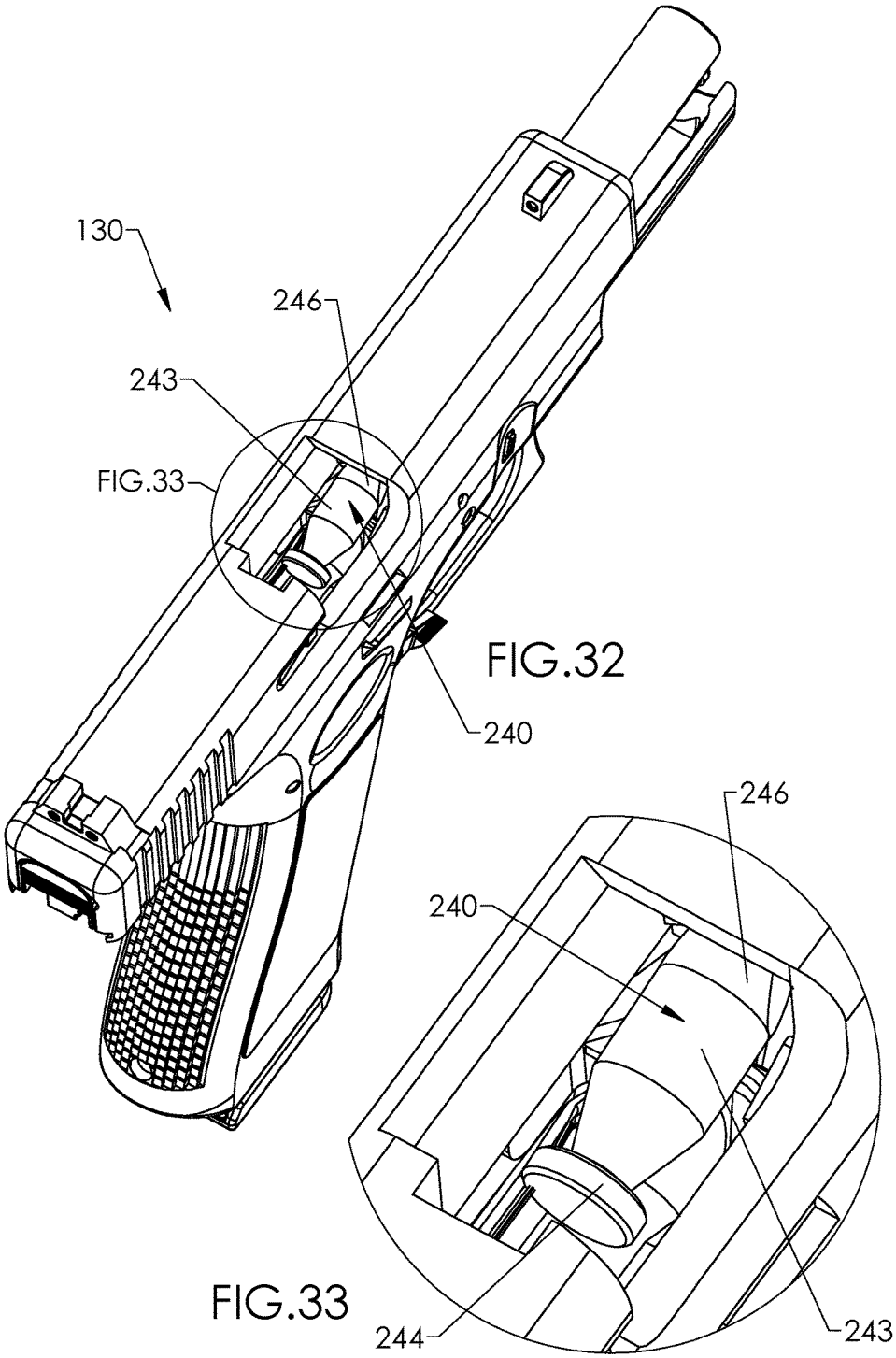
FIG. 32 is a top, perspective view of the pistol in the state depicted in FIG. 30.
FIG. 33 is a magnified, detail view of the circled portion of FIG. 32.

FIG. 32 is a top, perspective view of the pistol in the state depicted in FIGS. 30 and 31, with the majority of round 240 outside of the chamber 142 and visible through the ejection opening 134, but the front end 246 jammed in the breech at or near the ramps 144, 145. FIG. 33 is a magnified, detail view of the circled portion of FIG. 32.

Figure 34:
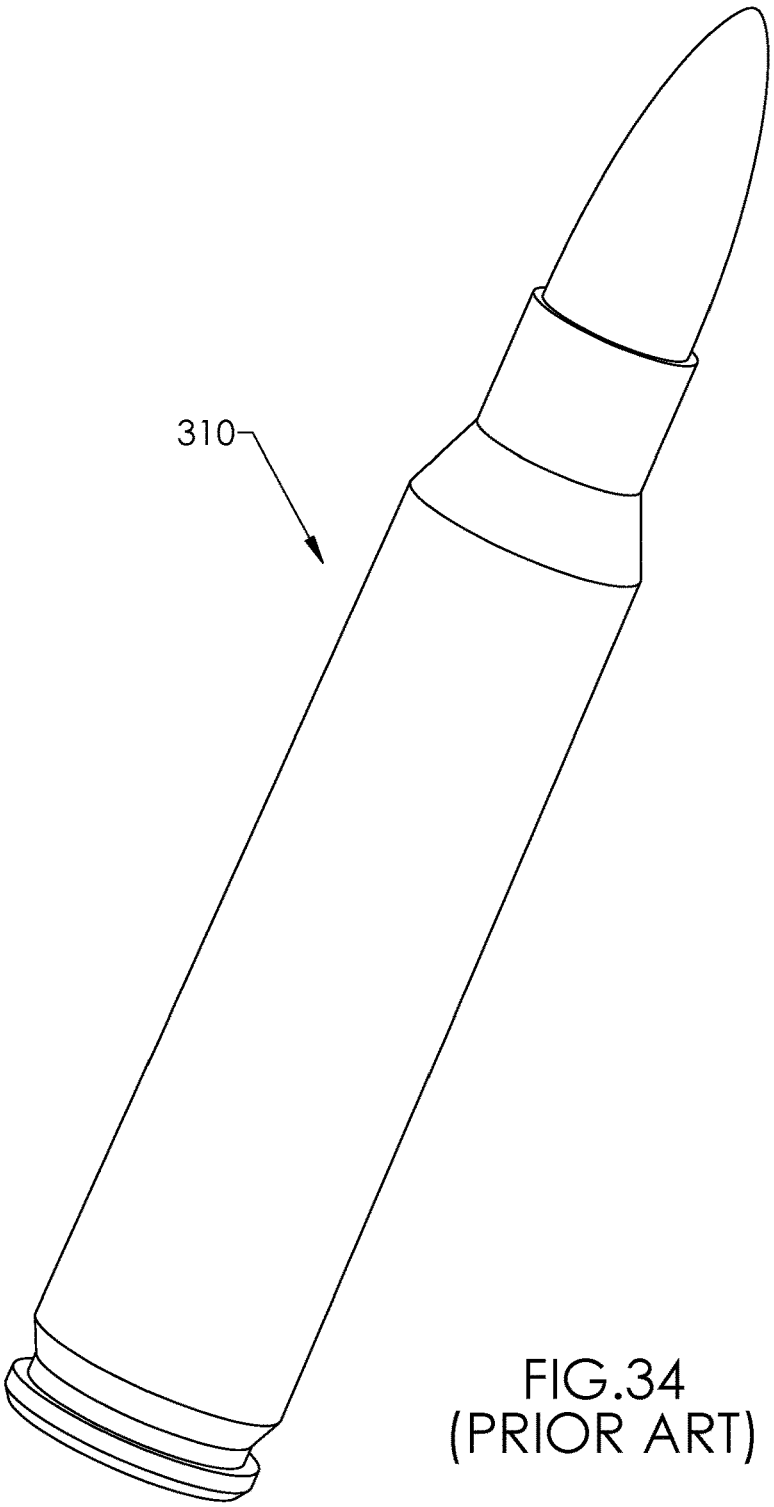
FIG.34 (PRIOR ART)
FIG. 34 is a side perspective view of an exemplary prior art live ammunition round for a rifle.
Figure 35:
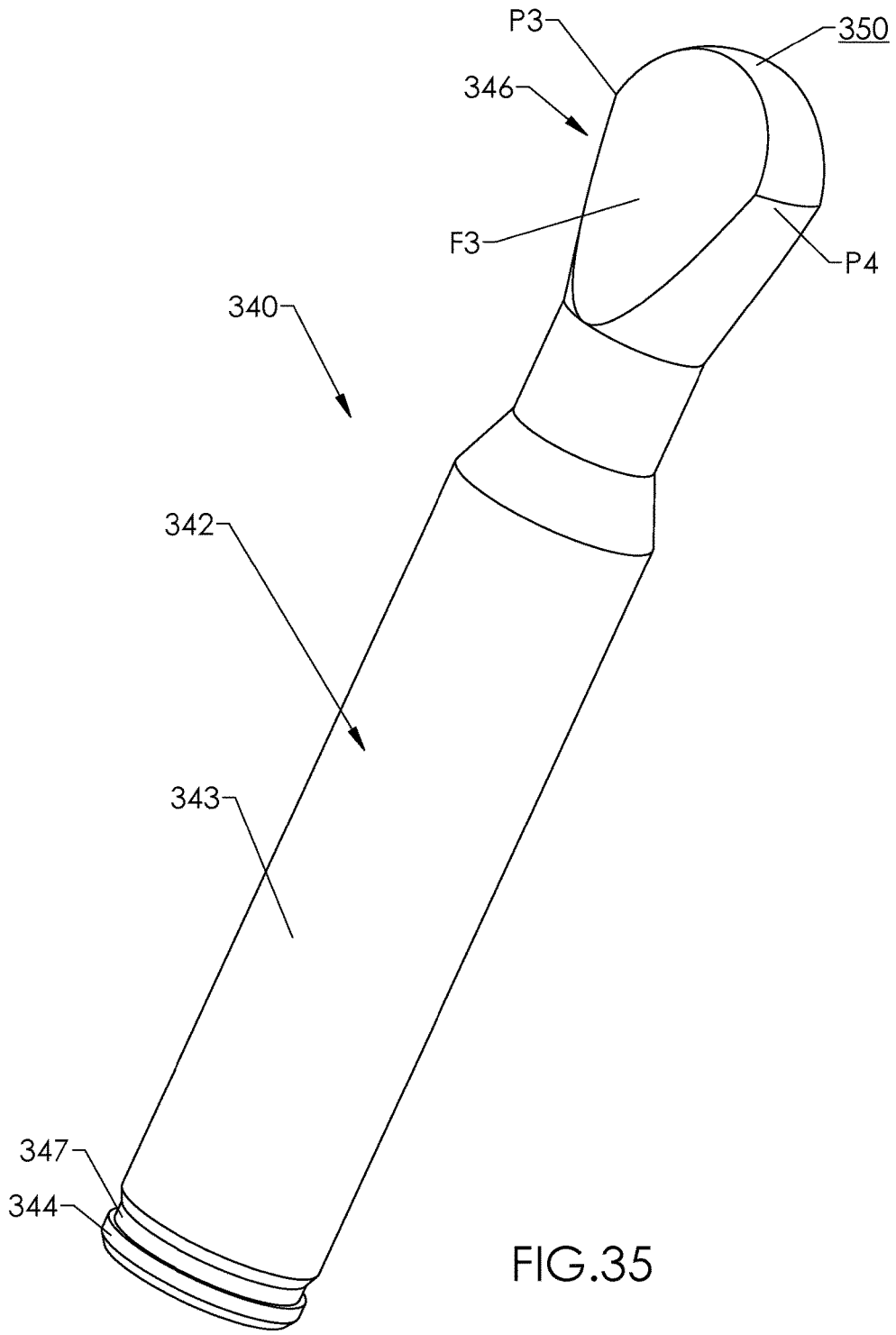
FIG. 35 is a side perspective view of a malfunction round according to an alternative embodiment of the invention, specially-adapted for use in various rifles.
Figure 36:
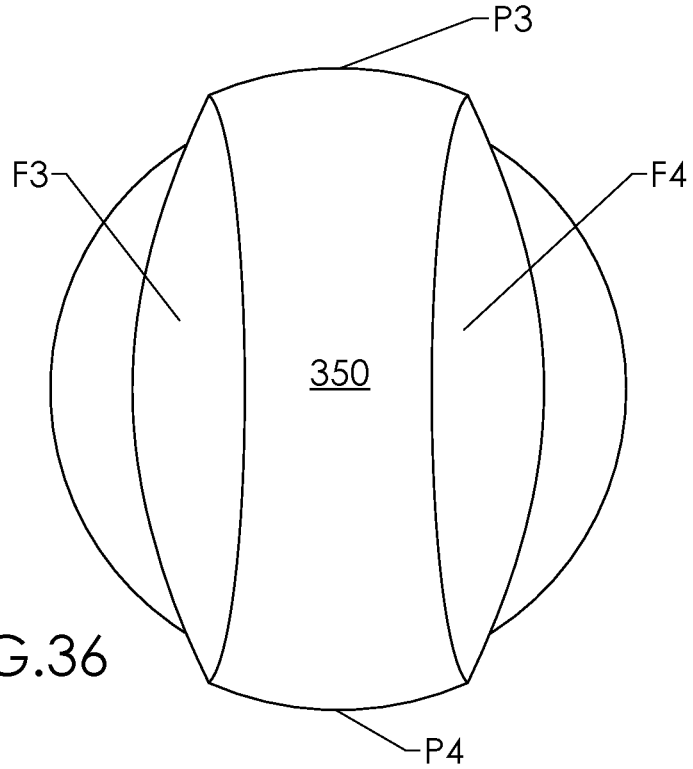
FIG. 36 is front view (or "front end" view) of the malfunction round of FIG. 35.
Figure 37:
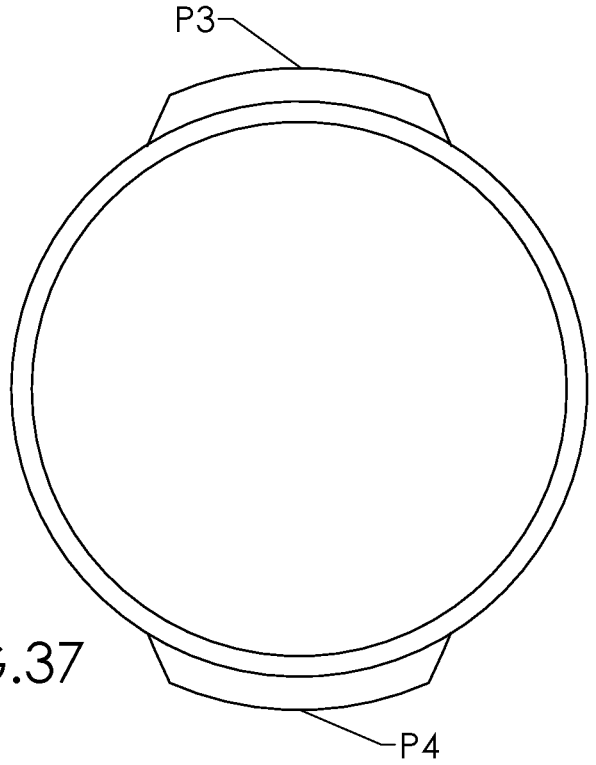
FIG. 37 is a rear view (or "rear end" view) of the malfunction round of FIG. 35.
Figure 38:
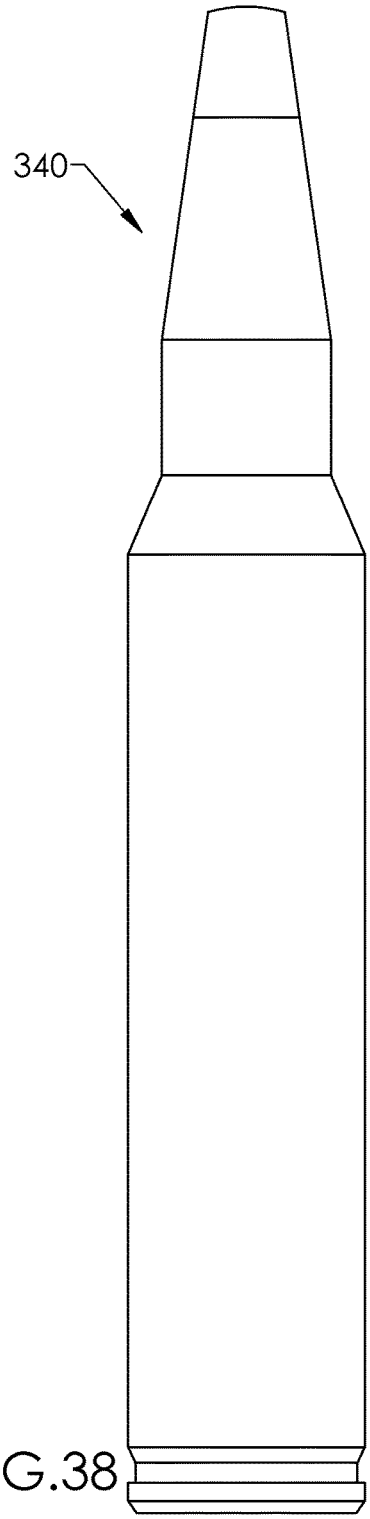
FIG. 38 is a side view of the malfunction round of FIG. 35.
Figure 39:
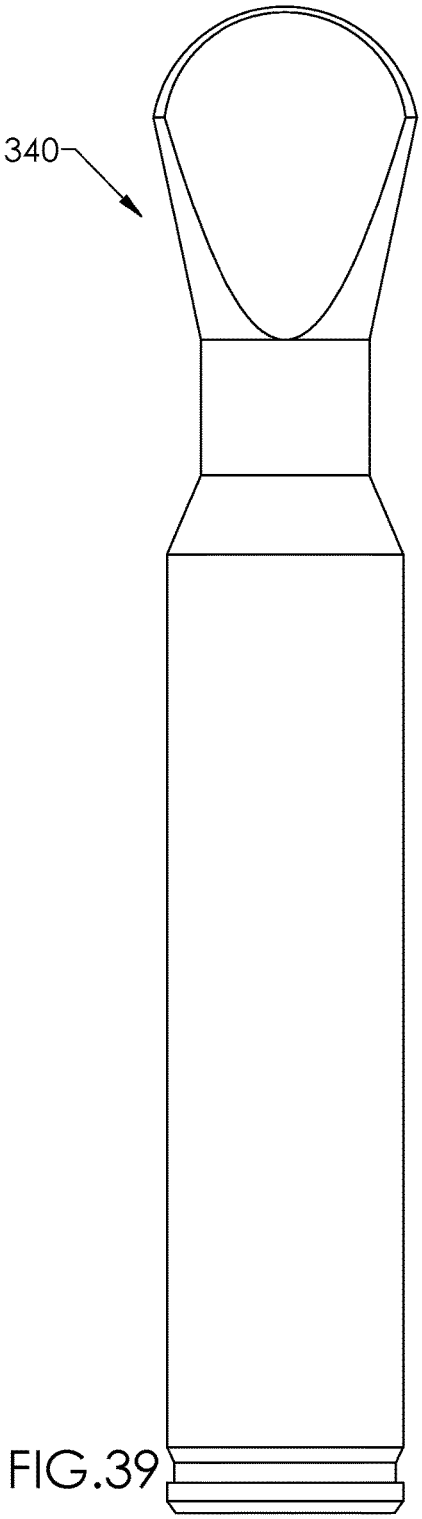
FIG. 39 is a side view of the malfunction round of FIG. 35, turned 90 degrees from FIG. 38.

Malfunction Round 340 and FIGS. 34-48:

An alternative malfunction round 340 comprises many features that are similar to those of malfunction rounds 40 and 240, and operates in many ways that are similar to the operation of rounds 40 and 240, but malfunction round 340 is particularly-well adapted as a universal malfunction round for many rifles and their magazines, for example, such as those that would use exemplary rifle live round 310 shown in FIG. 34. Due to its specially-adapted main body 342 and front end 346, malfunction round 340 may be used in many rifles, with slight modifications in its dimensions. Malfunction round 340, and its use for malfunction training with the corresponding firearm, magazine(s), and live round(s), will be understood from the above discussion of rounds 40, 240, from FIGS. 34-48, and the details below.

Figure 40A:
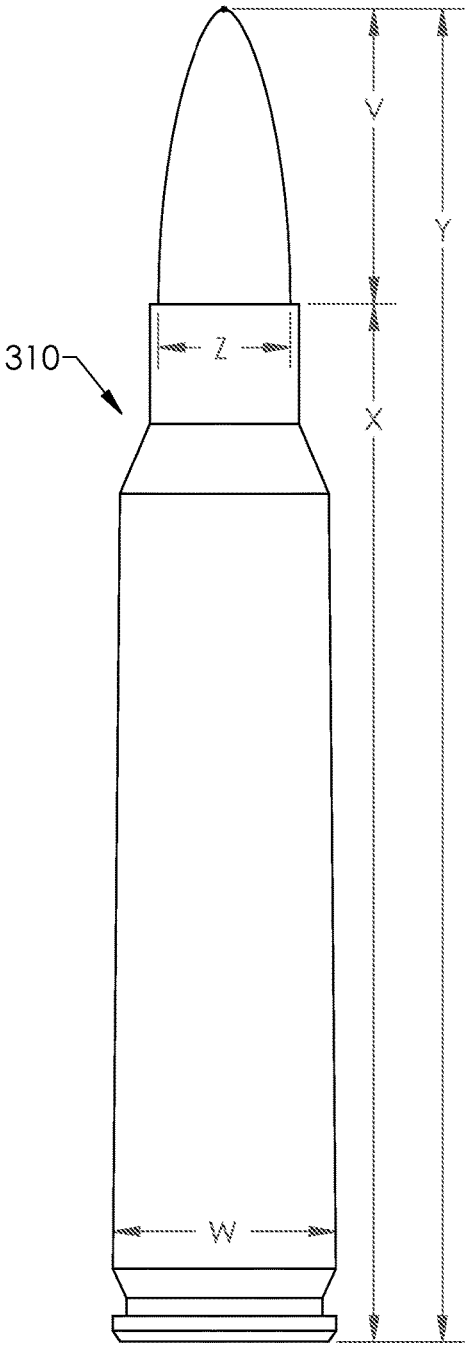
FIG.40A (PRIOR ART)
FIG. 40A is a side view of the prior art live round of FIG. 34, with dimension variables V, W, X, Y and Z indicated.

FIG. 40A depicts dimensions V, W, X, Y, and Z for the exemplary prior art live round 310, wherein SAAMI™ Appendix D, of Provisional Application Ser. No. 62/452,728, incorporated herein, provides the live round dimensions and the dimensions for the associated breech, chamber and barrel bore of one exemplary popular rifle, a 223 Remington.

Figure 40B:
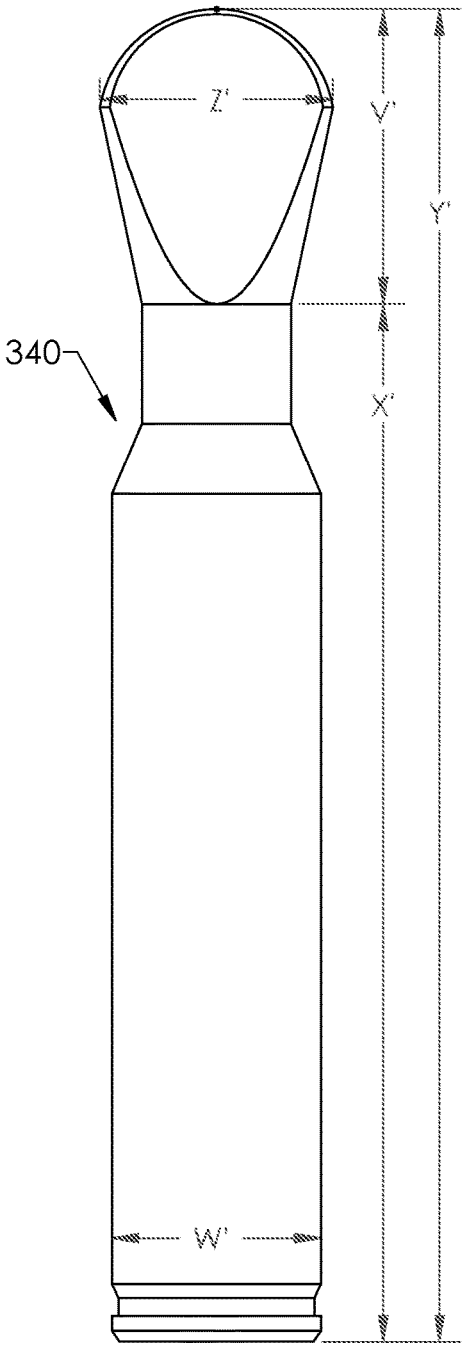
FIG. 40B is a side view of the malfunction found of FIGS. 35-39, with dimension variables V', W', X', Y' and Z' indicated, for comparison to the live round of FIG. 40A.

FIG. 40B depicts dimensions V', W', X', Y' and Z' for the blank, malfunction round 340, with the dimensions detailed for one embodiment of malfunction round 340 in Appendix E of Provisional Application Ser. No. 62/452,728, incorporated herein, for use in the firearm of the SAAMI™ spec sheet of said Appendix D. Appendix D and E may assist the reader to cross-reference between the live round specifications (for dimensions V, W, X, Y, and Z, and for breech, chamber, and barrel diameters), and the corresponding malfunction round 340 dimensions V', W', X', Y', and Z'. Dimension W' is the maximum O.D. of main portion 343, which is preferably the same as the maximum O.D. of base/back end 344. Dimension X' is the length of main body 342 including the base/back end 344, the groove 347, and main portion 343. Dimension Y' is the total length of malfunction round 340. Dimension V' is the length of the front end 336, and dimension Z' is the maximum O.D. of the front end 346 of malfunction round 340.

Malfunctions rounds 340 of the same general/overall shape of FIGS. 35-39, and 40B, but with slightly different dimensions V', W', X', Y' and/or Z', may be provided for different firearms, for example, for the 223 Remington and also a 7.62×39 rifle. Dimension Z' of malfunction round 340 is preferably about 0.01 to about 0.02 inches larger than the breech diameter of the corresponding firearm. For example, the malfunction round dimension Z' in said Appendix D is about 0.015 inches larger than the breech diameter in the corresponding firearm, the 223 Remington. Dimension Z' is 0.0146 and 0.0147 inches greater than the breech diameter for the 223 and the 7.62×39 firearms, respectively. It may be noted that dimension Z' is preferably the largest diameter of any portion of the malfunction round 340, which preferably has no piece/part that protrudes radially from the longitudinal axis of the round 340 a distance greater from the longitudinal axis than do the enlarged front end portions P3 and P4.

Malfunction round 340 comprises a cylindrical or generally cylindrical central main portion 343 and base/back end 344, and a groove 347 that serves as the transition between the main portion 343 and the base/back end 344. Forward of main portion 343 is front end 346. Enlarged front end 346 comprises two opposing, enlarged sides/surfaces, specifically protrusions P3 and P4, that are flared radially outward away from the longitudinal axis of the round 340, in order to create the portions of the front end that are enlarged compared to the relevant breech I.D. Between the outwardly-flared protrusions P3 and P4 are opposing inwardly-slanted sides/surfaces, or flats/notches F3 and F4, that slope inward toward the central longitudinal axis of the round 340 and toward the distal end surface 350 of the round 340. The angle between the planes of planar or substantially planar flats/notches F3 and F4 are preferably in the range of about 20-25 degrees. End surface 350 may be described as a generally semi-cylindrical surface extending between the two protrusions P3 and P4 between flats F3 and F4.

Figure 41:
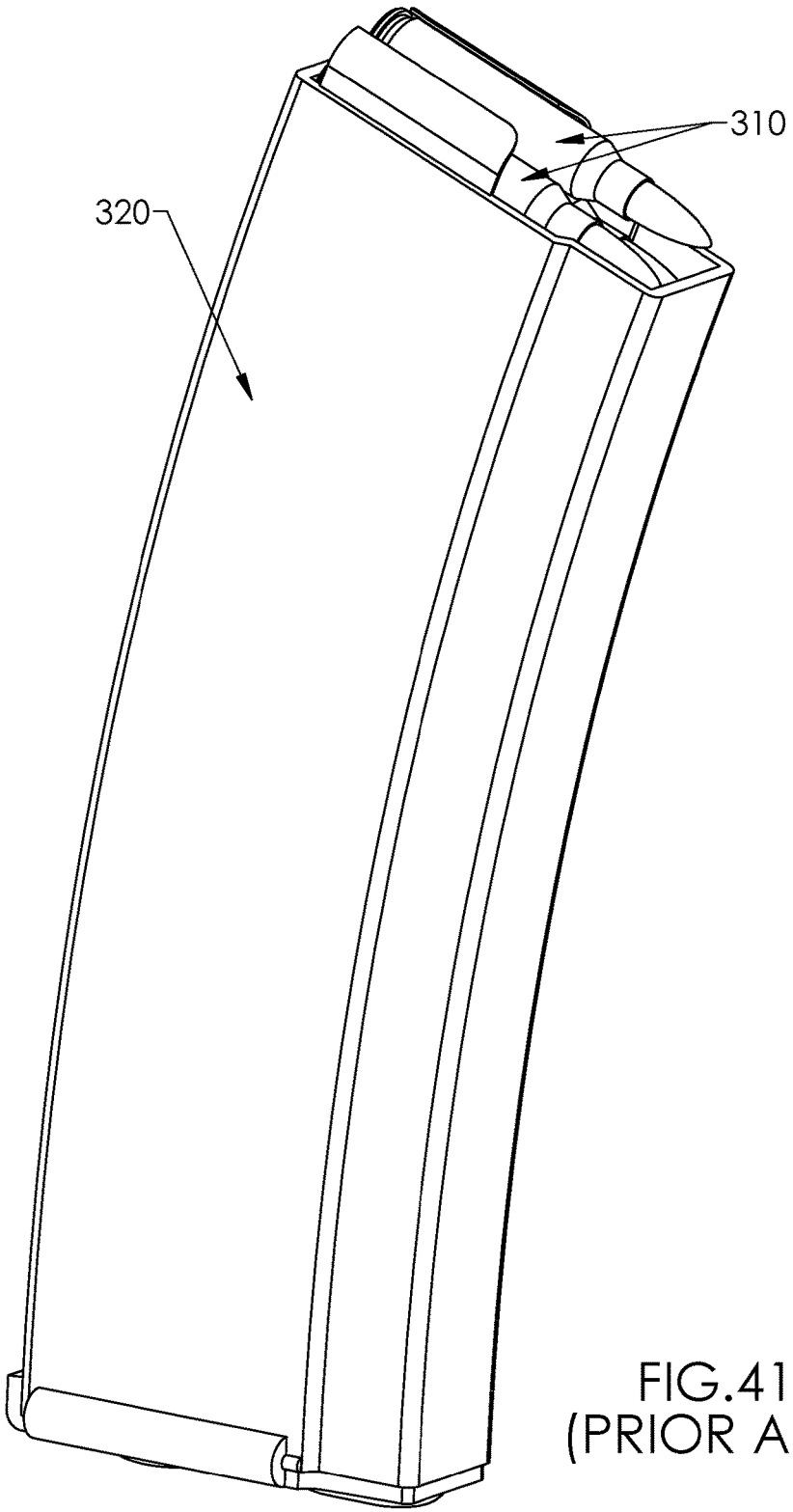
FIG.41 (PRIOR ART)
FIG. 41 is a side perspective view of a conventional magazine holding the prior art live rounds of FIGS. 34 and 40A.
Figure 42:
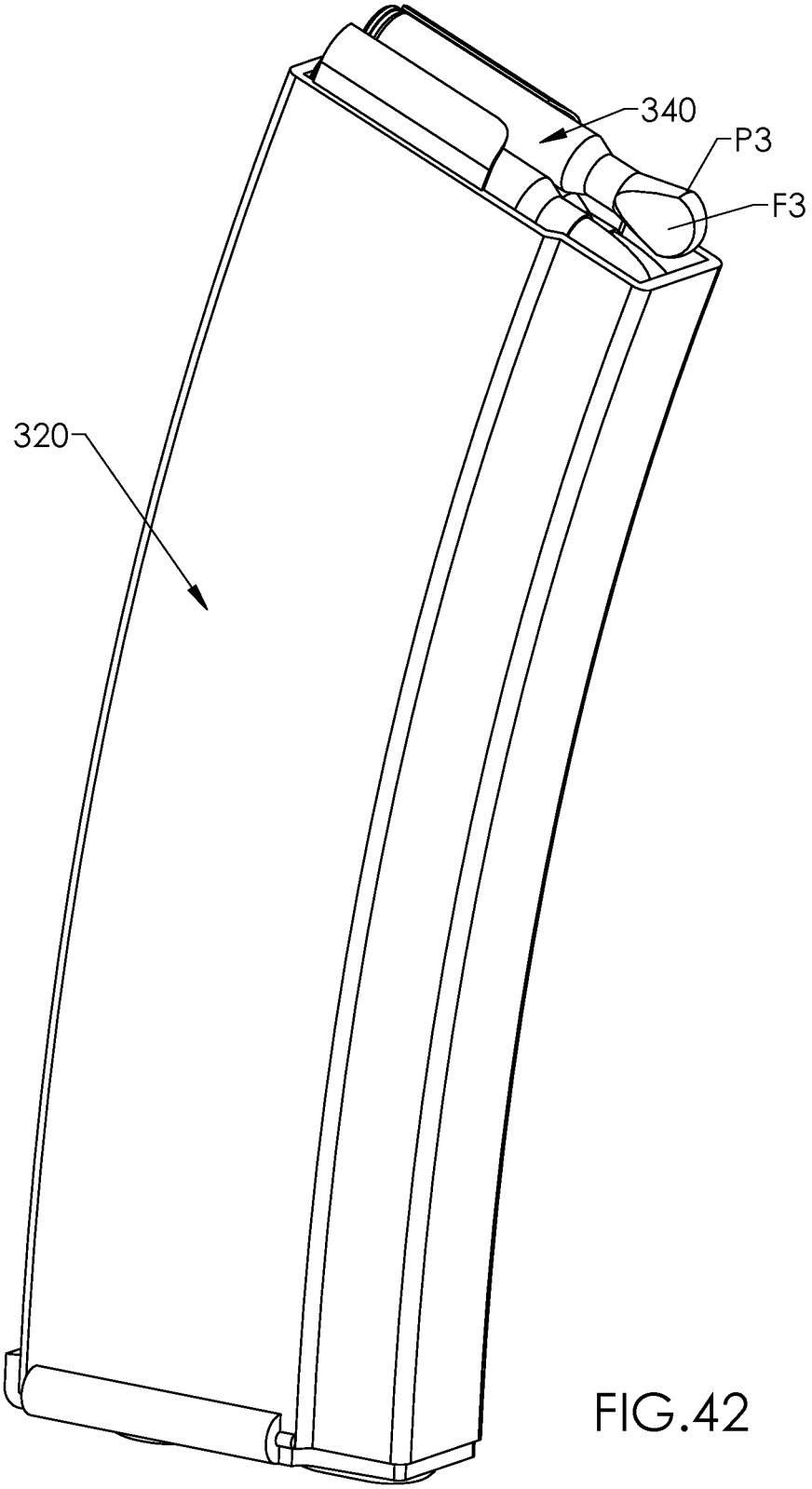
FIG. 42 is a side perspective view of the magazine of FIG. 41 with a malfunction round of FIGS. 35-39 at the top of the magazine.
Figure 43:
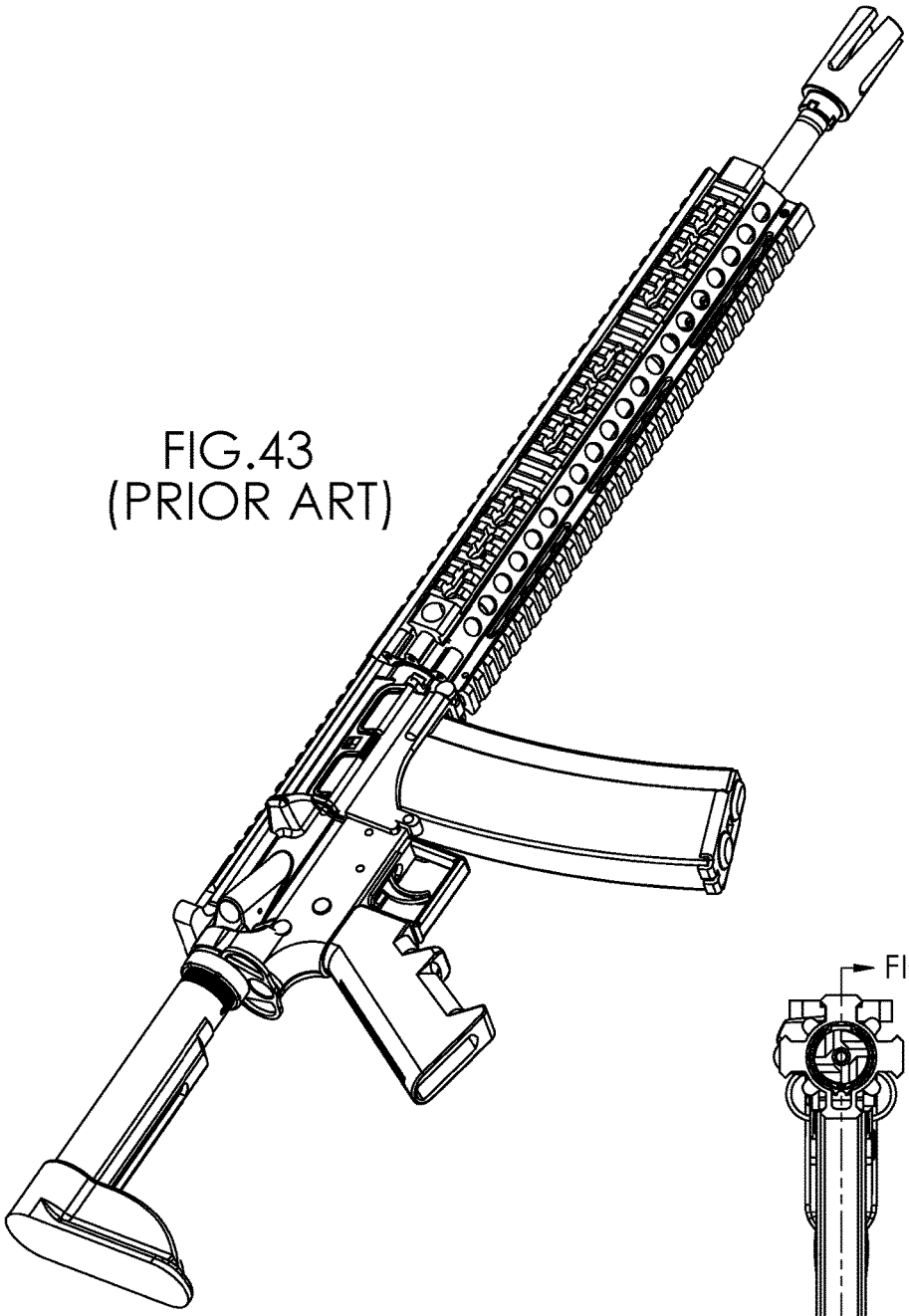
FIG.43 (PRIOR ART)
FIG. 43 is a side perspective view of an exemplary conventional rifle such as that in which the live round of FIG. 34 is used.
Figure 44:
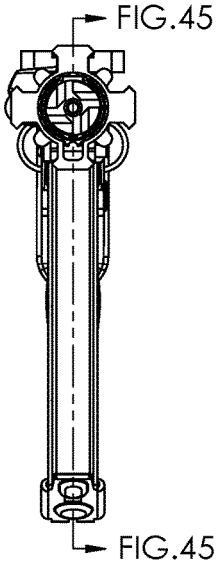
FIG.44 (PRIOR ART)
FIG. 44 is a front view of the rifle of FIG. 43.
Figure 45:
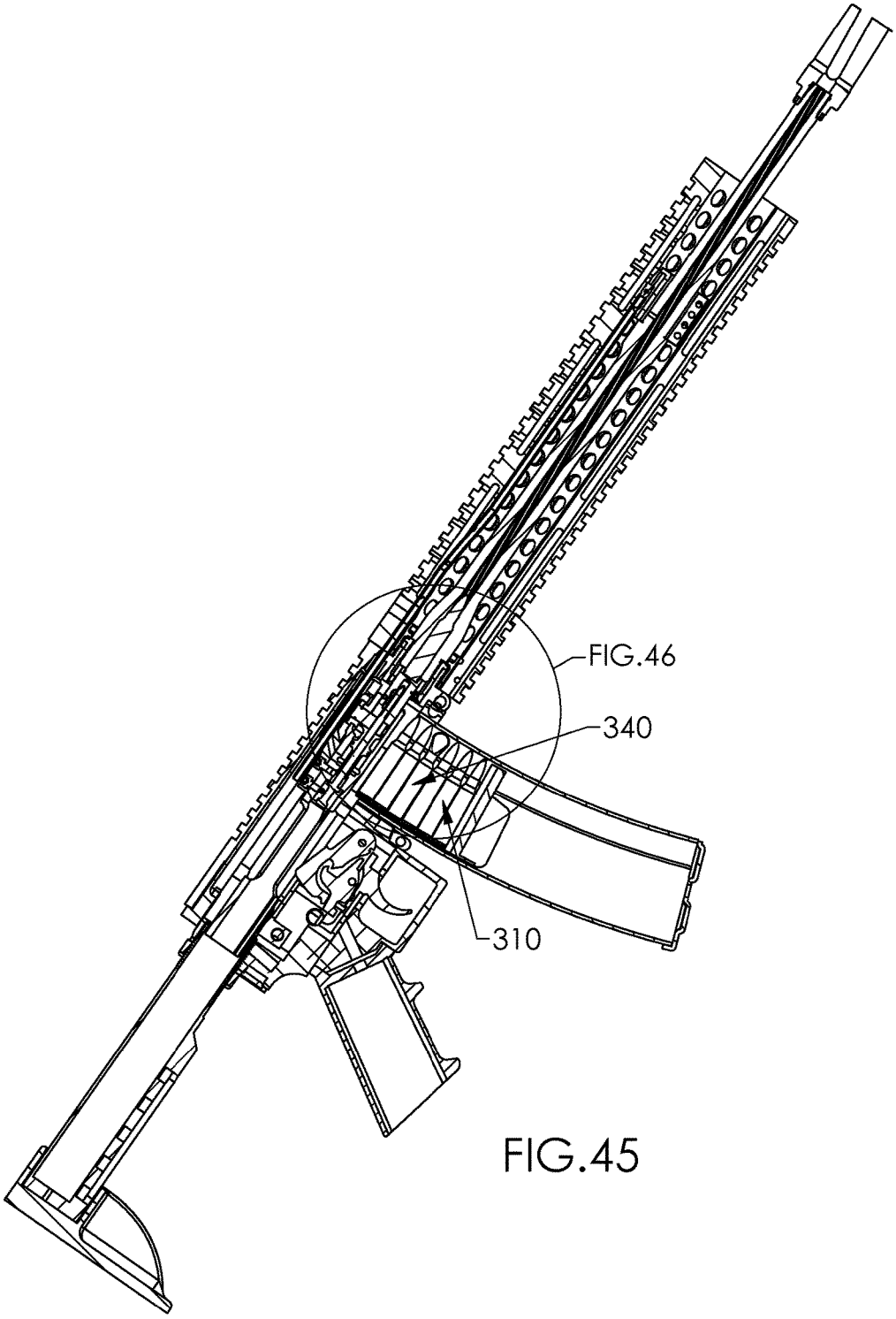
FIG. 45 is a right side cross-sectional view along the line 45-45 in FIG. 44, showing multiple live rounds and the malfunction round of FIGS. 35-39 loaded in the magazine of the rifle of FIGS. 43 and 44, and showing a chambered live round in the chamber of the rifle.
Figure 46:
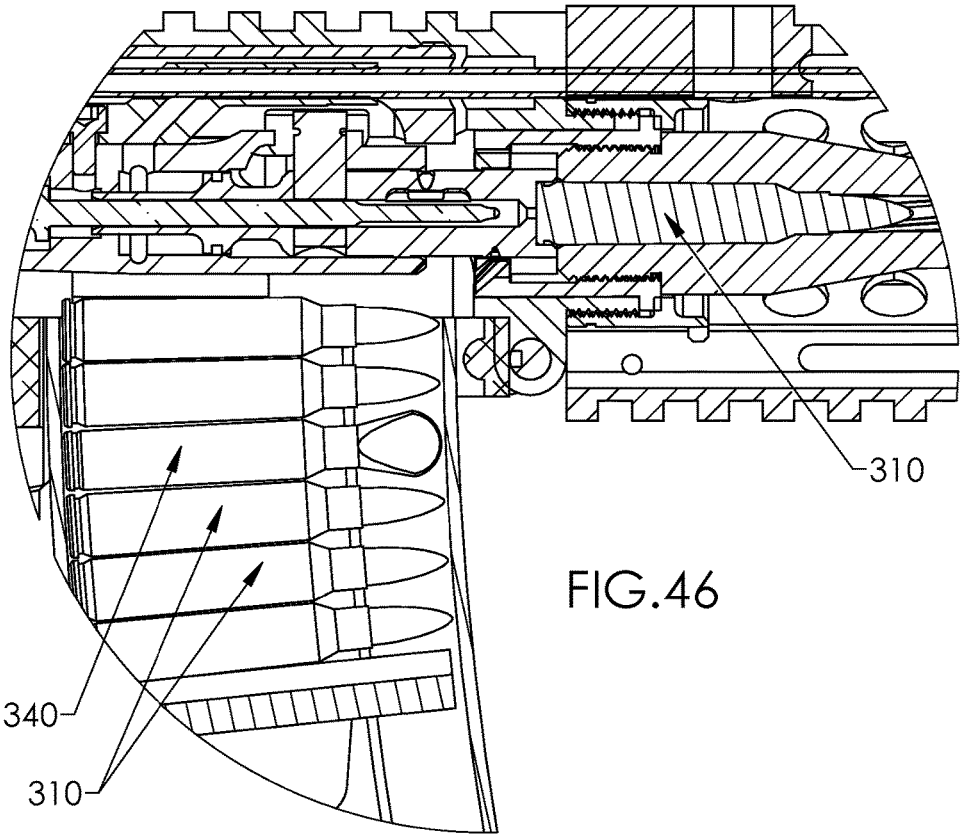
FIG. 46 is an enlarged view of the circled area of FIG. 45.
Figure 47:
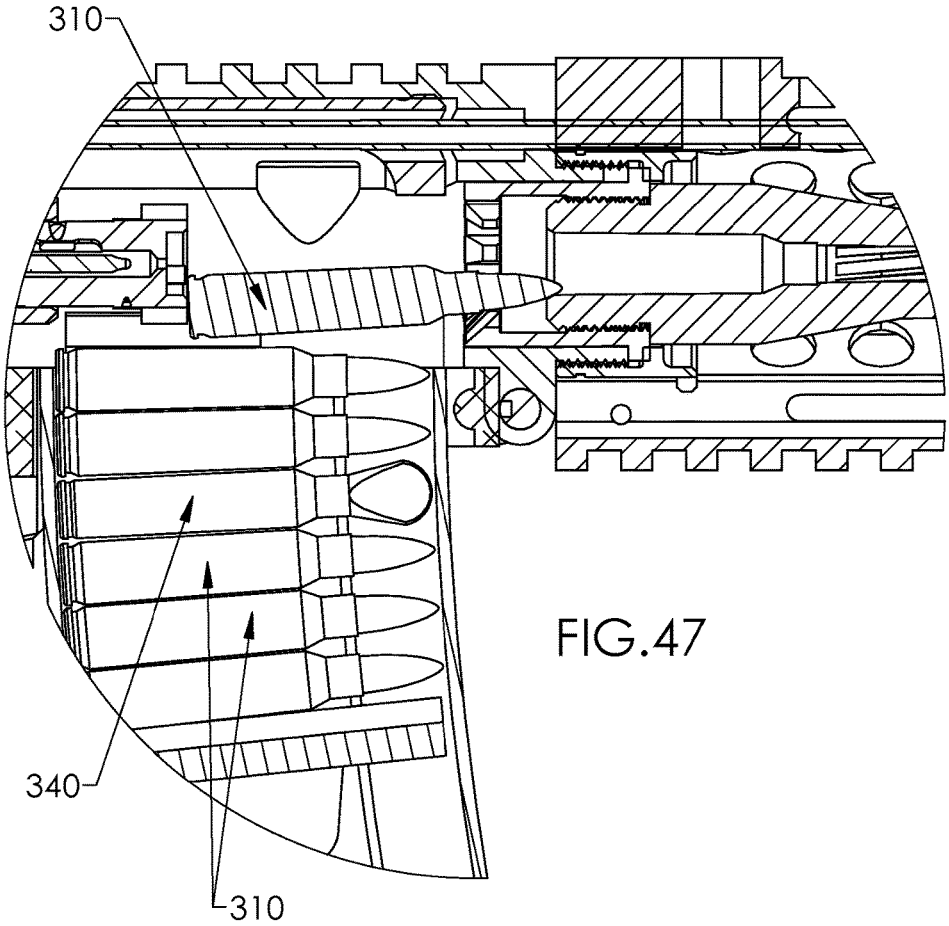
FIG. 47 is an enlarged view of the circled area of FIG. 45, wherein a live round is being loaded into the chamber, for comparison to FIG. 48.

As discussed above for round 240, malfunction round 340 is adapted to have dimensions and a shape so that the round 340 can fit and work well inside a magazine in which a corresponding exemplary prior art round 310 is used. FIG. 41 and FIG. 42, depict, respectively, the same conventional magazine 320 loaded with an exemplary prior art round 310, and a malfunction round 340. Note that the malfunction round 340 visible in FIG. 42 (and all of the rounds 340 in the magazine) are loaded so that that the flats F3 and F4 are generally vertical, and facing toward the left and right sidewalls of the magazine. The inventor has found this to be especially important for the "universality" of the round's 340 fit and smooth operation in, and smooth travel through, many magazines.

Each live ammunition round 310 and each malfunction round 340 operates properly in the magazine 320, fitting properly in, and moving smoothly along the length of, the magazine 320 to reach the top position in the magazine shown in FIGS. 41 and 42, without interfering with the higher-up or lower-down live round(s) 310 or malfunction round(s) 340 in the magazine. For training, one or more of the malfunction rounds 340 will be stacked with one or more corresponding live rounds 310 in a single magazine 320, with relative numbers of live and malfunction rounds and the order and position of stacking in the magazine being determined by the trainer, as discussed above.

When malfunction round 340 reaches the top of the magazine, the oversized nature of the enlarged protrusions P3 and P4 causes front end 346 to not fit properly or entirely through the breech, and therefore, to not fit properly or entirely in the chamber as would live round 310. This way, round 340 stops at or partly-extending into the breech, thereby jamming and disabling the firearm according to a simulated T3 malfunction. The effect of the dimensions of the malfunction round 340 vs the live round 310 is illustrated by comparing FIGS. 43-47 for a live round 310, to FIG. 48 for the malfunction round 340.

Figure 48:
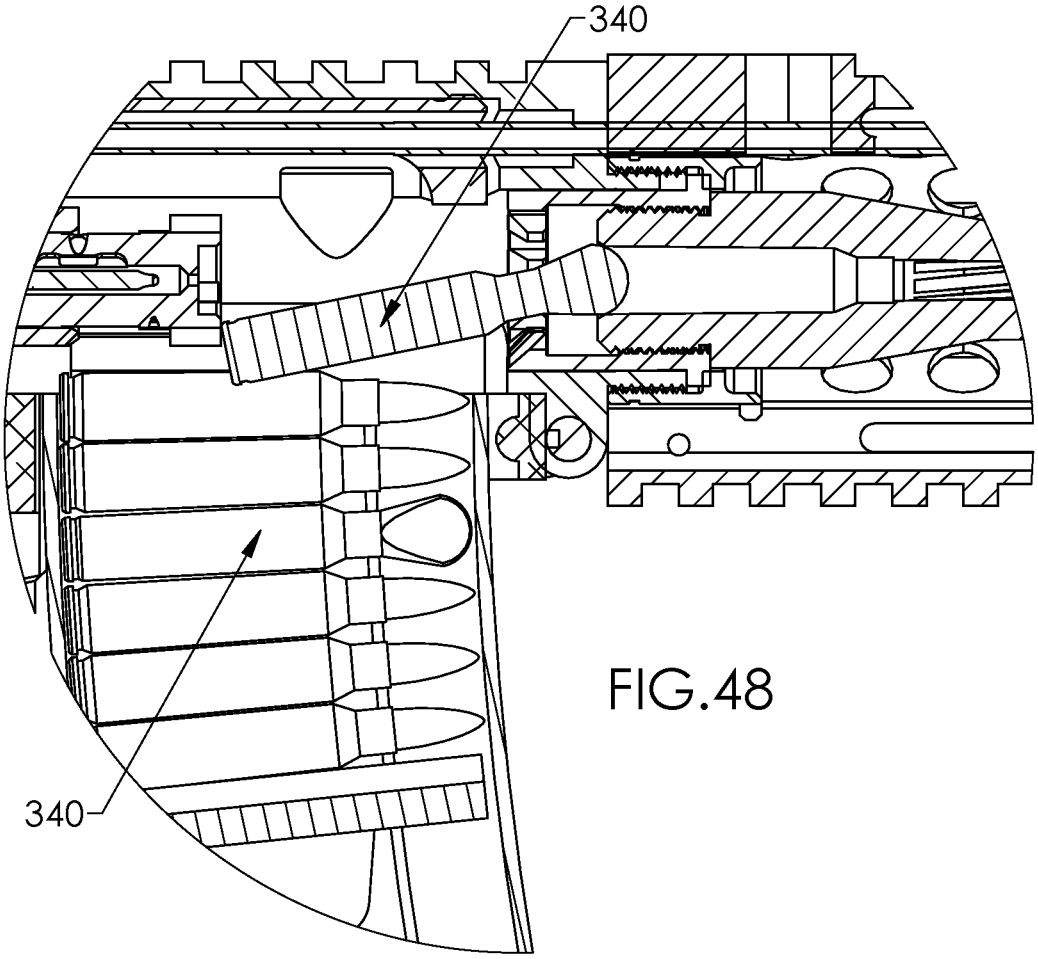
FIG. 48 is an enlarged view of the circled area of FIG. 45, with no round in the chamber, wherein a T3 malfunction that has been simulated by the presence of the malfunction round of FIGS. 35-39, becoming jammed at the entrance to the chamber of the rifle, that is, at/near the breech.

In FIG. 48, a T3 malfunction has been simulated by the presence of malfunction round 340. Malfunction round 340 is partially protruding from the magazine and jammed at the entrance to rifle chamber, particularly at/in the breech. In this situation, the prior, spent round has been properly ejected, and the malfunction round 340 is the first round at the top of the magazine. Therefore, unlike a natural T3 Malfunction in a rifle, there is no round or any other object in conventional position in the breech/chamber blocking round 340 from entering the rifle chamber. Instead, it is the enlargement of the front end 346 that prevents round 340 from properly/fully passing through the breech and entering the chamber.

Malfunction Round 440 and FIGS. 49-53:

Malfunction round 440 is an especially-preferred embodiment for a conventional 9 mm caliber automatic pistol. Malfunction round 440 is of the type of, and very similar to the malfunction round shown in FIG. 6C, having radially-enlarged, flared front end portions ("protrusions" or "fins"), and front end portions separating the protrusions that are curved, and generally elliptical, rather than being planar.

Figure 49:
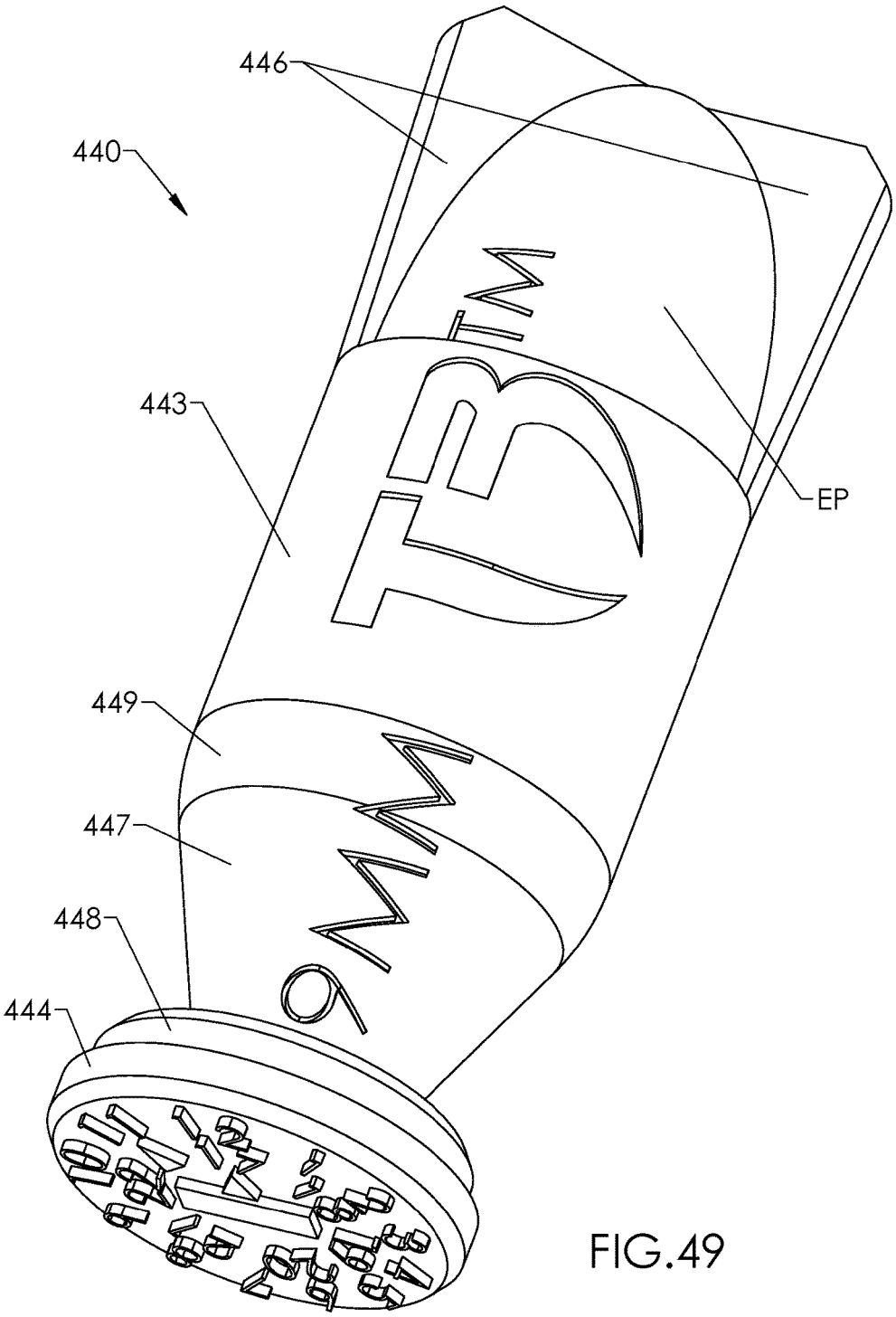
FIG. 49 is a side perspective view of a malfunction round according to an alternative embodiment of the invention, of the type of, and very similar to, the malfunction round of FIG. 6C.
Figure 50:
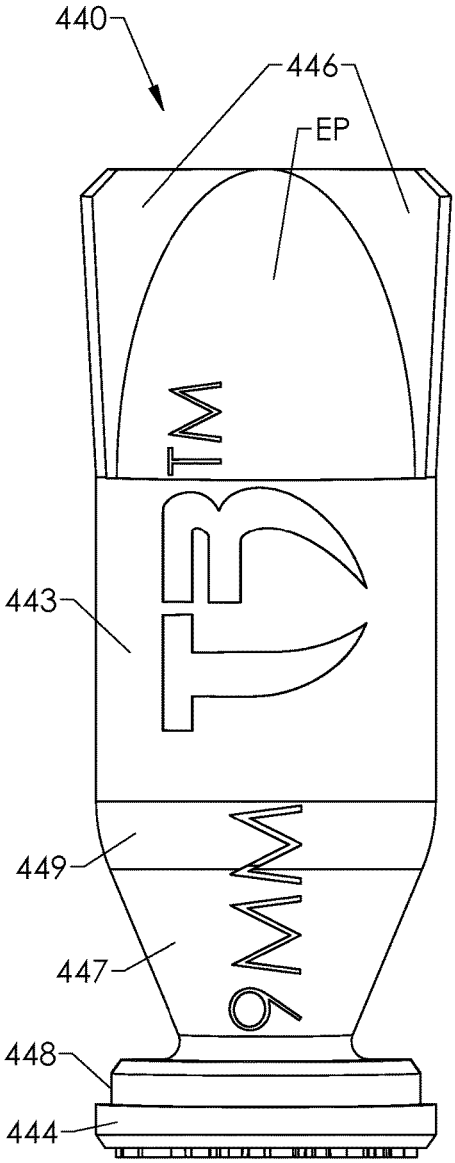
FIG. 50 is a right-side view of the malfunction round of FIG. 49, wherein the left-side view is a mirror image of the right-side view except for the indicia.
Figure 51:
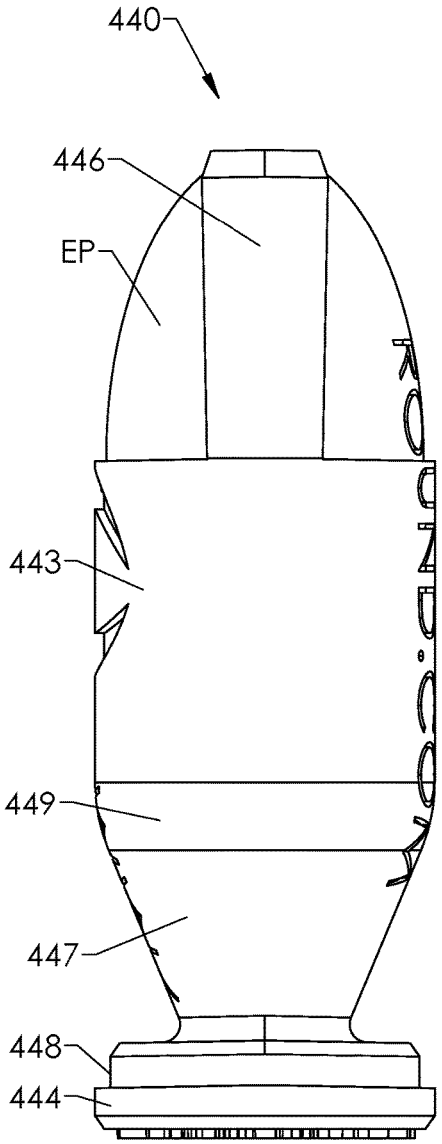
FIG. 51 is a top-side view of the malfunction round of FIG. 49, wherein the bottom-side view is a mirror image of the top-side view except for the indicia.

FIG. 49 is a side perspective view, and FIGS. 50 and 51 are side views, that illustrate important features of the malfunction round 440 that will be understood by viewing these figures, given the description above, especially of malfunction rounds 40 and 240. Malfunction round 440 comprises many features that are similar to those of malfunction round 240, and operates similarly to the operation of round 240. Due to its specially-adapted main body 442 and front end, malfunction round 440 may be used in many firearms that receive live round 10, for example, with only slight modifications in its dimensions.

Like round 240, malfunction round 440 comprises a cylindrical or generally cylindrical central main portion 443 and rearmost base/back end 444, and a conical portion 447 between the main portion 443 and the base/back end 444. Forward of main portion 443 is the over-sized front end comprising two spaced-apart, radially-protruding, oversized front end portions, that is, protrusions 446 that flare outward from nearer the main portion 443 to their maximum dimension/diameter (Z') near the front extremity of the malfunction round 440. In addition to accomplishing the desired jamming at the breech, the flared protrusions provide a "stream-lined" shape that does not snag on the live rounds above and below the malfunction round 440 in the magazine, and can even serve as a ramp for smooth movement of the live round above malfunction round 440. The oversized front-end protrusions 446 of malfunction round 440 will be well-understood in view of the discussion above regarding other embodiments, and in view of the drawings.

Malfunction round 440 is further-adapted for compatible fit and proper operation in the magazine, namely, due to: 1) the relatively-recessed elliptical portions EP between the oversized, 180 degree-apart, front end protrusions 446, 2) the conical portion 447 being axially-elongated and radially-undersized; and 3) the presence of a circumferential groove 448 in the outer perimeter surface of the base 444, and 4) the presence of a curved transition 449 from the main portion 443 to the conical portion 447. These features specially-adapt the malfunction round 440 to: 1) fit and move properly inside the magazine and not interfere with movement of the surrounding live rounds 10 in the magazine; and 2) to fit and move properly through the magazine top opening, including that the malfunction round separates from the magazine when the magazine is stripped from the firearm in the first/early step in the malfunction clearing procedure, typically flying out of the magazine top opening and falling to the ground for the subsequent clearing steps of "racking" the slide mechanism. These four features are further discussed below.

Figure 21:
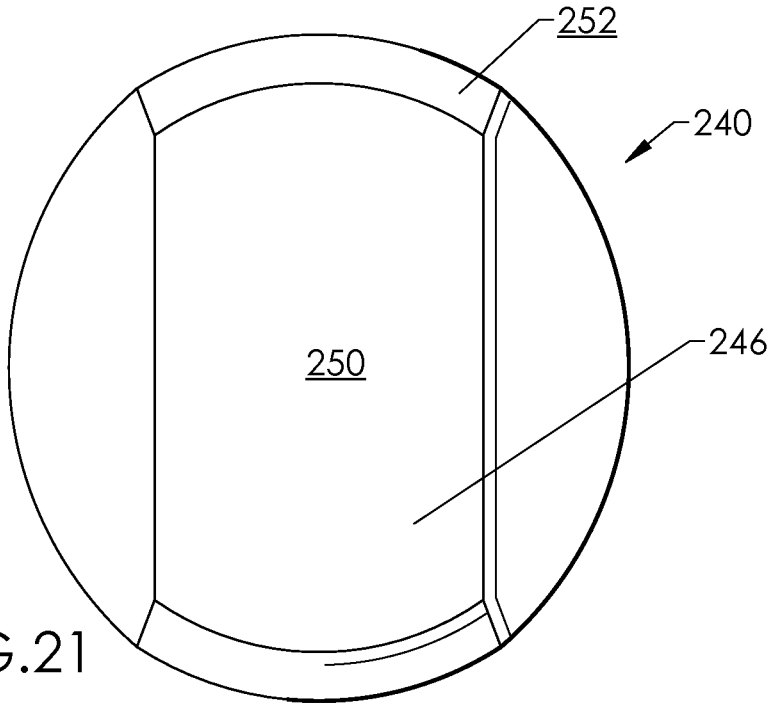
FIG. 21 is front view (or "front end" view) of the malfunction round of FIGS. 20A and B.
Figure 22:
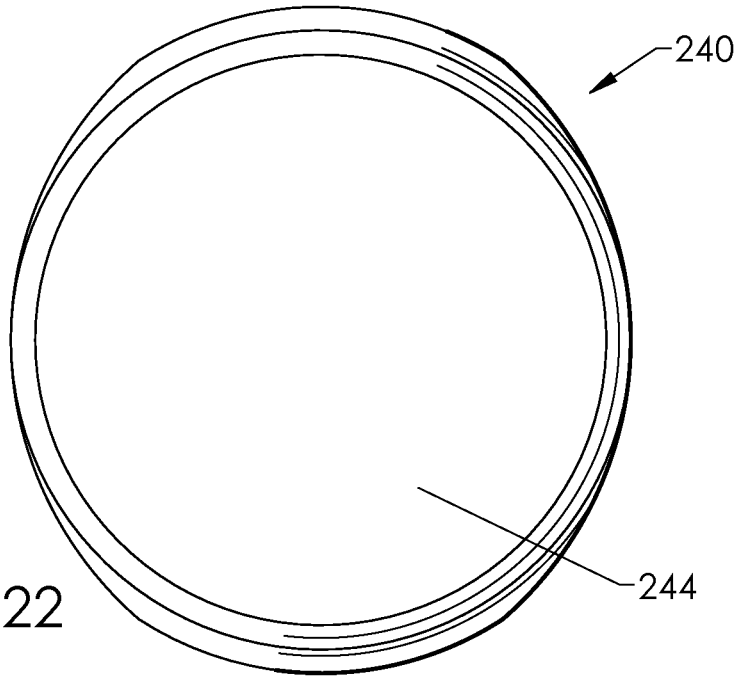
FIG. 22 is a rear view (or "rear end" view) of the malfunction round of FIGS. 20A and B.
Figure 52:
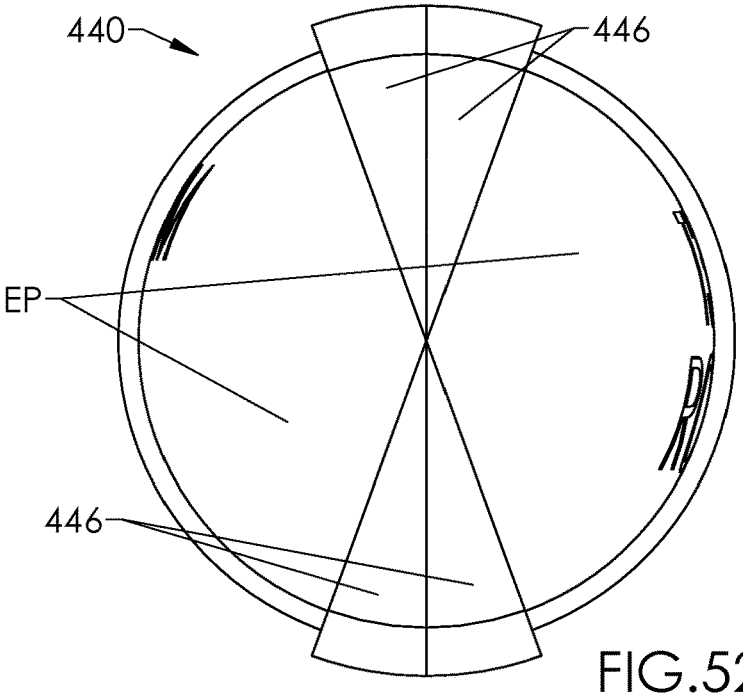
FIG. 52 is a front view (or "front end" view) of the malfunction round of FIG. 49.
Figure 53:
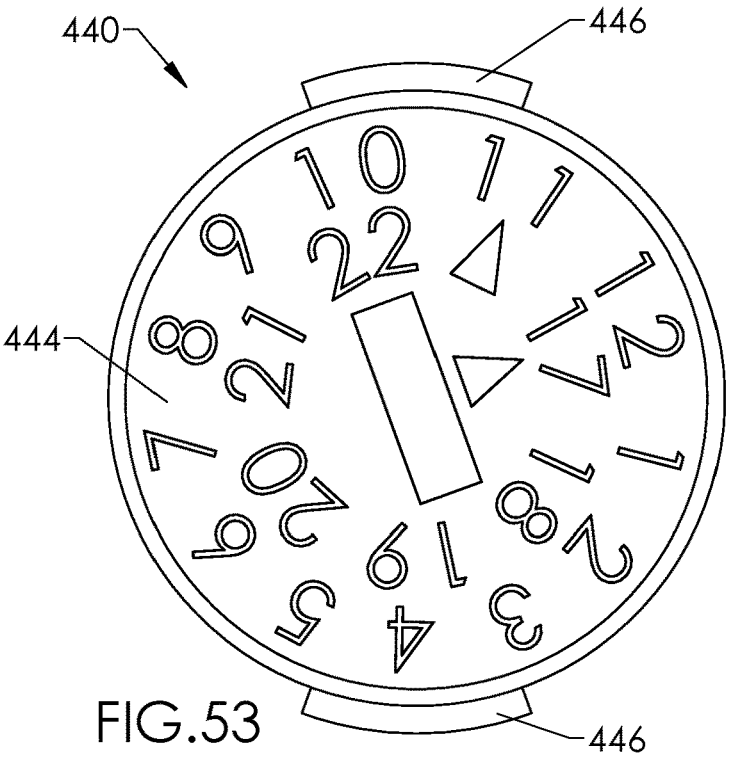
FIG. 53 is a rear view (or "rear end" view) of the malfunction round of FIG. 49.

Comparing side views FIGS. 50 and 51 of round 440, to FIGS. 23 and 24 of malfunction round 240, and comparing front end view FIG. 52 of round 440, to FIG. 21 of malfunction round 240, illustrates to best advantage the differences between protrusions with flat separating portions, and protrusions 446 with elliptical separating portions EP. The elliptical portions, though curved rather than flat or planar, are still relatively-recessed compared to the protrusions 446, and hence are recesses between the protrusions. The elliptical portions EP are much like the curvature of portions of the projectile of live round 10, and so the front end of the malfunction round 440 at the elliptical portions is smaller in diameter than the breech. These elliptical portions EP cover much of the front end of the malfunction round 440, while the protrusions 446 cover only a relatively small portion of the front end. For example, the two protrusions 446 may be described as extending around only a total of about ¼ or less of the circumference of the front end. On the other hand, the two protrusions of round 240 cover/extend-around a total of more than ⅓ of the circumference of the front end. Thus, malfunction round 440 is an example of optimizing the desirable jamming effect caused by the protrusions, while making the protrusions narrow and minimal in circumferential size. For example, this narrow and minimal size may reduce/eliminate the effect the protrusions 446 have on the other movements of round 440, particularly its travel inside the magazine and its separation from the magazine. Therefore, the front end of malfunction round 446 may be described as mainly elliptical, and therefore benefits from looking somewhat like a projectile of a conventional live round, which may help the user learn how to load the round 440 in the magazine. The rear end 444 is substantially flat, and looks somewhat like the base/primer end of a conventional live round, which may further help the user learn how to load the round 440 in the magazine. Note that the rear end 444 comprises indicia on its rear radial surface, for example, which may be stamped or otherwise marked to indicate the month and year of the manufacture of the malfunction round.

The undersized-diameter conical portion 447 extends from the main portion 443, toward the back/back end 444, decreasing to its smallest diameter at or near the base/back end 444. The smallest diameter is preferably about half of the diameter (W') of the main portion and preferably about 40-48 percent of the enlarged front end protrusion 446 dimension (Z'). As discussed above for conical portion 247, conical portion 447 is instrumental in creating a realistic training experience, by allowing the round 440 to separate from and leave the magazine, typically falling to the ground, when the magazine is stripped from the firearm, to place the round 440 away from the magazine and away from the firearm for the rest of the clearing and correction protocol.

Curved/radiused transition 449 is provided between the main portion 443 and the conical portion 447. Curved transition 449 prevents a live round, adjacent to the malfunction round 440 in the magazine, from catching/snagging on this region of the malfunction round 440 during the necessary relative movement of the live round relative to round 440 in the magazine. The transition 449 is therefore rounded to prevent there from being a corner against-which or with-which the shoulder of the live round might catch/snag.

Figure 6H:
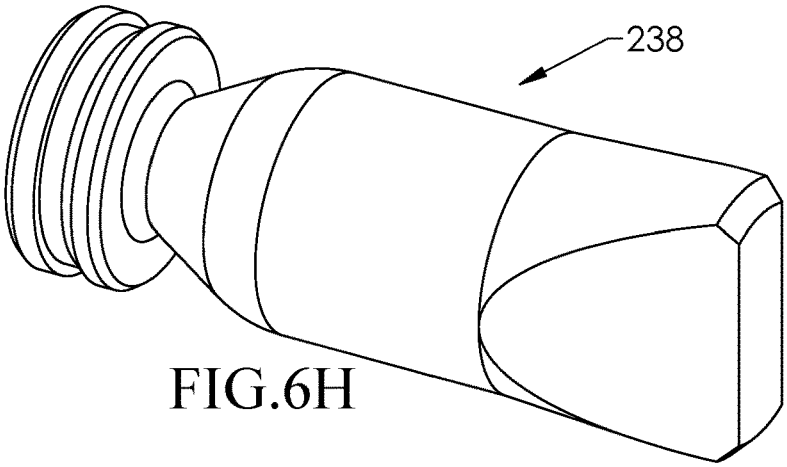
Figure 6I:
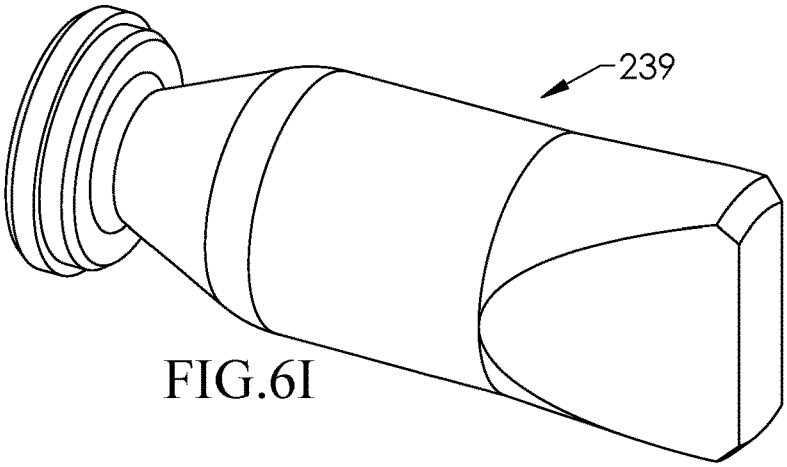

The circumferential groove 448 is provided in the base/back-end 444 for improved movement in certain magazines. The groove 448, in this and certain other embodiments, may be described as a portion of the base/back-end 444 that is reduced in diameter compared to the rearmost portion of the base/back-end 444 while still being larger in diameter than the smallest-diameter portion of the conical portion 447. This circumferential groove/recession preferably has a diameter about 0.7-0.9 times the diameter of the rearmost portion of the base/back-end 444 and about 1.6 to 1.8 times of the diameter of the smallest-diameter portion of the conical portion 447. It may be noted that a circumferential groove is also shown in the embodiments of FIGS. 6C, H, and I, and in Appendix C of Provisional Application Ser. No. 62/452,728, incorporated herein. The circumferential groove in FIG. 6H is midway along the longitudinal axis of the base/rear-end of the malfunction round, so that it is in-between two portions of the base/rear-end having larger diameter(s) than does the groove.

The inventor has found that the circumferential groove is necessary in certain embodiments of the malfunction round to ensure universal compatibility of the malfunction round to all semi-auto handguns. The inventor has successfully tested malfunction round 440 in many makes and models of pistols, for example 30-40 semi-automatic pistols. However, one pistol, the Sig Sauer P220, has a magazine with tabs/protrusions that protrude into the magazine and hence would interfere with malfunction round 240, and certain other embodiments, from moving through that magazine. The circumferential groove of round 440 and certain other embodiments, however, which prevents said inward-protruding magazine tabs/protrusions from interfering with smooth movement of malfunction round through the magazine, to make the malfunction round universal to all, or at least 30 different makes and models of, semi-automatic pistols/handguns.

Of note is that this round 440 may effectively be made of nylon 6/6 with 33% fiberglass fill, to protect the steel parts of the firearms in which it is used. And, the round 440, despite of its protrusions 446 and the groove 448, resembles a live round closely enough that a user will intuitively understand how to load the round 440 and, upon seeing the round 440 and receiving a short tutorial or explanation, will likely understand the operation and function of the round 440.

The structure of malfunction round 440, and the methods and benefits of using it, may be further understood by reading and viewing the Summary, and the Detailed Description regarding malfunction round 40, 240, and 340. One may understand from FIGS. 1-48 regarding malfunction rounds 40, 240, and 340, how round 440 will be loaded in a magazine, used to create a simulated T3 malfunction during firearm training, and the benefits thereof. For example, while dimensions W' and Z' are not drawn on FIGS. 49-53, the location of these dimensions relative to malfunction round 440 will be clearly understood from the previous discussion and the drawings that do include these dimensions. Further, in the Summary of the Invention above, throughout the Detailed Description of the Invention, and in the accompanying drawings, including of the Provisional Applications incorporated herein, reference is made to particular features (including method steps) of certain embodiments of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally.

In summary, to accomplish this purposeful, simulated T3 Malfunction, malfunction rounds, 40, 240, 340, and 440, including the malfunctions rounds shown in Appendices B, C and E of the Provisional Ser. No. 62/452,728, are built to specifications that configure the malfunction round so that it does not have a compatible fit with, and does not operate properly/conventionally in, each of the breech and the chamber. This is preferably done by radially enlarging at least a portion of the front end of the malfunction round to an extent that the front end does not fit properly/conventionally through the breech. This also results in the front end also not fitting in the chamber or the barrel bore, which are smaller in I.D. than the breech, The front end enlargement may be described as a configuration/adaptation wherein at least one portion of the front end radially protrudes a distance, from the longitudinal axis of the malfunction round, that is greater than the breech radius, so that said at least one portion of the front end, and preferably two or more portions spaced around the circumference of the front end, has a diameter greater than the breech diameter and is enlarged compared to the breech. Said at least one portion of the front end diameter also is larger in diameter than one or more, but preferably all, of the following dimensions: A) the chamber I.D.; B) the barrel bore I.D.; C) the nominal caliber of the firearm and its corresponding live round; D) the maximum-diameter of the projectile of the corresponding live round; E) the maximum-diameter of the casing (such as 12) of the corresponding live round; and F) the diameter of the distal end/edge of the casing (such as 12) of the corresponding live round. It is preferred that the enlarged front end or front end portion of the malfunction round have an enlarged outer diameter (Z') that is greater than the breech diameter, more preferably that said enlarged outer diameter is at least 0.005 inches greater than the breech diameter. To account for manufacturing variances in both firearms and the malfunction rounds, certain malfunction round embodiments have specifications that call for the dimension Z' to be about 0.01 up to about 0.02 inches greater than the breech diameter, and most preferably about 0.02 inches greater than the breech diameter. Further, the enlarged outer diameter Z' is preferably the largest diameter of any portion of the malfunction round, which preferably has no piece/part that protrudes radially from the longitudinal axis of the round a distance greater from the longitudinal axis than do the enlarged front end/portions.

Although this invention has been described above with reference to particular means, materials, and embodiments, it is to be understood that the invention is not limited to these disclosed particulars, but extends instead to all equivalents within the broad scope of this disclosure and the scope of the following claims.

The invention claimed is:

1. A combination of a semi-automatic firearm having a magazine with an internal diameter, a chamber, and a breech opening into the chamber, the breech opening having a breech diameter, and a blank malfunction round for use in training in the firearm, wherein the malfunction round is configured to be operative in the magazine, and the malfunction round is configured to be inoperative in the breech opening, by the malfunction round comprising a front end portion having a diameter larger than said breech diameter, so that the malfunction round abuts into one or more surfaces of the breech opening, but does not fully pass through the breech opening into the chamber.

2. The combination of claim 1, wherein said front end portion is cylindrical and has a generally flat, radial front surface.

3. The combination of claim 1, wherein the front end comprises multiple radially-extending protrusions and recessed surfaces between the protrusions, wherein the diameter of said front end at the protrusions is larger than said breech diameter and the diameter of said front end at the recessed surfaces between the protrusions is smaller than said breech diameter.

4. The combination of claim 3, wherein the multiple radially-extending protrusions comprise only two protrusions 180 degrees apart.

5. The combination of claim 4, wherein the recessed surfaces between the protrusions are flat and are 180 degrees apart.

6. The combination of claim 4, wherein the recessed surfaces between the protrusions are elliptical and are 180 degrees apart.

7. The combination of claim 1, wherein the diameter of the front end is at least 0.005 inches greater than the breech diameter.

8. The combination of claim 1, wherein the diameter of the front end is at least 0.01 inches greater than the breech diameter.

9. The combination of claim 1, wherein the diameter of the front end is 0.01 up to 0.02 inches greater than the breech diameter.

10. The combination of claim 3, wherein the diameter of the front end at the protrusions is at least 0.005 inches greater than the breech diameter.

11. The combination of claim 3, wherein the diameter of the front end at the protrusions is at least 0.01 inches greater than the breech diameter.

12. The combination of claim 3, wherein the diameter of the front end at the protrusions is 0.01 up to 0.02 inches greater than the breech diameter.

13. The combination of claim 1, wherein the malfunction round has a longitudinal axis and a length between the front portion and a rearmost base, a main portion rearward of the front portion, and a conical portion between the main portion and the base that extends axially in a range of 15-30 degrees to the longitudinal axis of the malfunction round.

14. A combination of a semi-automatic firearm having a magazine with an internal diameter, a chamber, and a breech opening into the chamber, the breech opening having a breech diameter, and a blank malfunction round for use in training in the firearm, wherein the malfunction round is configured to be operative in the magazine, and the malfunction round is configured to be inoperative in the breech opening, by the malfunction round comprising a front end portion having a diameter larger than said breech diameter, so that the malfunction round abuts into one or more surfaces of the breech opening, but does not fully pass through the breech opening into the chamber; wherein the malfunction round has a longitudinal axis and a length between the front portion and a rearmost base, a main portion rearward of the front portion, and a conical portion between the main portion and the base that extends axially in a range of 15-30 degrees to the longitudinal axis of the malfunction round; and wherein the conical portion extends along 15-30 percent of the length of the malfunction round, so that the malfunction round separates from the magazine when the magazine is stripped from the firearm after a simulated breech jam.

15. The malfunction round of claim 1, wherein the front end diameter is the largest diameter of any portion of the malfunction round.

16. The malfunction round of claim 3, wherein the diameter at the protrusions is the largest diameter of any portion of the malfunction round.

17. A blank malfunction round for use in a firearm with a breech opening and a magazine, for training a user to handle a breech jam malfunction of the firearm, the malfunction round having a front end, a rear base, a longitudinal axis and a length between the front end and the base, a main portion rearward of the front portion, and a conical portion between the main portion and the base, wherein the front end has a maximum diameter that is enlarged in diameter compared to all of the base, main portion, and the conical portion, so that the front end jams in the breech opening, and wherein the conical portion extends axially along 15-30 percent of the length of the malfunction round, at 15-30 degrees to the longitudinal axis of the malfunction round, so that the malfunction round separates from the magazine upon stripping of the magazine from the firearm.

18. The malfunction round of claim 17, wherein the front end comprises multiple radially-extending protrusions and multiple recessed surfaces between the protrusions, wherein said front end maximum diameter extends through at least one of the protrusions.

19. The malfunction round of claim 17, wherein the front end comprises two radially-extending protrusions at 180 degrees apart, and recessed surfaces between the protrusions, wherein said front end maximum diameter extends through the protrusions.

20. The malfunction round of claim 19, wherein the recessed surfaces are selected from the group consisting of: flat surfaces, planar surfaces, elliptical surfaces, and curved surfaces.

21. The malfunction round of claim 17, wherein the base comprises a circumferential groove near the conical portion so that the malfunction round moves smoothly through the magazine of the firearm.

* * * * *